US008405323B2

(12) United States Patent
Finney et al.

(10) Patent No.: US 8,405,323 B2
(45) Date of Patent: Mar. 26, 2013

(54) METHOD AND APPARATUS FOR SIGNAL PRESENTATION

(75) Inventors: Joseph Finney, Bay Horse (GB); Alan John Dix, Kendal (GB)

(73) Assignee: Lancaster University Business Enterprises Limited (GB)

( * ) Notice: Subject to any disclaimer, the term of this patent is extended or adjusted under 35 U.S.C. 154(b) by 1178 days.

(21) Appl. No.: 12/224,650

(22) PCT Filed: Mar. 1, 2007

(86) PCT No.: PCT/GB2007/000708

§ 371 (c)(1), (2), (4) Date: Aug. 29, 2008

(87) PCT Pub. No.: WO2007/099318

PCT Pub. Date: Sep. 7, 2007

(65) Prior Publication Data

US 2009/0051624 A1 Feb. 26, 2009

Related U.S. Application Data

(60) Provisional application No. 60/781,122, filed on Mar. 9, 2006.

(30) Foreign Application Priority Data

Mar. 1, 2006 (GB) ..... 0604076.0

(51) Int. Cl.
*H05B 37/02* (2006.01)
*H05B 41/36* (2006.01)

(52) U.S. Cl. ..... 315/312; 315/294; 315/130

(58) Field of Classification Search ..... 315/130, 315/291, 294, 312; 340/500; 345/30
See application file for complete search history.

(56) References Cited

U.S. PATENT DOCUMENTS

| | | | | |
|---|---|---|---|---|
| 6,005,501 | A * | 12/1999 | Wolosewicz | 341/52 |
| 6,545,586 | B1 | 4/2003 | Belliveau | |
| 2002/0047646 | A1 | 4/2002 | Lys et al. | |
| 2002/0078221 | A1 | 6/2002 | Blackwell et al. | |
| 2005/0248299 | A1* | 11/2005 | Chemel et al. | 315/312 |
| 2005/0249037 | A1* | 11/2005 | Kohn et al. | 367/117 |
| 2006/0205417 | A1* | 9/2006 | Ju et al. | 455/456.5 |

(Continued)

FOREIGN PATENT DOCUMENTS

| | | | |
|---|---|---|---|
| EP | 0591899 | A1 | 4/1994 |
| EP | 1455482 | A1 | 9/2004 |

(Continued)

OTHER PUBLICATIONS

International Search Report for International Application No. PCT/GB2007/000708 dated Jul. 19, 2007, 4 pages.

(Continued)

*Primary Examiner* — Don Le
(74) *Attorney, Agent, or Firm* — Pillsbury Winthrop Shaw Pittman LLP

(57) ABSTRACT

A method and apparatus for presenting an information signal such as an image signal or a sound signal using a plurality of signal sources. The plurality of signal sources are located within a predetermined space, and the method comprises receiving a respective positioning signals from each of said signal sources, generating location data indicative of locations of said plurality of signal sources, based upon said positioning signals, generating output data for each of said plurality of signal sources based upon said information signal and said location data, and transmitting said output data to said signal sources to present said information signal.

37 Claims, 47 Drawing Sheets

U.S. PATENT DOCUMENTS

| | | | | |
|---|---|---|---|---|
| 2008/0203928 | A1* | 8/2008 | Frumau et al. | 315/151 |
| 2011/0062888 | A1* | 3/2011 | Bondy et al. | 315/294 |
| 2011/0190913 | A1* | 8/2011 | Van De Sluis et al. | 700/94 |
| 2012/0022826 | A1* | 1/2012 | Giesekus | 702/150 |

FOREIGN PATENT DOCUMENTS

| | | | |
|---|---|---|---|
| FR | 2832587 | A1 | 11/2001 |
| WO | WO 02/13490 | A2 | 2/2002 |
| WO | WO 02/101702 | A2 | 12/2002 |
| WO | WO 2004/057927 | A1 | 7/2004 |

OTHER PUBLICATIONS

Written Opinion for International Application No. PCT/GB2007/000708 dated Jul. 19, 2007, 6 pages.

* cited by examiner

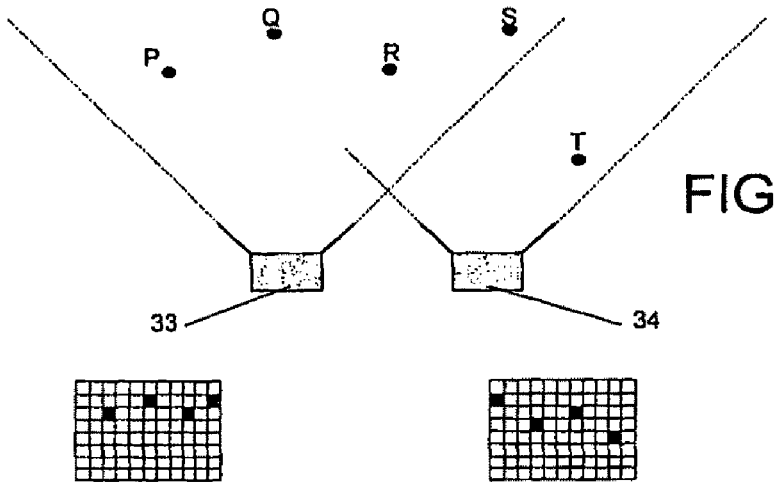
FIG 10
FIG 10A
FIG 10B
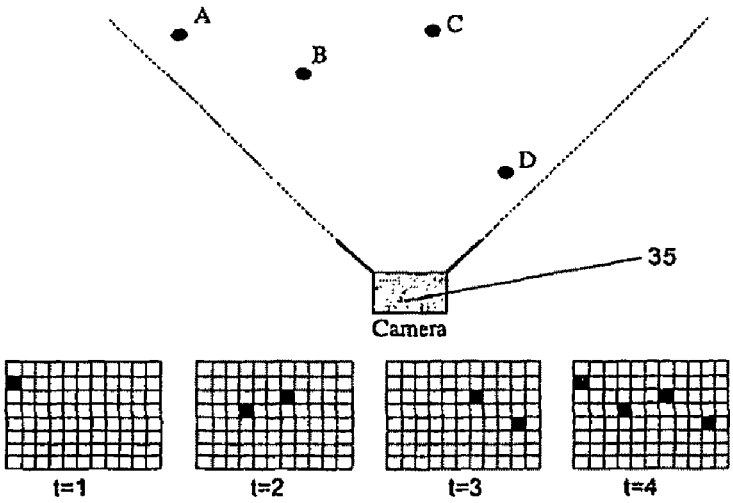
FIG 11
FIG 11A

METHOD AND APPARATUS FOR SIGNAL PRESENTATION

RELATED APPLICATIONS

This application claims priority under 35 U.S.C. §119(a) to both British Patent Application No. 0604076.0, filed 1 Mar. 2006, U.S. Provisional Patent Application No. 60/781,122, filed 9 Mar. 2006, and International Application PCT/GB2007/000708, filed 1 Mar. 2007, which designated the U.S. and that International application was published under PCT Article 21(2) in English.

The present invention relates to methods and apparatus for locating signal sources, and methods and apparatus for presenting information signals using such signal sources.

It is well known to use strings of lights for decorative purposes. For example, it has long been commonplace to place strings of lights on Christmas trees for decorative effective. Lights have similarly been placed on other objects such as trees and large plants in public places. Such lights have, in recent times, been coupled to a control unit capable of causing the lights to turn off and on in various predetermined manners. For example, all lights may "flash" on and off together. Alternatively the lights may turn off and on in sequence with respect to lights adjacent to one another in the string, so as to cause a "chasing" effect. Many such effects are known, and all have in common that the effect applies to all lights, to a random selection of lights, or to lights selected by reference to their relative position to one another within the string of lights.

Decorative lights of the type described above are also sometimes fixedly attached to a surround in a predetermined configuration, such that when the lights are illuminated, the lights display an image determined by the predetermined configuration. For example, the lights may be attached to a surround in the shape of a Christmas tree, such that when the lights are illuminated, the outline of a Christmas tree is visible. Similarly, lights have been arranged to display letters of the alphabet, such that when a plurality of such letters are combined together words are displayed by the lights.

Heretofore, where more complex images were to have been displayed, an array of lighting elements has been used, the lighting elements of the array being fixed relative to one another. A processor can then process image data and data representing the fixed position of the lights, to determine which lights should be illuminated to display the desired image. Such arrays can take the form of a plurality of light bulbs or similar light emitting elements, however it is more common that the lights are much smaller, and collectively form an liquid crystal display (LCD) or plasma screen. Indeed, this is the manner in which images are displayed on modern day flat-screen monitors, lap-top screens and many televisions.

It should be noted that all of the methods described above are based upon a fixed relationship between lighting elements, the fixed relationship being used in the image display process.

In recent times, it has become reasonably commonplace for televisions, and audio-visual amplifiers to be provided with a plurality of speakers. Typically, a front central speaker is co-located with a display screen, with front right and front left speakers being arranged to either side of the display screen in a conventional stereo arrangement. Additionally, at least two speakers are positioned behind a position intended to be adopted by a viewer, so as to allow "surround sound" effects to be provided. For example, in a video display sequence if an aircraft enters a displayed image at the bottom left hand corner of the screen, and leaves a displayed image some frames later at the top right hand corner of the screen, over the course of video display, aircraft sound may initially be transmitted through the rear left speaker, and later through the front right speaker so that transmitted sound gives the impression of aircraft movement. Such effects provide an impression of increased involvement with the displayed image for a viewer.

It should be noted that the sounds to be transmitted through the various speakers are determined at the time at which the audio and visual data are created. However, when the equipment described above is installed within a viewer's home, minor adjustments (e.g. to the relative volumes of various speaker outputs) may be made so as to compensate, for example, for differing distances between the viewer's intended position and the front speakers, and the viewer's intended position and the rear speakers.

It should be noted that surround sound systems of the type above always comprise a plurality of speakers arranged in a predetermined manner, with variation being possible only to compensate for slight differences is location and distance. Thus, the surround sound systems described above essentially allow sound to be presented using an array of speakers of predetermined configuration. That is, such speaker arrangements are the sonic equivalent of the display of images using fixedly arranged arrays of light elements as described above.

The systems described above, with reference to both light and sound emission, are both restrictive in their requirement that lights and speakers are arranged, at least in part, in a predetermined manner, thereby reducing the flexibility of the systems.

It is an object of embodiments of the present invention to obviate or mitigate at least some of the problems outlined above.

The present invention provides a method and apparatus for presenting an information signal using a plurality of signal sources, the plurality of signal sources being located within a predetermined space. The method comprises receiving a respective positioning signal from each of said signal sources, generating location data indicative of locations of said plurality of signal sources, based upon said positioning signals, generating output data for each of said plurality of signal sources based upon said information signal and said location data, and transmitting said output data to said signal sources to present said information signal.

Thus, the present invention provides a method which can be used to locate signal sources such as lighting elements, and then use these lighting elements to display an information signal. Such lighting elements may be arranged on a fixed structure such as a tree in a random manner. Thus, randomly arranged lighting elements can be located and then used to display a predetermined pattern such as an image or predetermined text.

Generating location data for a respective signal source may further comprise associating said location data with identification data identifying said signal source. Associating said location data with identification data identifying said signal source, may comprise generating said identification data from said positioning signal received from the respective signal source.

Each of said positioning signals may comprise a plurality of temporally spaced pulses, and in such cases, generating identification data for a respective signal source may comprise generating said identification data based upon said plurality of temporally spaced pulses. Each of said positioning signals may indicates an identification code uniquely identifying one of said plurality of signal sources within said plurality of signal source. Each of the positioning signals may be a modulated form of an identification code of a respective signal source. For example, Binary Phase Shift Keying modulation or Non Return to Zero modulation may be used.

Receiving each of said positioning signals may comprise receiving a plurality of temporally spaced emissions of electromagnetic radiation. The electromagnetic radiation may take any suitable form, for example, the radiation may be visible light, infra-red radiation or ultra-violet radiation.

In this document various reference is made to visible light, ultra violet light and infra red light. The meaning of such terms will be readily understood by those skilled in the art. However, it should be noted that infrared light typically has a wavelength of about 0.7 μm to 1 mm, visible Light has a wavelength of about 400 nm to 700 nm, and ultraviolet light has a wavelength of about 1 nm to 400 nm.

Receiving a positioning signal from each signal source may comprise receiving a positioning signal transmitted from each said signal source at a signal receiver, the signal receiver being configured to produce two-dimensional location data locating said signal source within a detection frame. Location data may then be generated based upon said position within said detection frame.

Receiving a positioning signal transmitted from each said signal source may comprise receiving said positioning signals using a camera. In preferred embodiments of the invention the camera includes a charge coupled device (CCD) sensitive to electromagnetic radiation. Generating said location data may further comprise temporally grouping frames generated by said camera to generate said identification data. Grouping a plurality of said frames to generate said identification data may comprise processing areas of said frames which are within a predetermined distance of one another.

Receiving said positioning signals may further comprise receiving a positioning signal transmitted from each said signal source at a plurality of signal receivers, the signal receivers each being configured to produce two-dimensional location data locating said signal source within a respective detection frame. Generating said location data may further comprise combining said two-dimensional location data generated by said plurality of signal receivers to generate said location data. The two-dimensional location data may be combined by triangulation.

Each of the signal sources may be an electromagnetic element configured to cause emission of electromagnetic radiation to present said information signal. Transmitting said output data to said signal sources to present said information signal may then comprise transmitting instructions to cause some of said electromagnetic elements to emit electromagnetic radiation.

The electromagnetic elements may be lighting elements, and the instructions may cause said lighting elements to emit visible light. The lighting elements may be able to be illuminated at a predetermined plurality of intensities and said instructions may then specify an intensity for each lighting element to be illuminated. Each of said positioning signals may then be represented by intensity modulation of said electromagnetic radiation emitted by a respective lighting element to present said information signal. Such intensity modulation is preferred in some embodiments of the invention given that it allows the lighting elements to continue to display the information signal, while at the same time allowing the same lighting elements to output positioning signals in a relatively unobtrusive manner.

The lighting elements can be illuminated to cause display of any one of a predetermined plurality of colours, and said instructions specify a colour for each lighting element. In such cases, positioning signals may be represented by hue modulation of said light emitted by a respective lighting element to present said information signal. Again, such transmission of positioning signals is advantageous, given that it allows positioning signals to be transmitted by lighting elements presenting the information signal in a relatively unobtrusive manner. Indeed, research has shown that human beings are relatively insensitive to such hue modulation. Thus, given that such hue modulation can be detected by suitably configured cameras, such hue modulation is an effective way of transmitting positioning signals.

The term signal sources is used herein to include both signal generating sources, and signal reflective sources. For example, each of said signal sources may be a reflector of electromagnetic radiation, and preferably a reflector of electromagnetic radiation with controllable reflectivity. Such controllable reflectivity may be provided by associating an element of variable opacity, with each reflective element. A liquid crystal display (LCD) may be used as a such an element of variable opacity.

The term "signal" as used herein includes a signal generated by a plurality of signal sources. For example, a colour signal could be construed as a combined effect of red, green and blue signal sources.

The signal sources may be sound sources, and transmitting said output data to said signal sources to present said information signal comprises transmitting sound data to be output by some of said instructions to cause some of said sound sources to output sound data to generate a predetermined sound scape.

The invention further provides a method and apparatus for locating a signal receiver within a predetermined space. The method comprises receiving data indicating a signal value received by said signal receiver; comparing said received data with a plurality of expected signal values, each value representing a signal expected at a respective one of a predetermined plurality of points within said predetermined space; and locating said signal receiver on the basis of said comparison.

Thus, by storing data indicating data expected to be received in a plurality of locations, a signal receiver can be located based upon the signal received by that signal received. This method can be carried out in a distributed manner at each signal receiver, or alternatively the signal receiver may provide details of a received signal to a central computer, the central computer being configured to locate the signal receiver.

Each signal receiver may be a signal transceiver. The method may further comprise providing signals to said signal receiver.

The method may further comprise transmitting predetermined signals to said signal receiver, such that the signals received each of said signal receivers are based upon said predetermined signals. Receiving data indicating a signal value received by said signal receiver may comprise receiving data indicating a sound signal received by said signal receive, although this aspect of the invention is not restricted to use with sound data.

The invention also provides a method and apparatus of locating and identifying a signal source. The method comprises receiving a signal transmitted from said signal source by a signal receiver, the signal receiver being configured to produce two-dimensional location data locating said signal source within a detection frame, generating location data based upon said position within said detection frame, processing said received signal, said received signal comprising a plurality of temporally separated signal transmissions, and determining, from said received plurality of temporally separated signal transmissions, an identification code for said located signal source.

This aspect of the invention has particular applicability in monitoring movement of people or equipment within a predetermined space. For example, the signal sources may be associated with respective people or items of equipment.

The signals received from the signal source may take any suitable form. In particular, the signals may take the form of the positioning signals described above with reference to other aspects of the invention.

The invention further provides a method and apparatus for generating a three-dimensional soundscape using a plurality of sound sources. The method comprises determining a desired sound pattern to be applied to a predetermined space; determining a sound to be emitted from each of said sound sources, said determining being carried out using data indicating sound source locations, and using said sound pattern; and transmitting sound data to each of said sound sources.

Thus, the invention allows the generation of sound signals which are to be output using a plurality of sound sources to generate a three dimensional sound scape.

The sound sources used may take any suitable form. In some embodiments of the invention sound is produced using a plurality of small handheld devices such as mobile telephones, the sound being output through loudspeakers associated with the mobile telephones.

The invention also provides a method and apparatus for processing an address in an addressing system configured to address a plurality of spatial elements arranged in a hierarchy. The method uses an address defined by a predetermined plurality of digits, and comprises processing at least one predetermined digit of said address to determine a hierarchical level of said hierarchy represented by said address, and determining an address of a spatial element at said determined hierarchical level from said processed address.

Processing at least one predetermined digit of said address to determine a hierarchical level may comprise processing at least one leading digit of said address. For example, each digit of the address may be processed, starting at a first end, all processed digits having an equal value may then be considered to form a group of leading digits which is used to determine the hierarchical level. For example, when binary addresses are used, the number of leading '1's within the address can be used to determine the hierarchical level.

Determining an address of a spatial element may comprise processing at least one further digit of said address. The at least one further digit to be processed may be determined by said digit or digits indicating said hierarchical level.

The method can be used with various addressing mechanisms, including IPv6 addresses.

The invention further provides, a method of allocating addresses to a plurality of devices, the method comprising: causing each of the plurality of elements to select an address, receiving data indicating addresses selected by each of said devices, processing data indicating selected addresses to determine whether more than device has selected a single address, and if more than one of device has selected a single address, instructing said more than one of said devices to reselect an address.

The invention further provides, a method for identifying device addresses of a plurality of devices, the addresses being arranged within a range of addresses, the method comprising: generating a plurality of sub-ranges from said range of addresses, determining whether any of said plurality of devices has an address within a first sub-range, and if but only if one or more devices have an address within said first sub-range, processing at least one address within said first sub-range.

It will be appreciated that features of one aspect of the invention described herein may be used in combination within one of the other aspects of the invention as described herein. It will also be appreciated that all aspects of the invention can be implemented by means of methods, apparatus, and devices. It will also be appreciated that the methods provided by the invention can be implemented using computer programs. Such computer programs can be embodied on suitable carrier media such as CD ROMs, and discs. Such carrier media also include communications signals which carry suitable computer programs. The aspects of the invention can also be implemented by suitably programming a stored program computer apparatus with suitable computer program code.

Embodiments of the present invention will now be described, by way of example, with reference to the accompanying drawings, in which:

FIG. 10 is a schematic illustration of an arrangement of cameras used to locate lighting elements in an embodiment of the present invention;

FIGS. 10A and 10B are pixelised representations of frames captured using the cameras illustrated in FIG. 10;

FIG. 11 is a schematic illustration of a camera used to locate lighting elements in a further embodiment of the present invention;

FIG. 11A is a series of four pixelised representations of frames captured using the camera of FIG. 11 over a predetermined time period;

Figure 5:
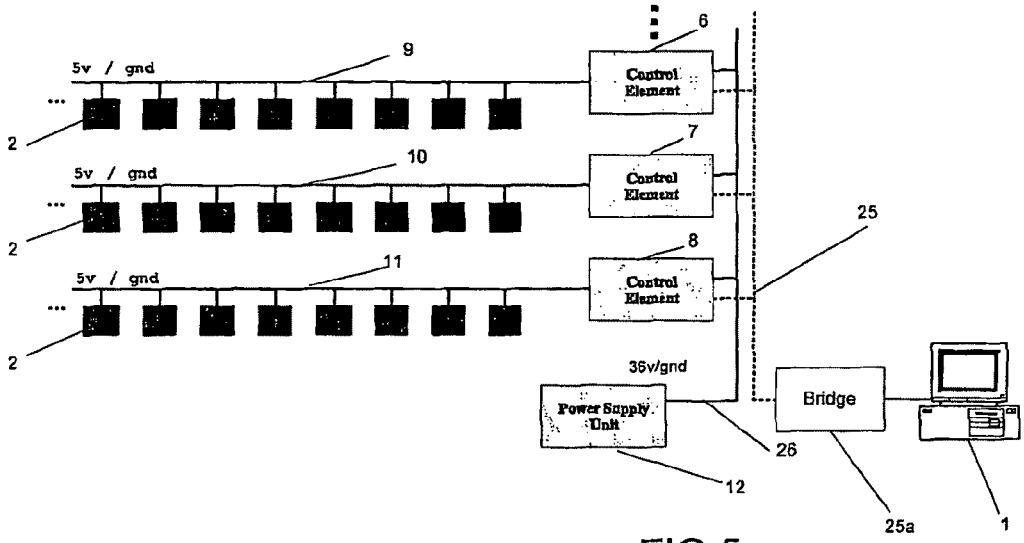
FIG. 5 is a schematic illustration of a network of computer-controlled lighting elements suitable for use in an embodiment of the present invention.
Figure 9:
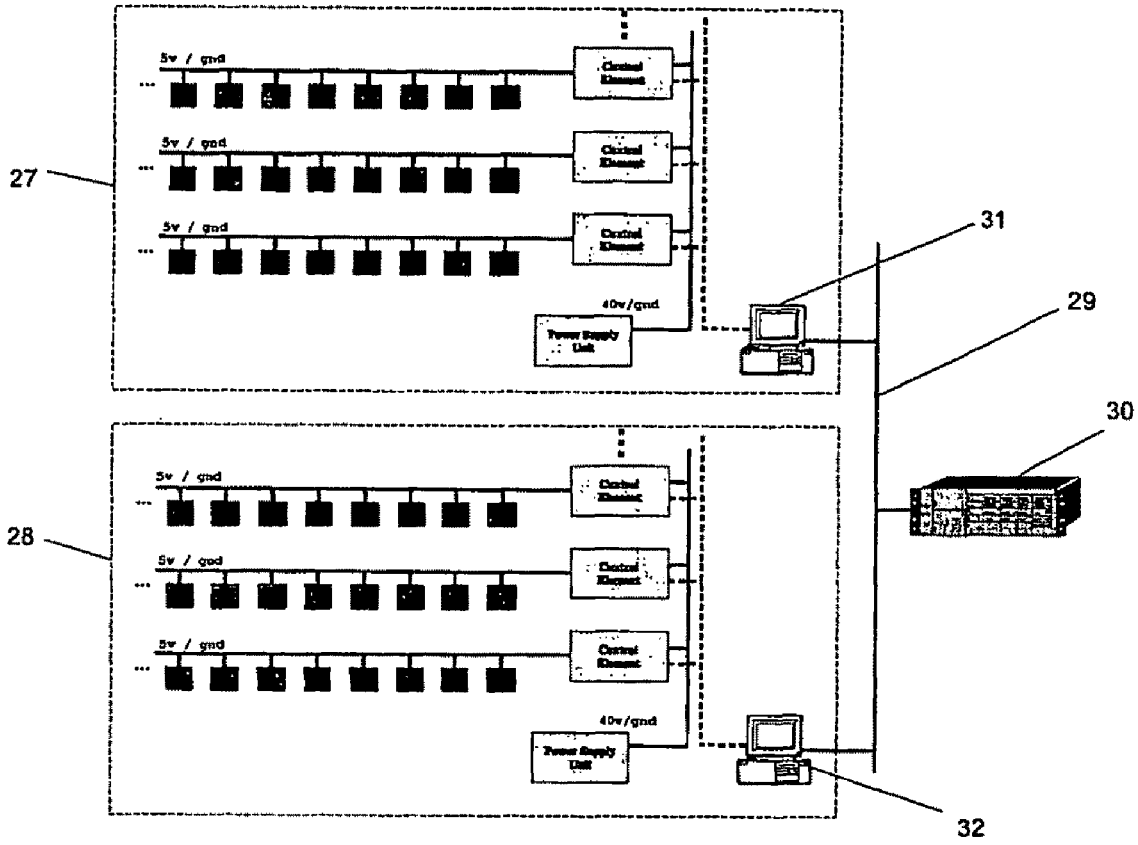
FIG. 9 is a schematic illustration of an alternative network of computer-controller lighting elements suitable for use in an embodiment of the present invention.
Figure 21:
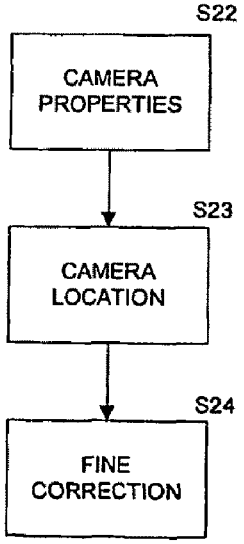
Figure 23:
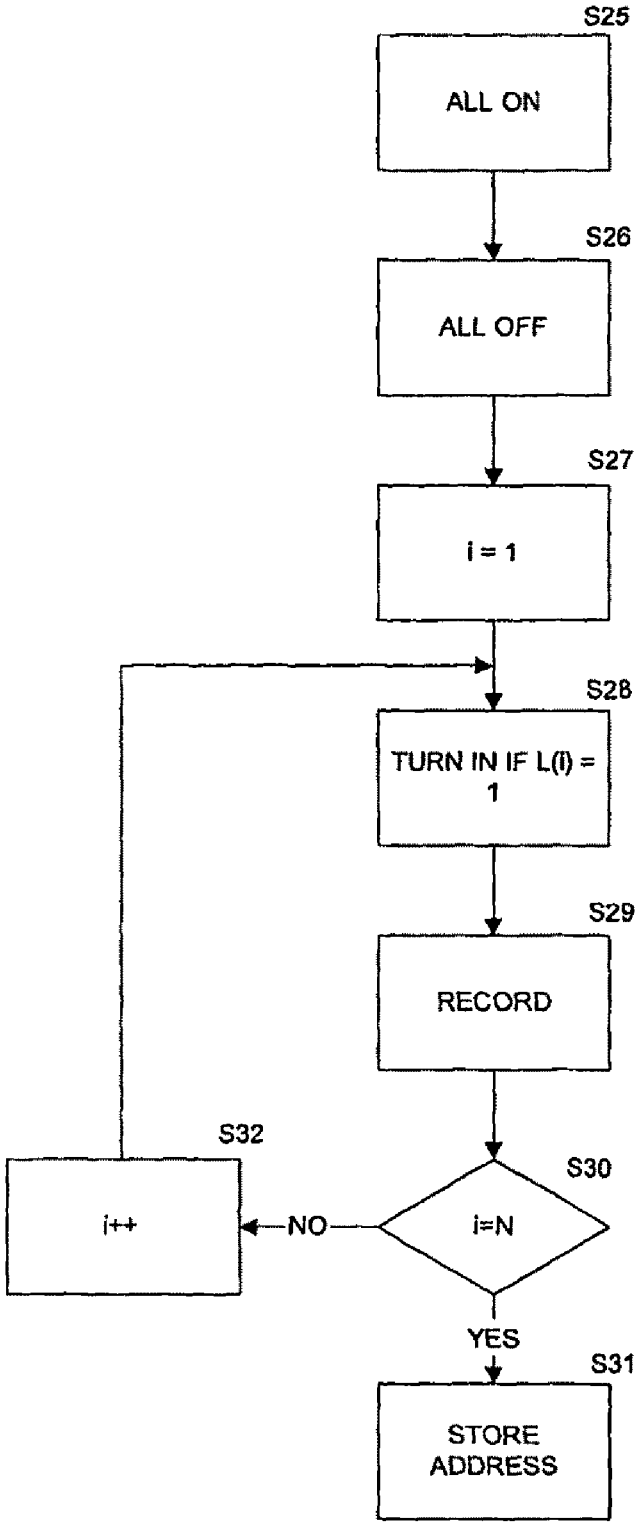
Figure 23A:
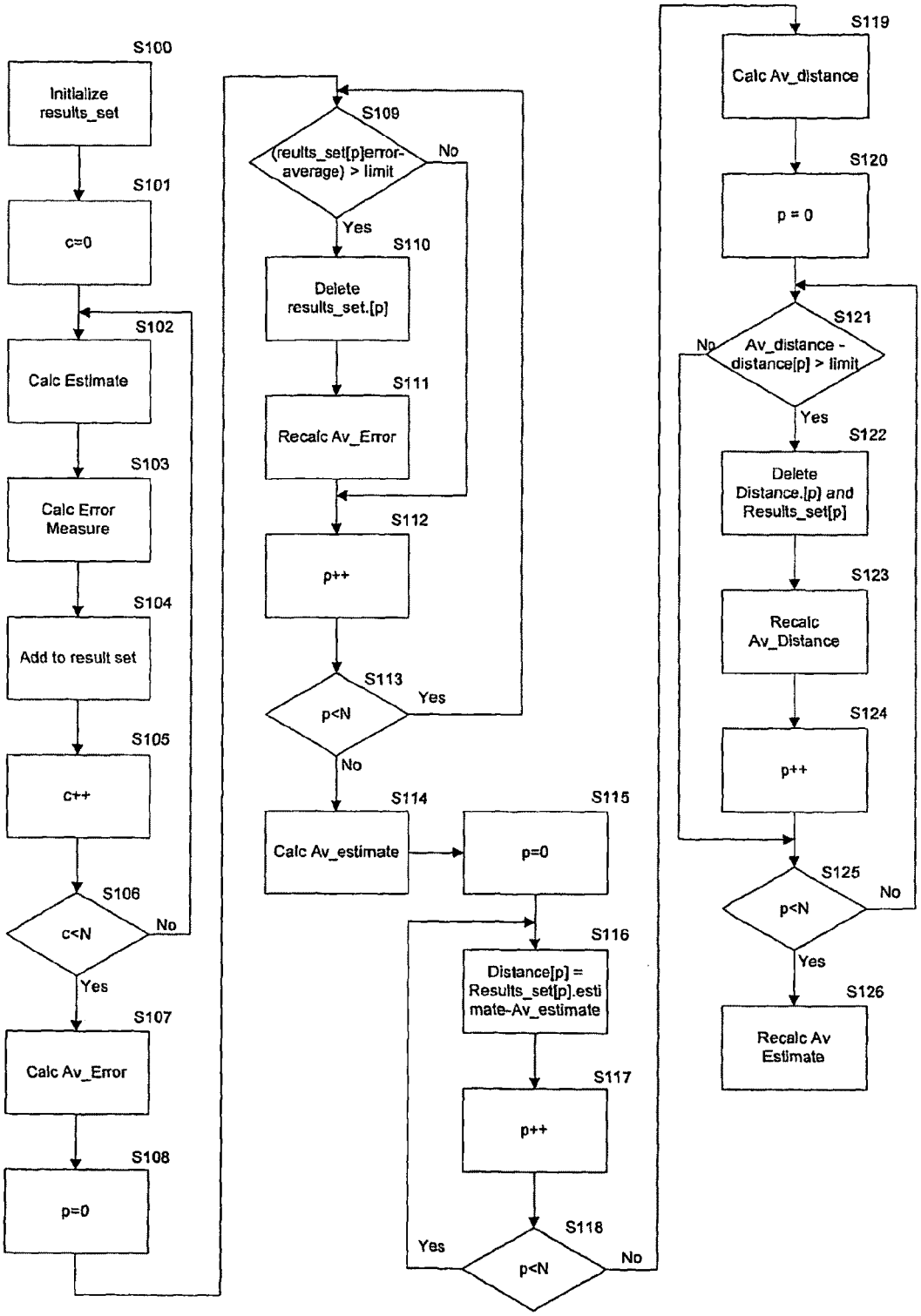
Figure 24:
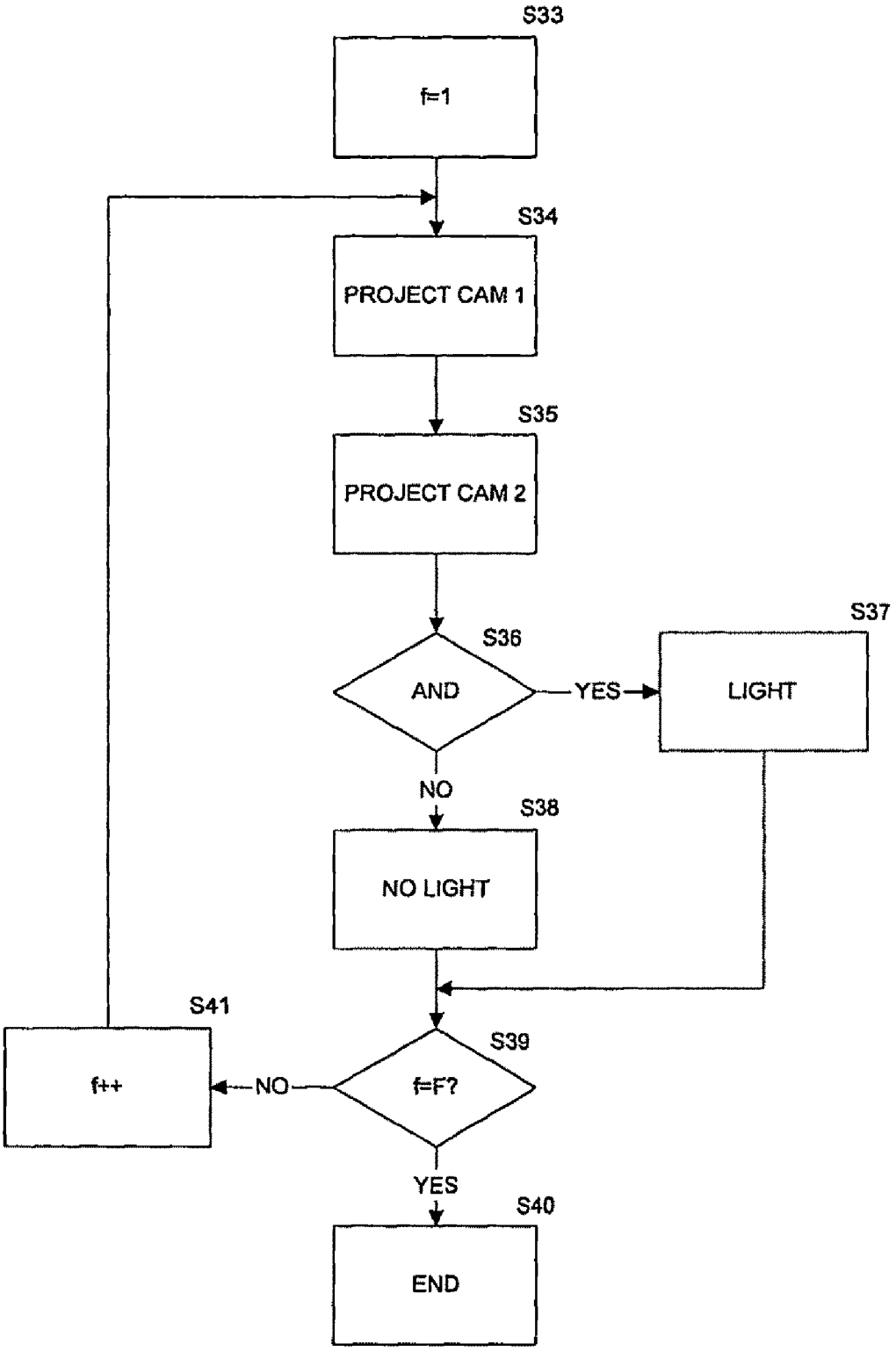
Figure 24A:
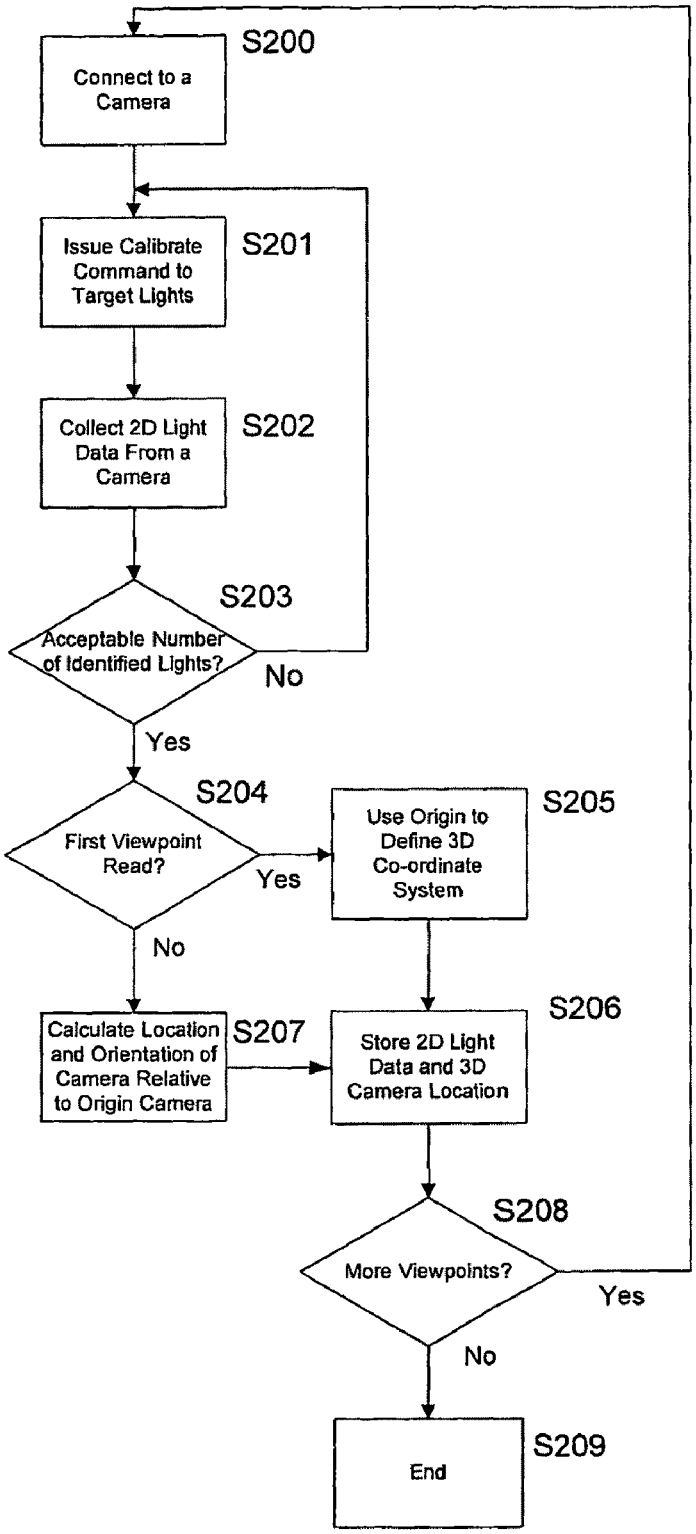
Figure 24B:
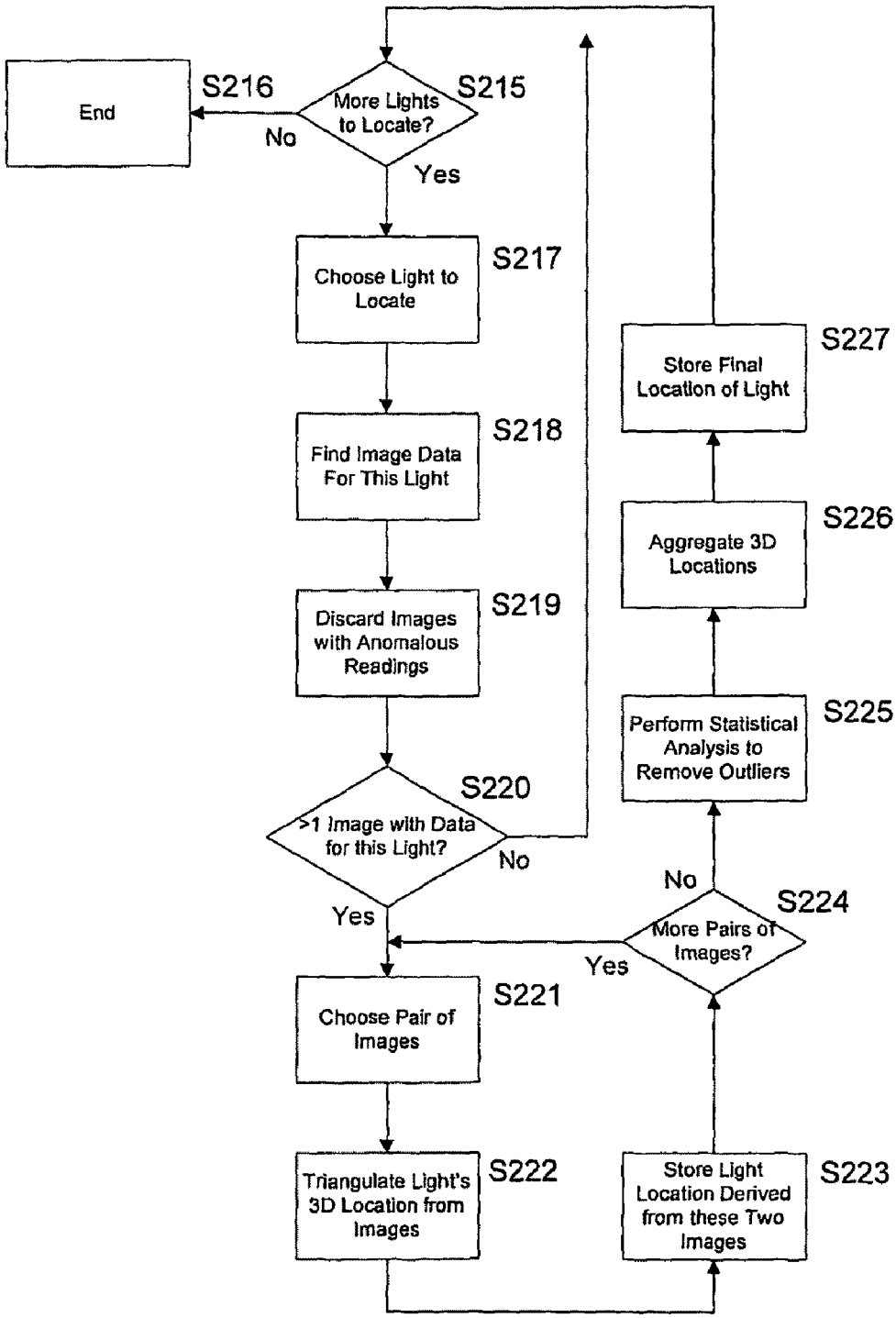
Figure 24C:
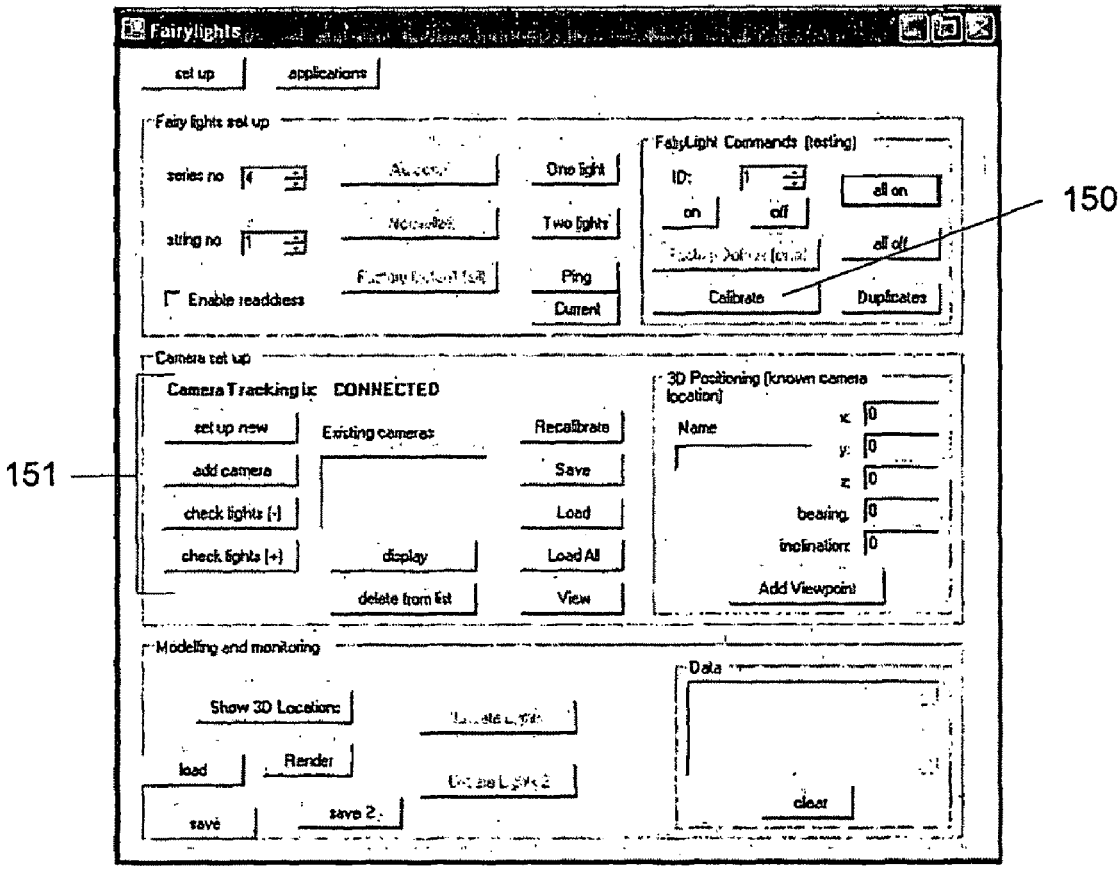
Figure 24D:
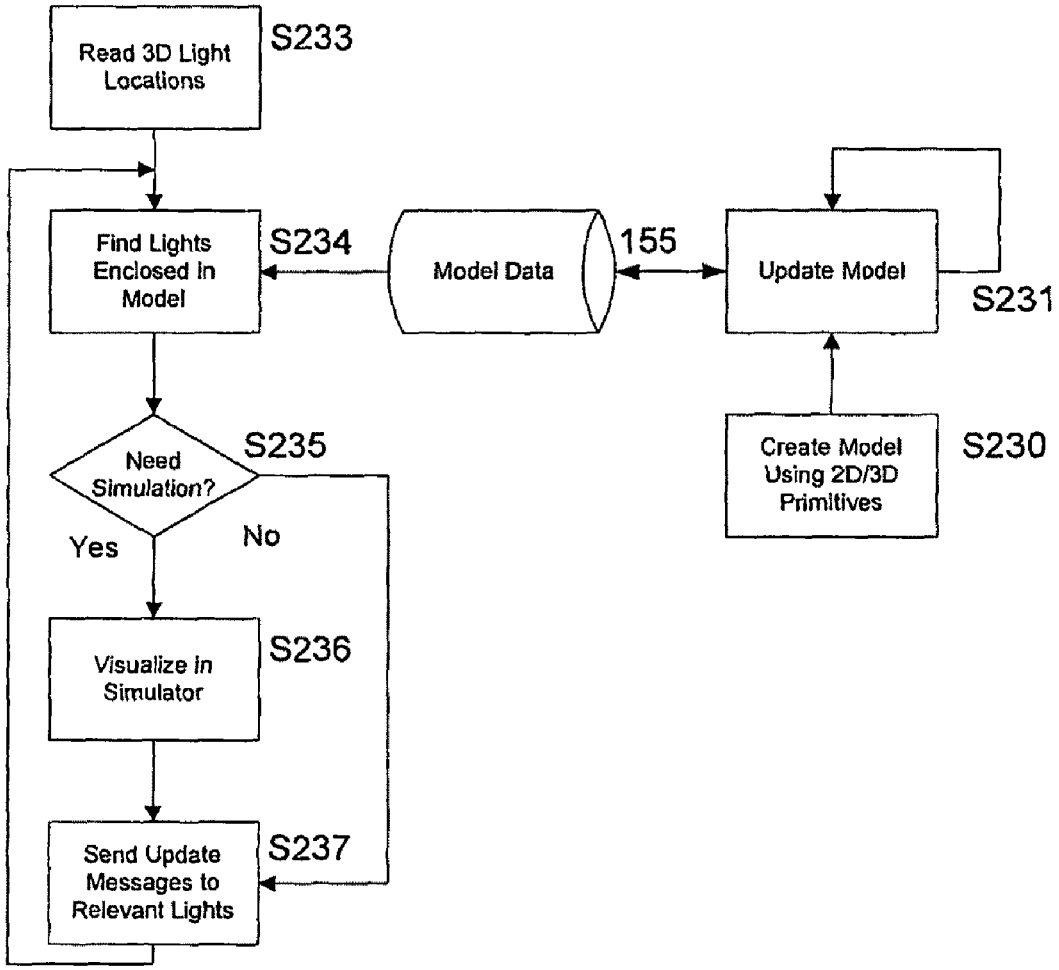
Figure 24E:
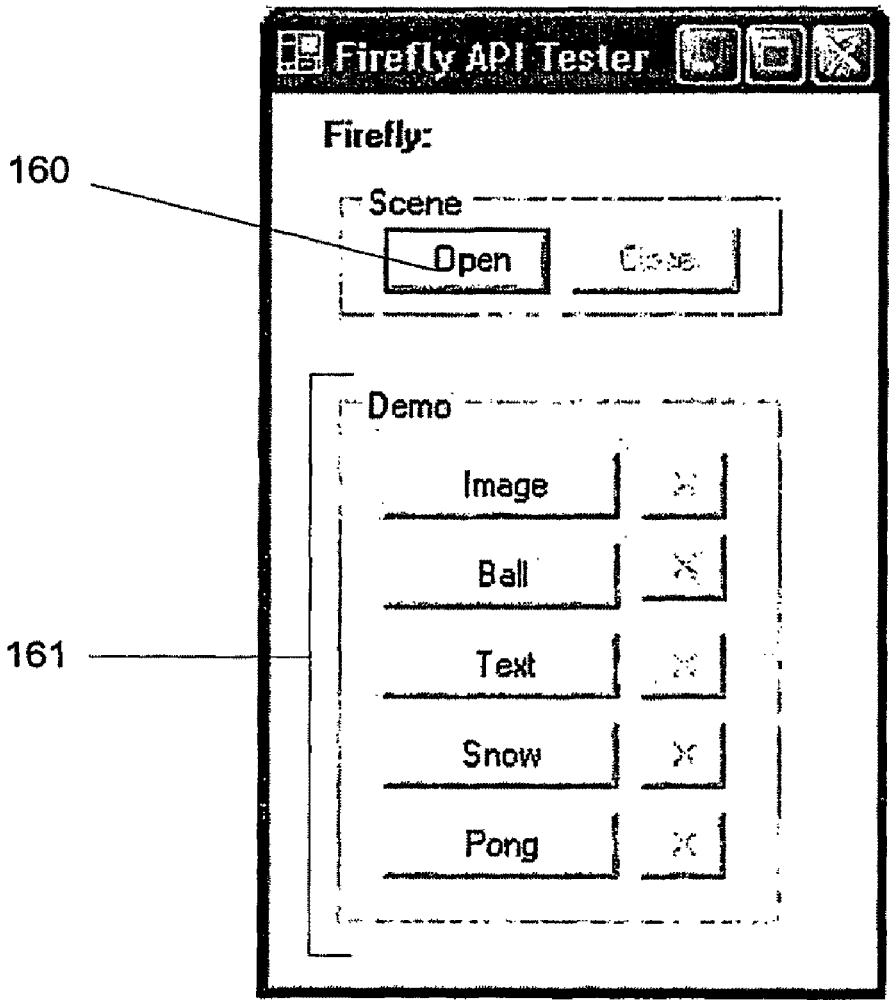
Figure 24F:
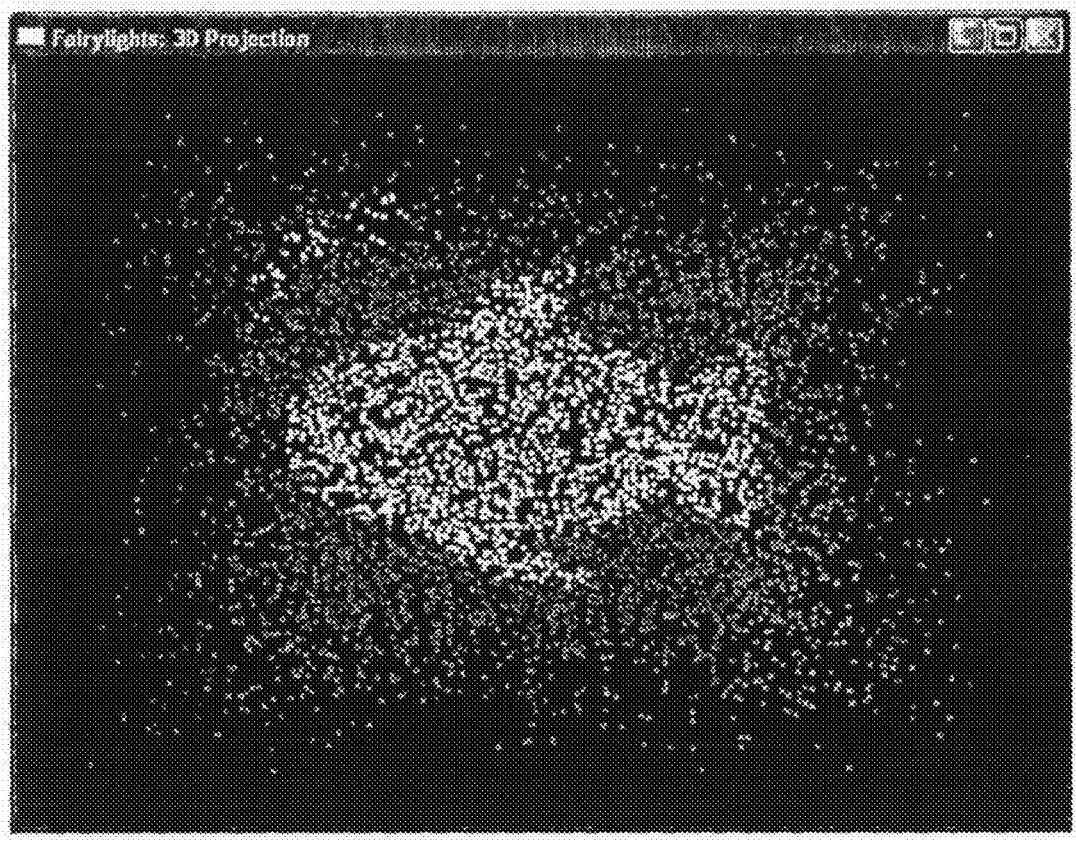
Figure 24G:
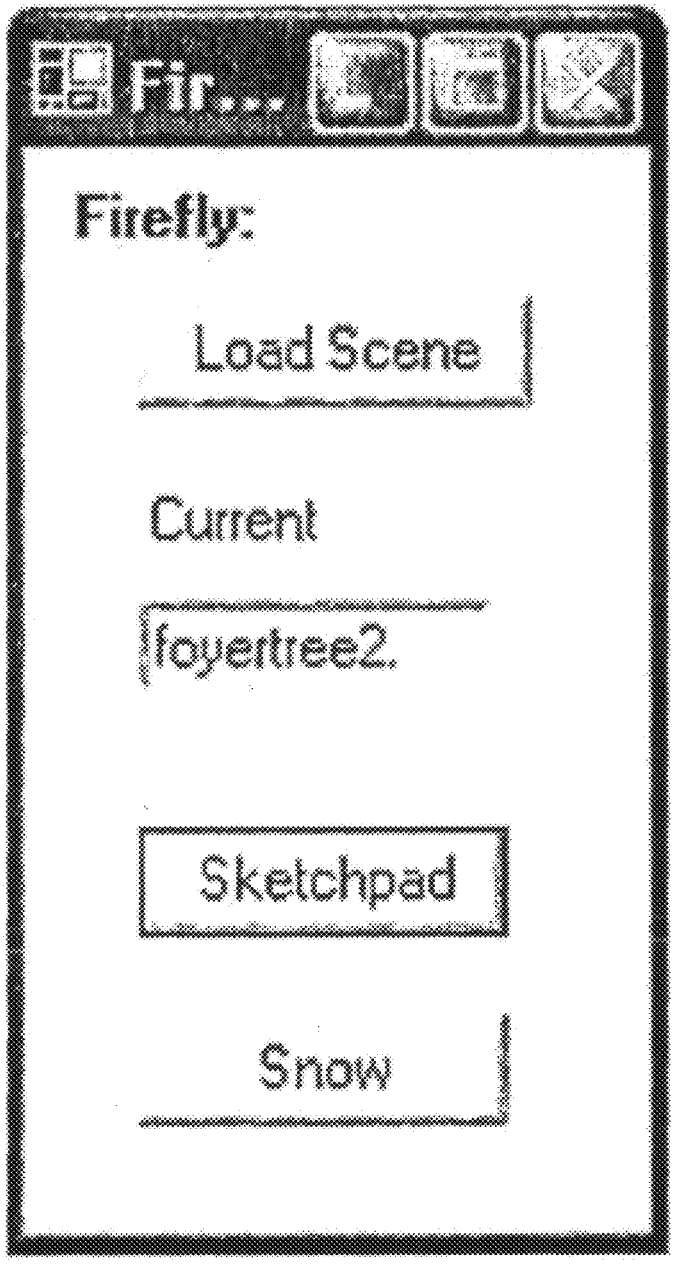
Figure 24H:
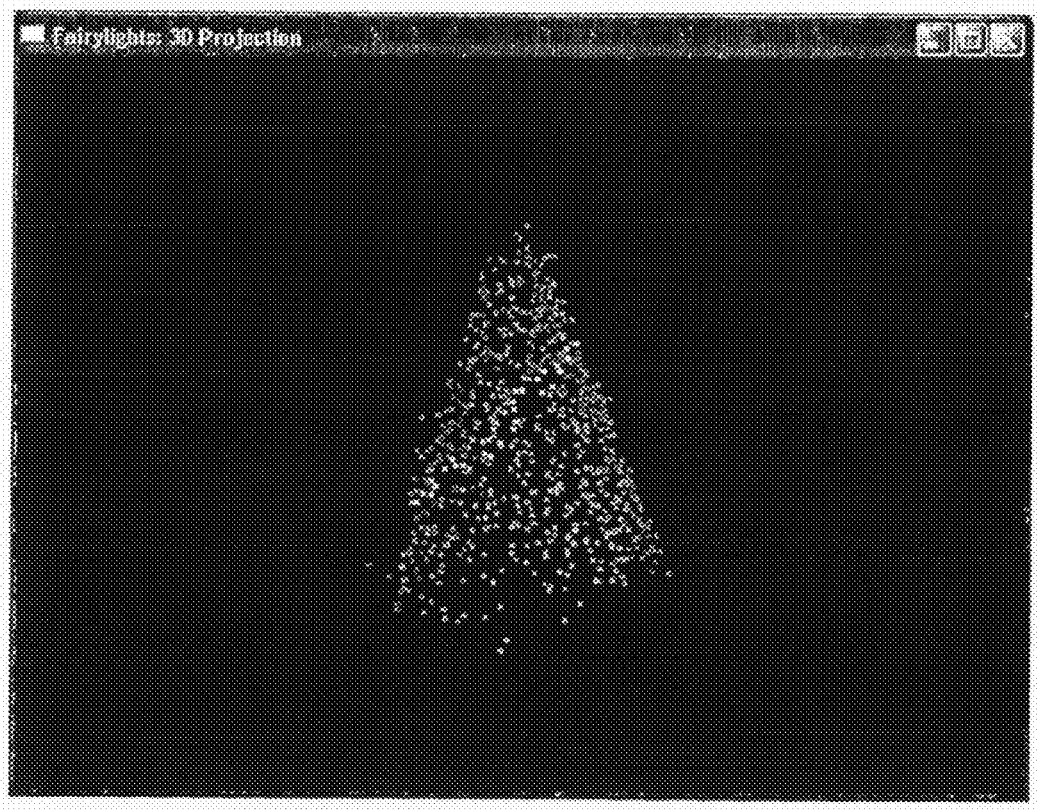
Figure 24I:
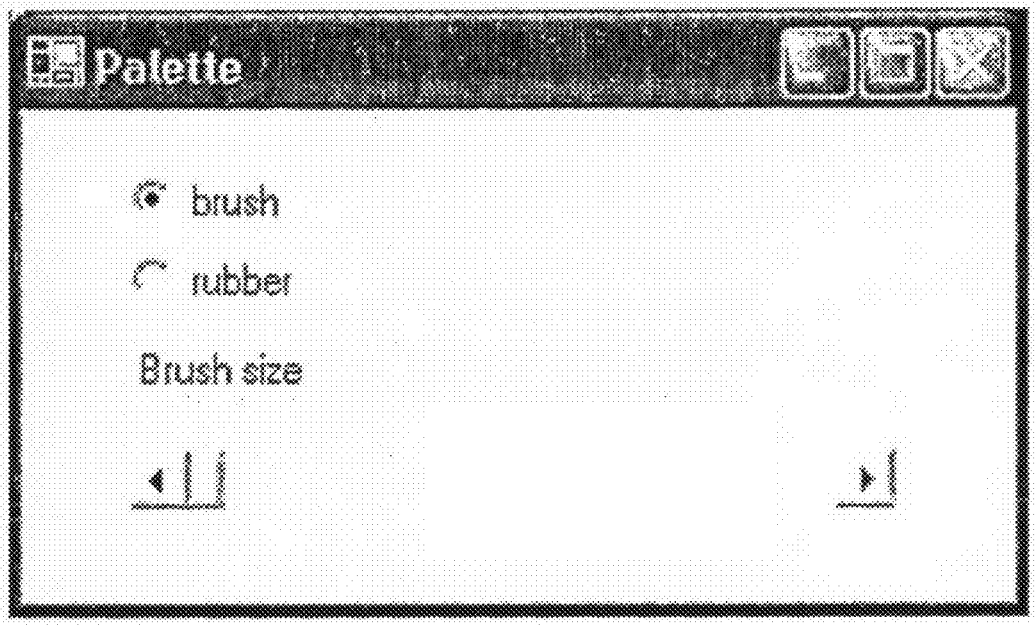
Figure 25:
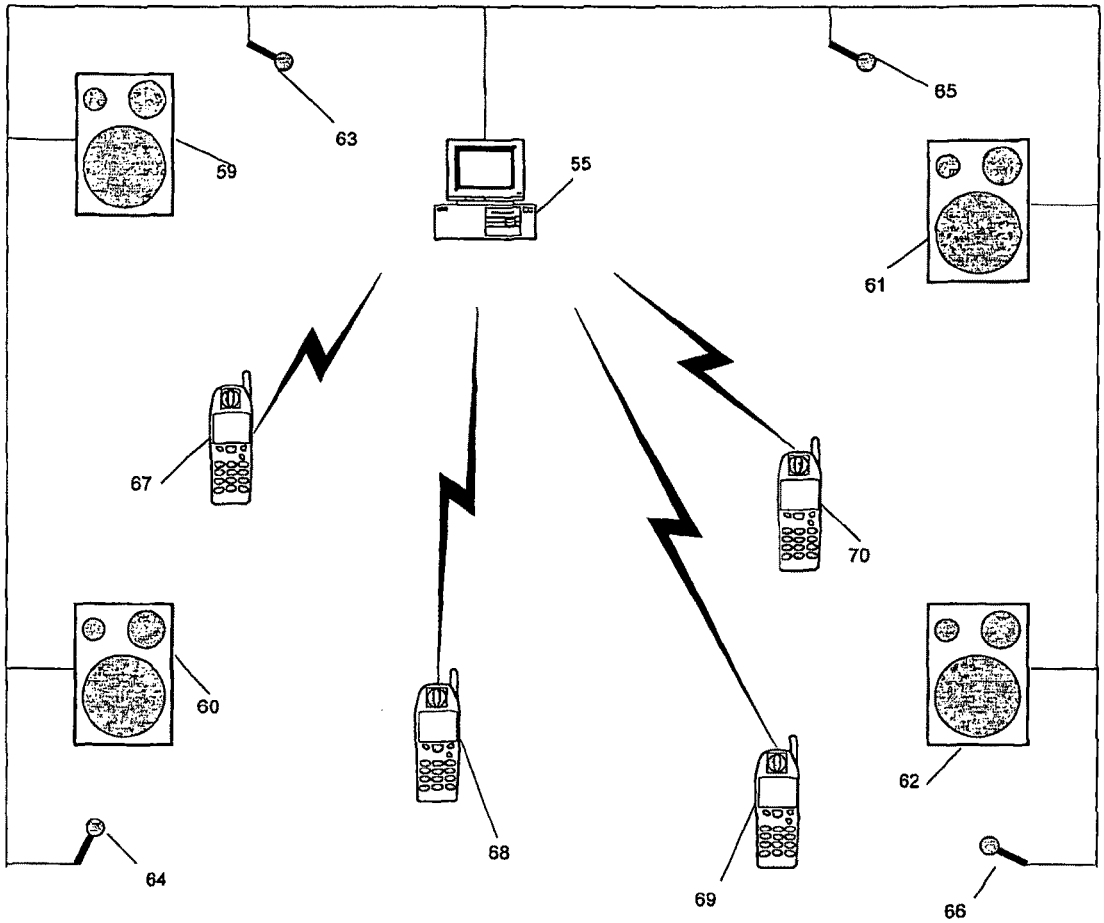
Figure 26:
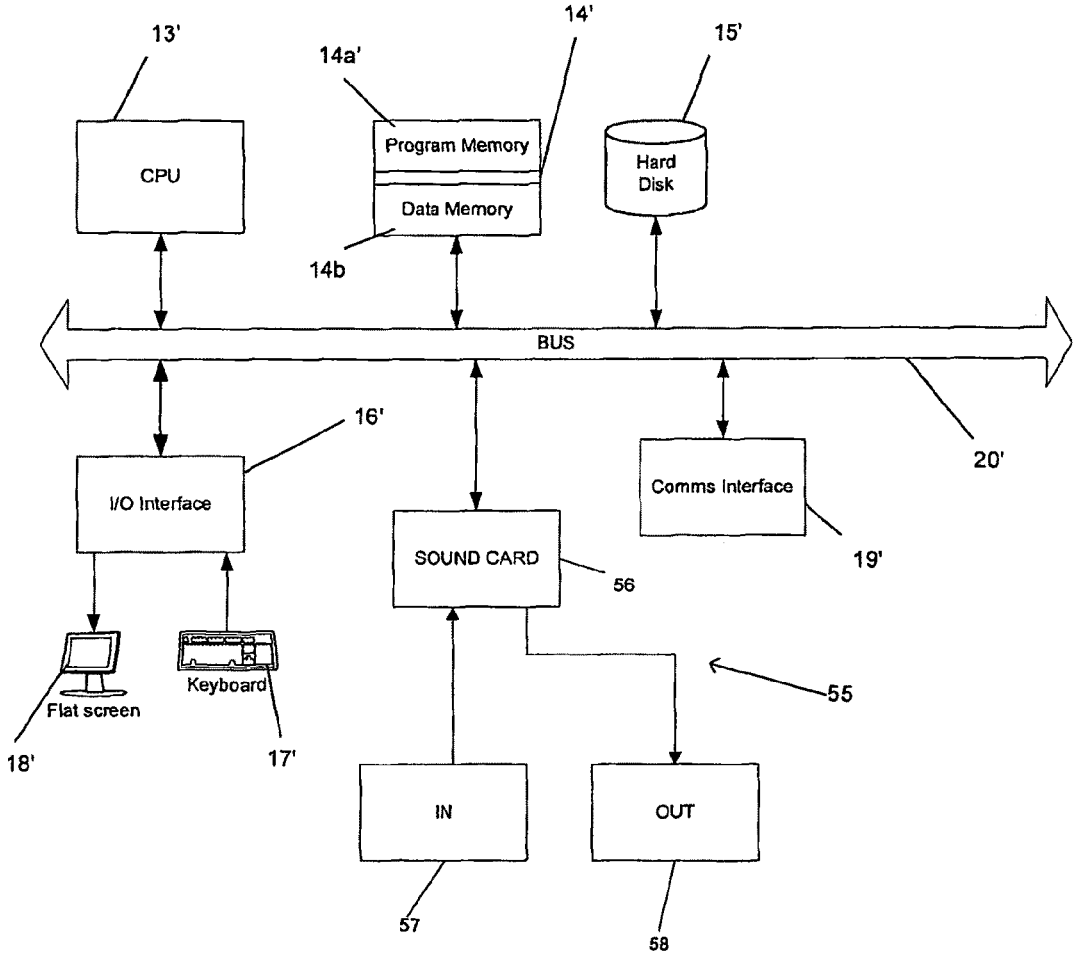
Figure 27:
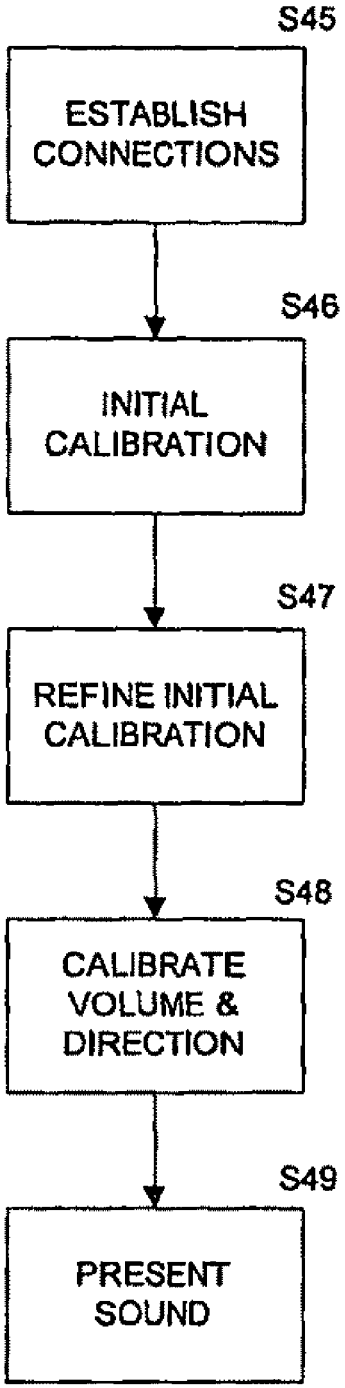
Figure 28:
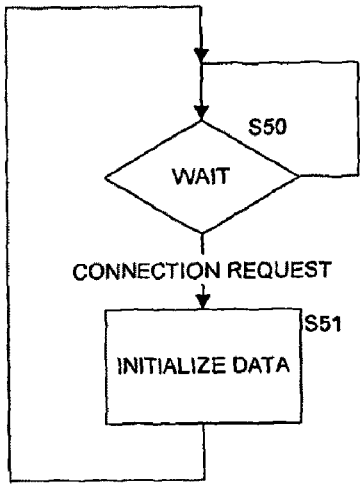
Figure 29:
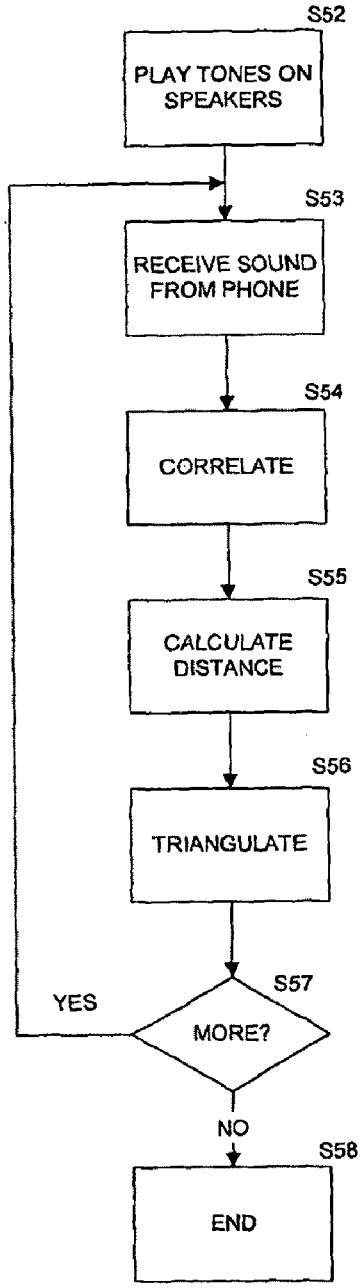
Figure 30:
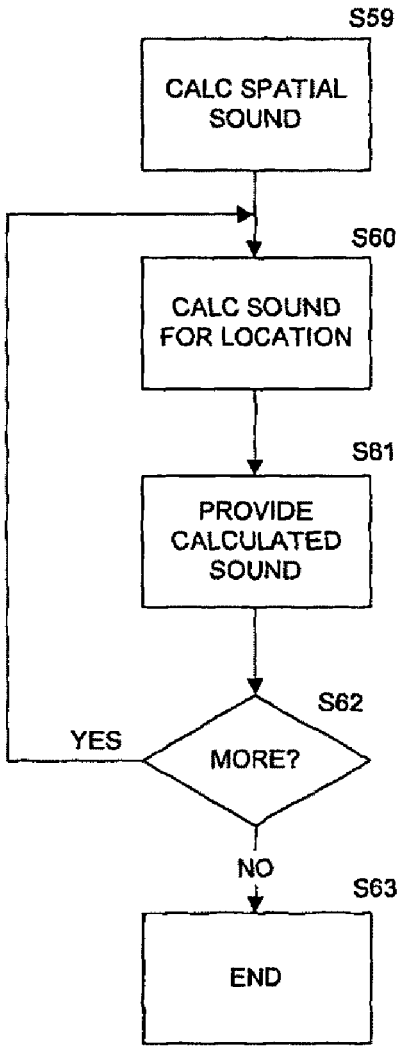
Figure 31:
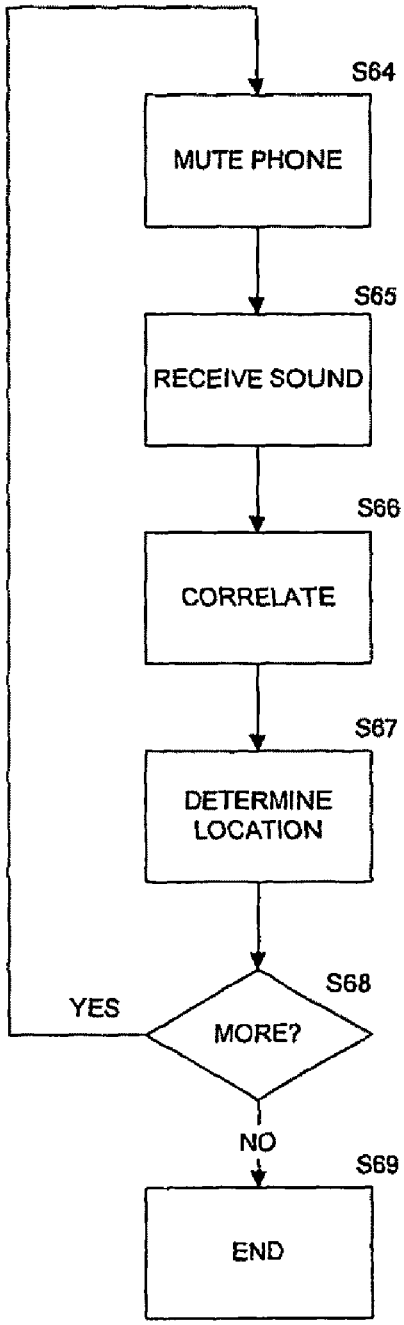
Figure 32:
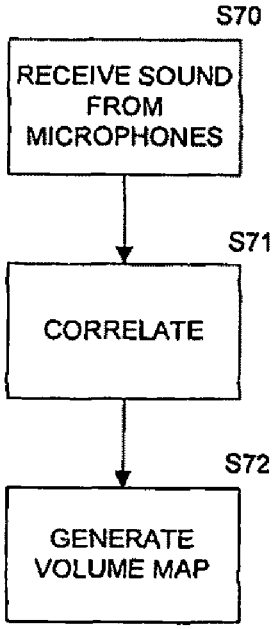
Figure 33:
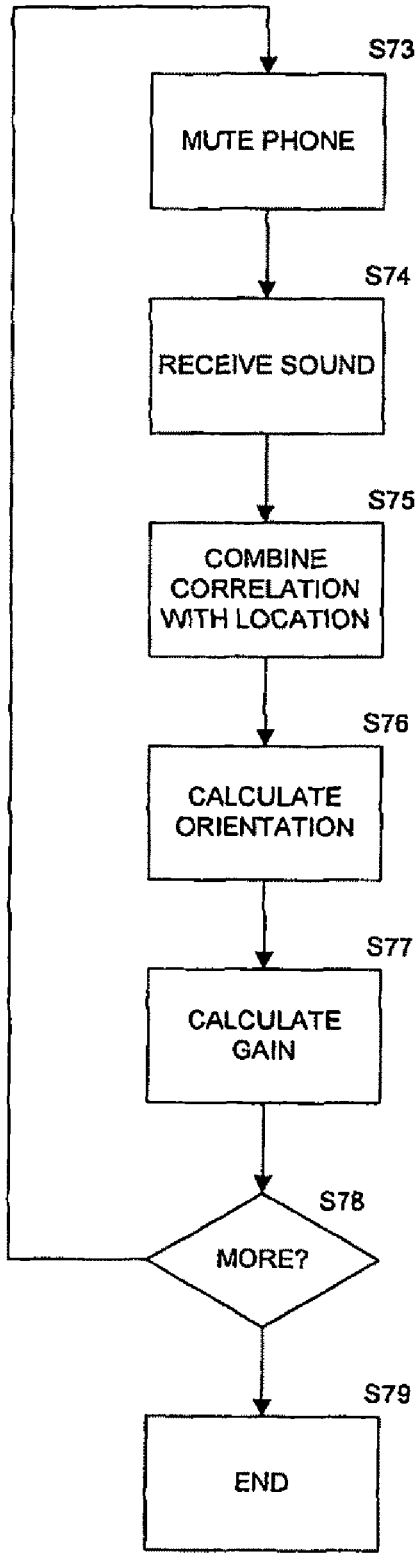
Figure 34:
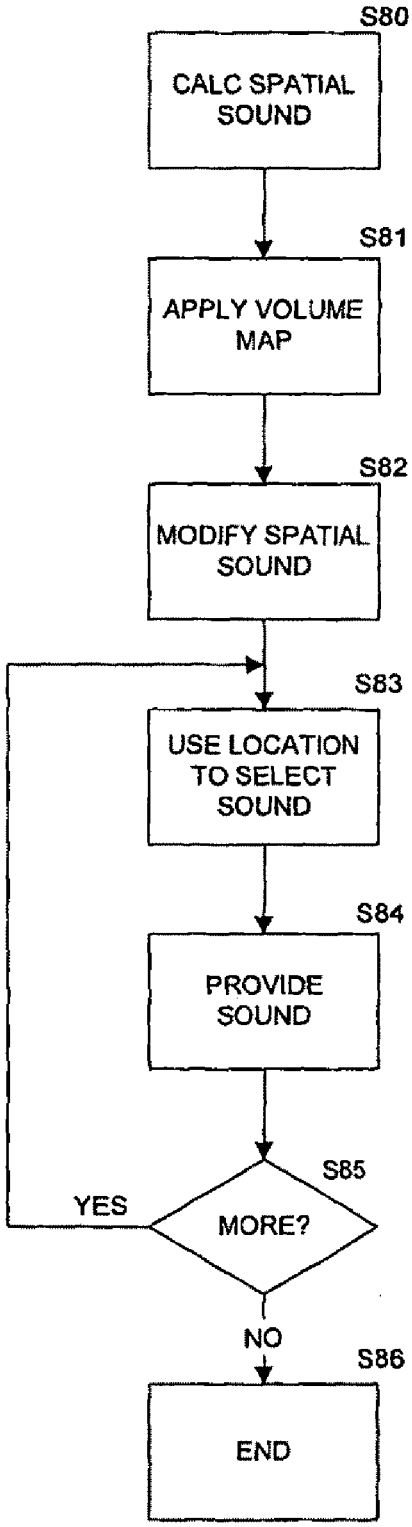
Figure 35:
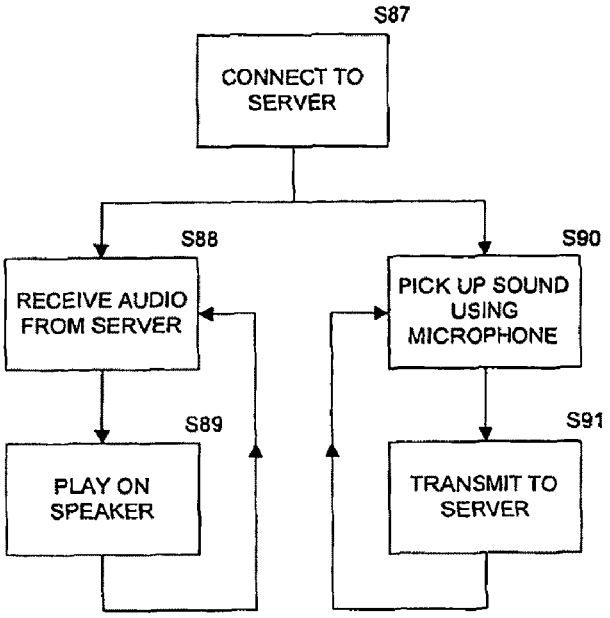
Figure 36:
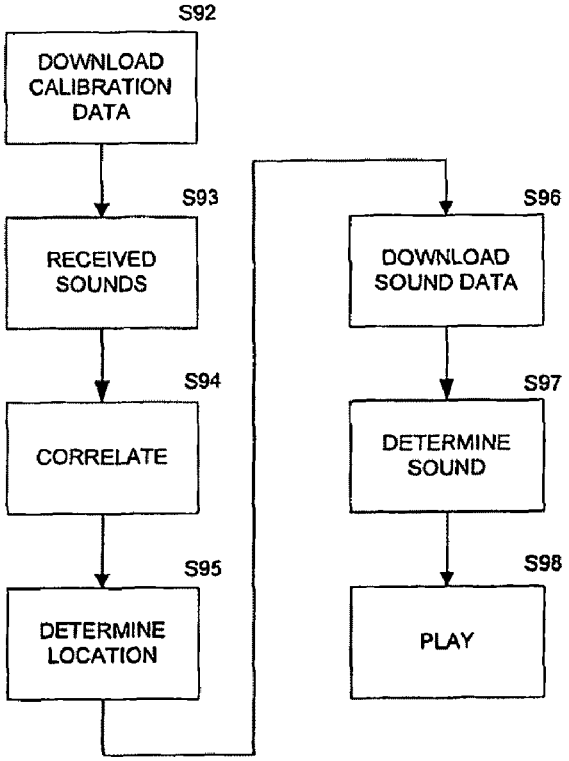
Figure 37:
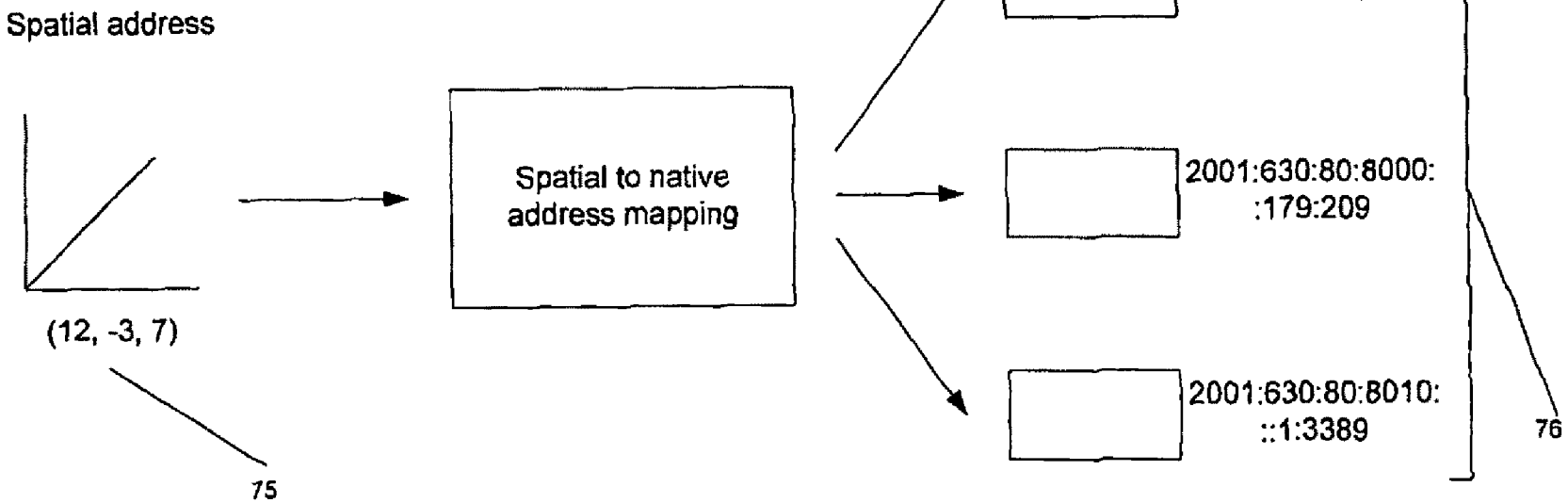
Figure 38:
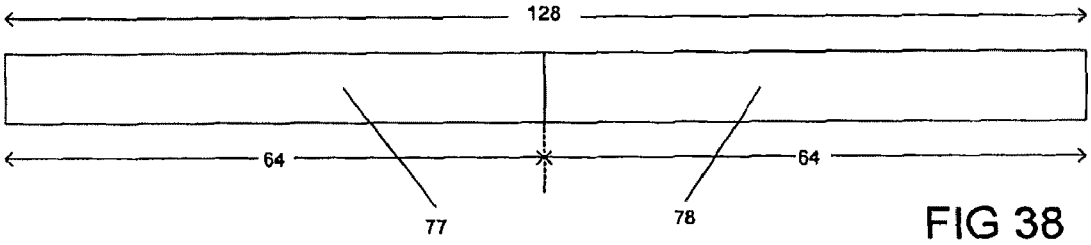
Figure 39:
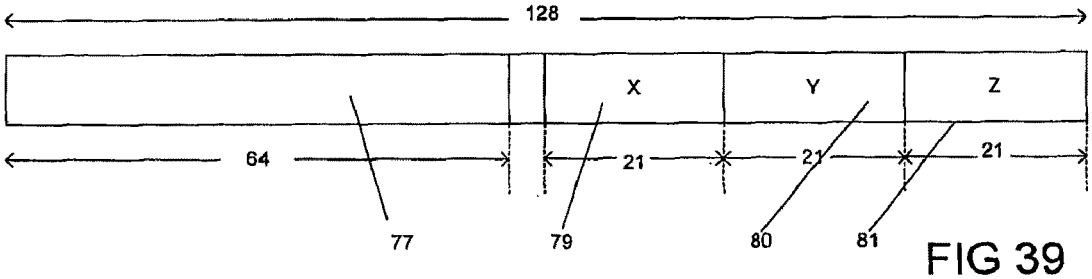
Figure 40:
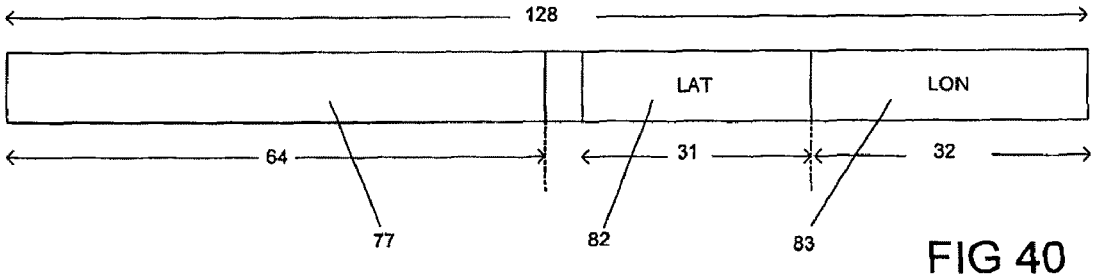
Figure 41:
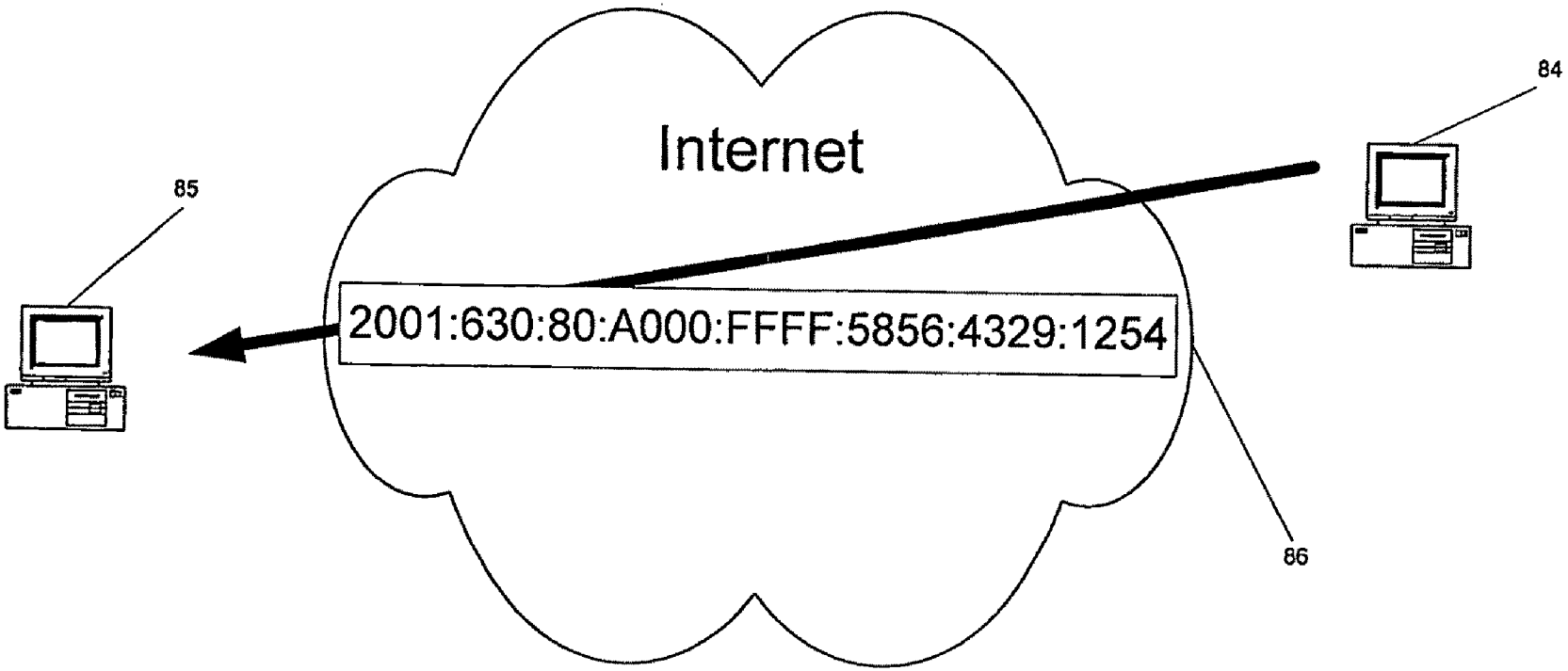
Figure 42:
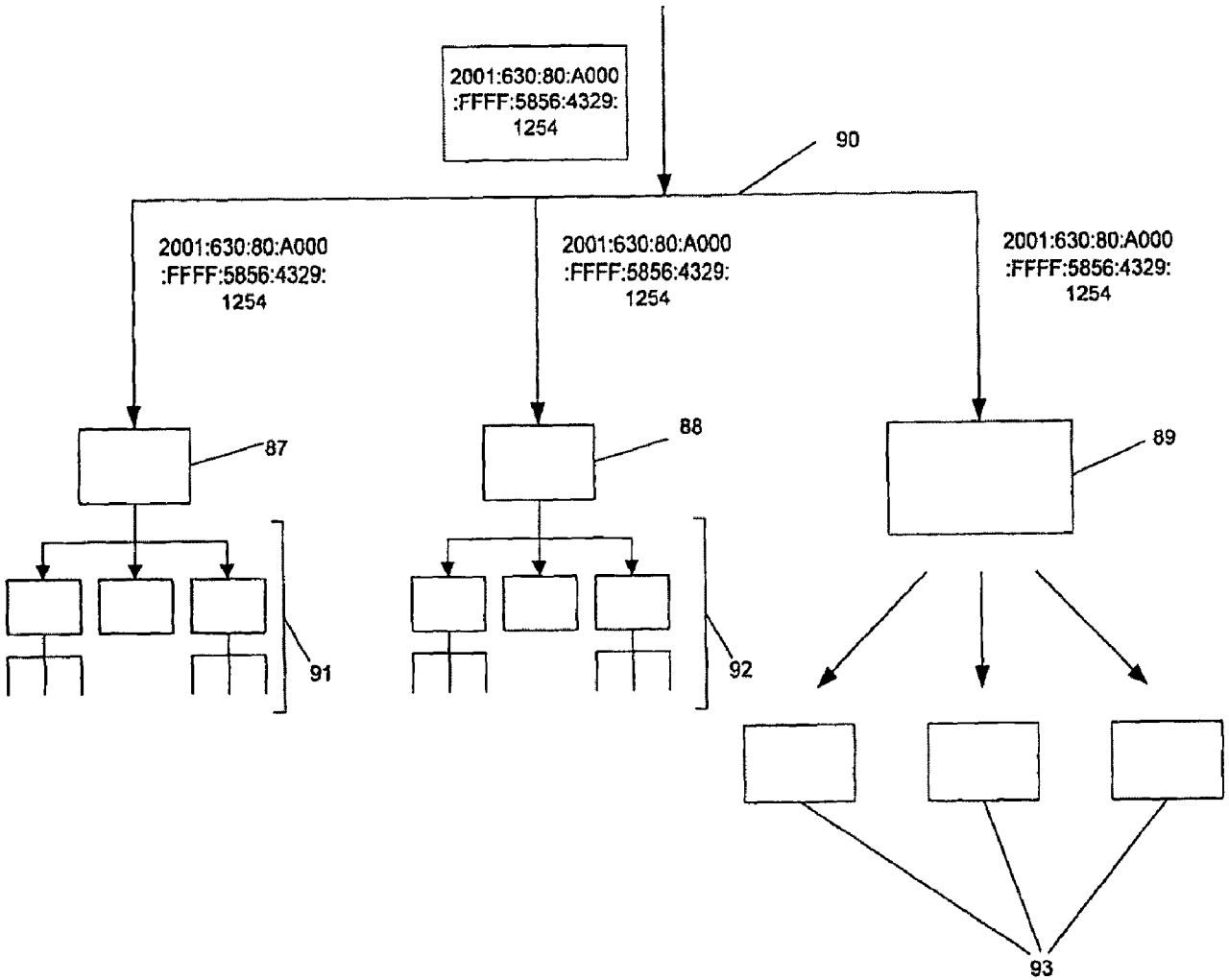
Figure 43:
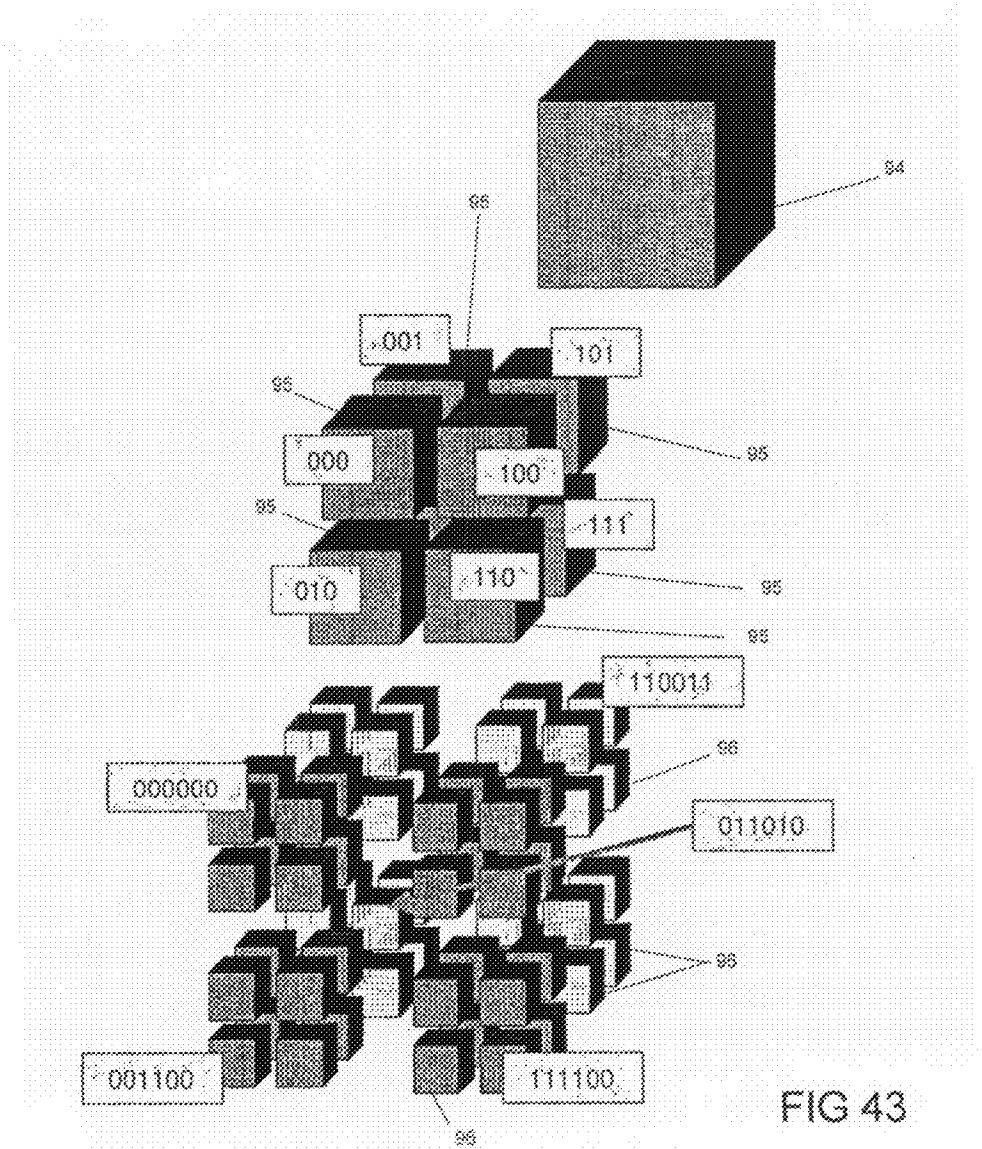

FIGS. 20, 20*a*, 20*b*, 20*c* and 20*d* are schematic illustrations of methods used in embodiments of the present invention to locate lighting elements;

FIG. 21 is a flow chart of a camera calibration process used in embodiments of the present invention;

FIGS. 22A to 22D are schematic illustrations of artefacts present when the cameras illustrated in FIGS. 10 and 11 are incorrectly calibrated;

FIG. 23 is a flow chart of an alternative light element location algorithm suitable for use with the apparatus illustrated in FIGS. 5 and 9;

FIG. 23A is a flowchart showing processing carried out to estimate signal source location;

FIG. 24 is a flow chart of a light element location process used in some embodiments of the present invention;

FIG. 24A is a flow chart showing processing carried out to obtain data used to locate lighting elements;

FIG. 24B is a flow chart of showing processing carried out to locate lighting elements from the data obtained using the process of FIG. 24A;

FIG. 24C is a screenshot taken from a graphical user interface adapted to cause the processing shown in FIGS. 24A and 24B;

FIG. 24D is a flow chart showing processing carried out to display an image using located lighting elements;

FIG. 24E is a screenshot taken from a graphical user interface adapted to cause the processing shown in FIG. 24D;

FIG. 24F is a screenshot taken from a simulator simulating lighting elements;

FIG. 24G is a screenshot showing how data defining a plurality of lighting elements can be loaded into the simulator;

FIG. 24H is a screenshot showing how the interface of FIG. 24G can be used;

FIG. 24I is a screenshot taken from a graphical user interface adapted to allow interactive control of lighting elements;

FIG. 25 is a schematic illustration of a spatial sound generation system in accordance with the present invention;

FIG. 26 is a schematic illustration of a PC used for control of the system illustrated in FIG. 25;

FIG. 27 is a flow chart providing an overview of processing carried out by the system of FIG. 25;

FIG. 28 is a flow chart showing initialization processing carried out in the system shown in FIG. 25;

FIG. 29 is a flow chart showing processing carried out in the system shown in FIG. 25 to generate location data for a particular sound transceiver;

FIGS. 30 and 31 are flow charts showing how location data generated using the process of FIG. 29 can be improved upon;

FIG. 32 is a flow chart showing a process for generating a volume map in the system of FIG. 25;

FIG. 33 is a flow chart showing a process for calculating gain and orientation of a sound transceiver in the system of FIG. 25;

FIG. 34 is a flow chart showing a process for generating sound using the system of FIG. 25;

FIG. 35 is a flow chart showing processing carried out by a sound transceiver in the system of FIG. 25;

FIG. 36 is flow chart showing an alternative process for generating sound in the system of FIG. 25;

FIG. 37 is a schematic illustration of a process for converting spatial addresses to native addresses;

FIGS. 38 to 40 are schematic illustrations of 128-bit address configurations;

FIG. 41 is a schematic illustration of the process of FIG. 37 implemented over the Internet;

FIG. 42 is a schematic illustration showing how spatial addressing can be used in embodiments of the present invention; and FIG. 43 is a schematic illustration of an oct-tree representation of space, used in embodiments of the present invention.

Figure 1:
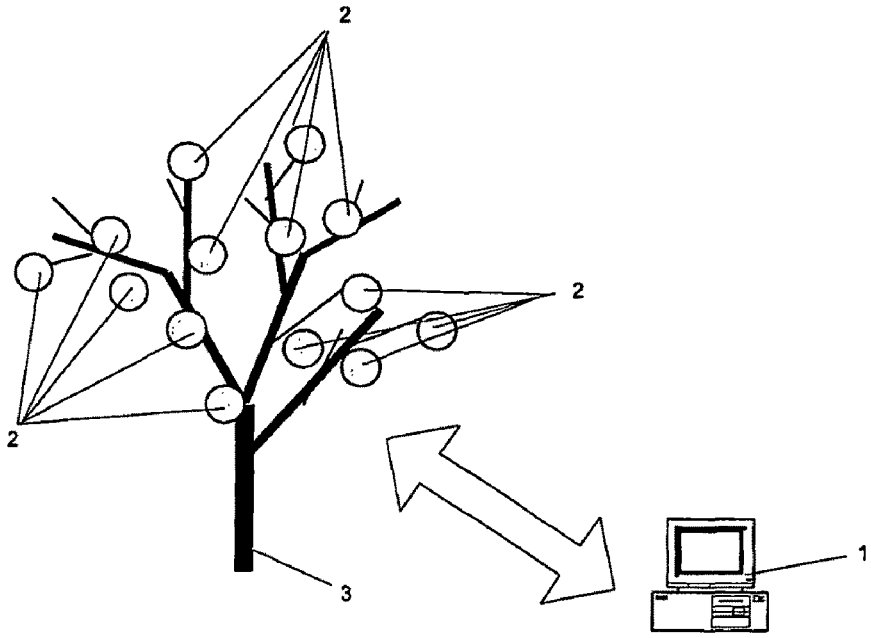
FIG. 1 is a high-level schematic illustration of an embodiment of the present invention.

Referring first to FIG. 1, an overview of the present invention is provided. A PC 1 is in communication with a plurality of lighting elements 2 arranged in a random fashion on a tree 3. The PC 1 is configured to spatially locate the lighting elements 2, and having carried out such location to display user-specified patterns using the lighting elements.

Figure 2:
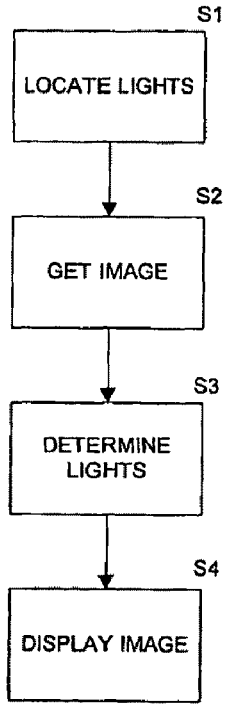
FIG. 2 is a high-level flow chart showing an overview of processing carried out by the embodiment of the present invention illustrated in FIG. 1.

The high-level processing carried out by the apparatus of FIG. 1 is shown by the flow chart of FIG. 2. At step S1, the lighting elements 2 are spatially located using location algorithms described below. At step S2 an image to be displayed is received, typically by way of user input providing details of a file from which data should be read, and by reading data from that specified file. Alternatively the image may be read from an image buffer, in a similar manner to that in which conventional computer monitors read images to be displayed from a frame buffer. At step S3, some of the lighting elements 2 which are to be illuminated to cause display of the image are selected, and having selected the appropriate lighting elements, these lighting elements are illuminated at step S4. It will be appreciated that some previously illuminated lighting elements may need to be extinguished to cause display of the image.

Figure 3:
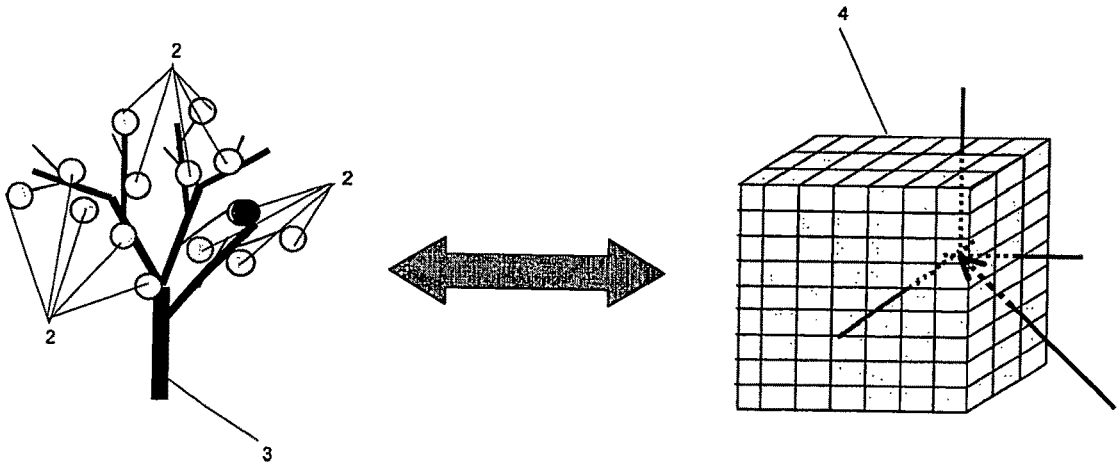
FIG. 3 is a schematic illustration of a process for converting spatial addresses to addresses associated with particular signal sources, in the embodiment of the present invention illustrated in FIG. 1.

FIG. 3 schematically illustrates the desired output of the lighting element location process of step S1 of FIG. 2. It can be seen that a plurality of voxels collectively define a voxelised representation 4 of the space containing the lighting elements 2. The location process maps each of the lighting elements 2 to one of the voxels of the voxelised representation of space 4. Having carried out the process schematically illustrated in FIG. 3, it is then a relatively straightforward matter to determine which lights should be illuminated for a particular image to be displayed, assuming that the image to be displayed is mapped onto the voxels of the voxelised representation 4. That is, if it is known which voxels should be illuminated, the output of step S1 will allow the lighting elements which are to be illuminated to be easily identified.

Figure 4:
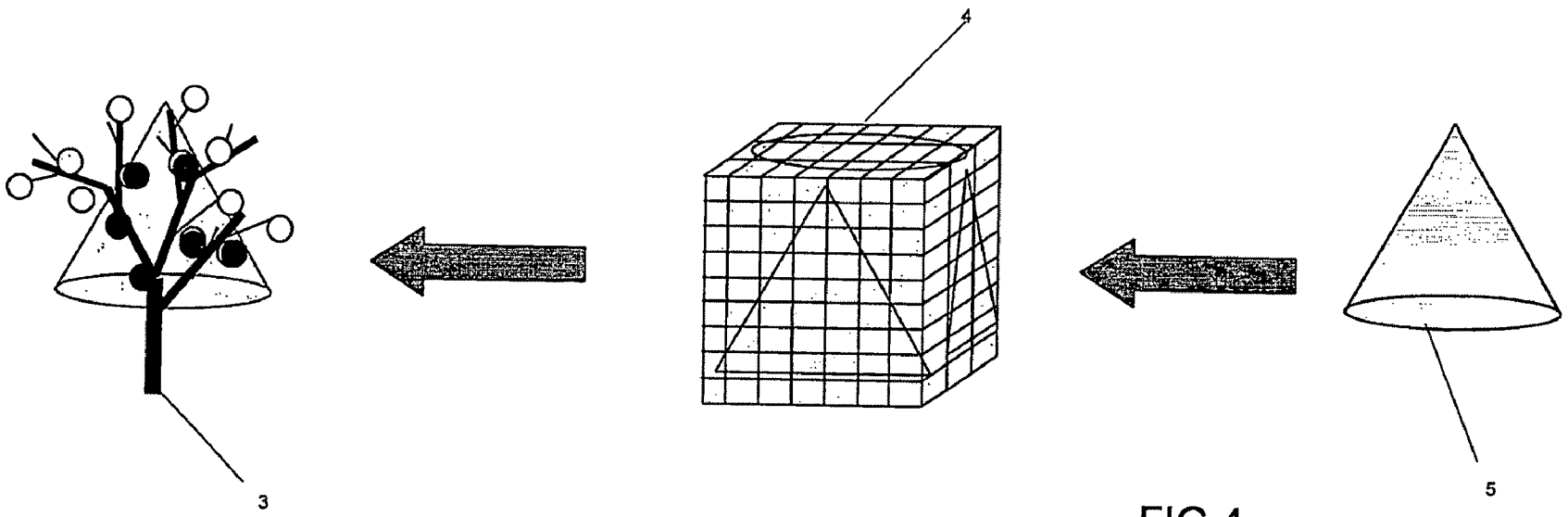
FIG. 4 is a schematic illustration of a process for presenting an image using a plurality of light sources, used in the embodiment of the present invention illustrated in FIG. 1.

The process for displaying an image on the lighting elements 2 is now described with reference to the schematic illustration of FIG. 4. It can be seen that image data 5 representing a three-dimensional image of a cone is to be displayed using the lighting elements 2, which have been associated with the voxelised representation 4 as described with reference to FIG. 3. The image data 5 is mapped onto the voxelised representation 4 to identify a plurality of voxels which should be illuminated. This corresponds to step S3 of FIG. 2. Having carried out this mapping operation, the lighting elements 2 to be illuminated can then be determined, and the appropriate lighting elements can then be illuminated to cause the image data 5 to be displayed using the lighting elements 2.

Apparatus used to implement a preferred embodiment of the present invention is now described with reference to FIG. 5. The PC 1 is connected to three control elements 6, 7, 8 which in turn are connected to respective sets of the lighting elements 2 via respective buses 9, 10, 11. The apparatus further comprises a power supply unit 12, which is also connected to the control elements 6, 7, 8. The PC 1 is connected to the control elements 6, 7, 8 via a serial connection. Operation of the apparatus is described in further detail below.

Figure 6:
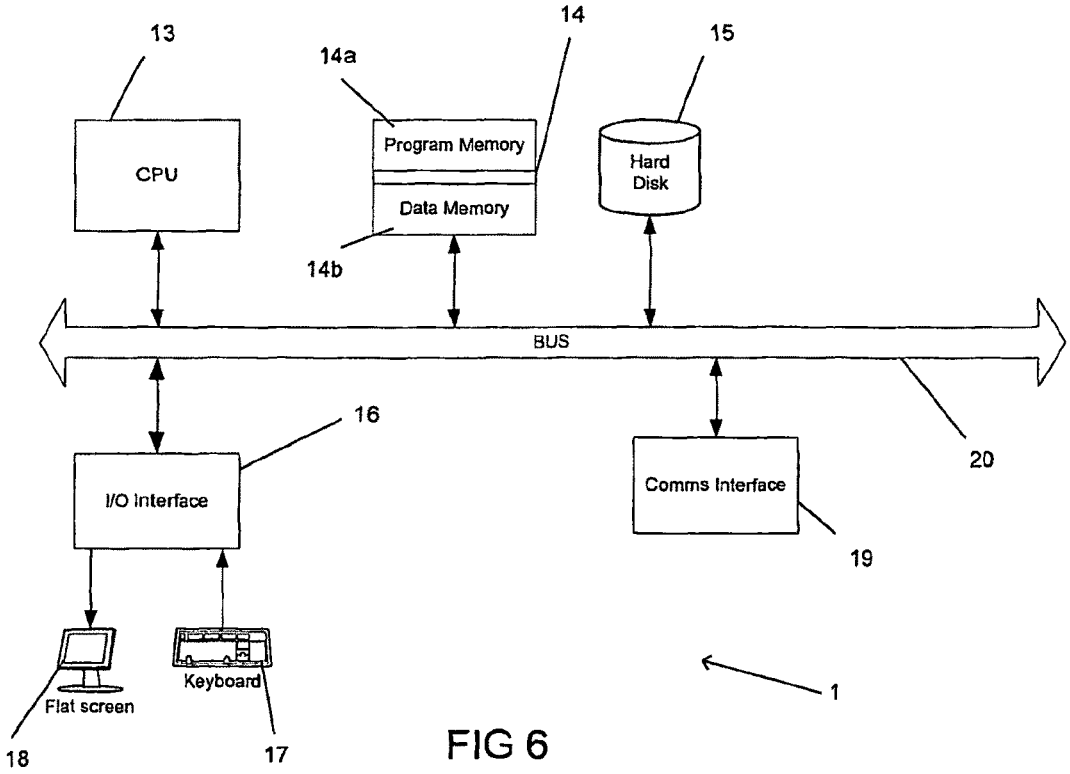
FIG. 6 is a schematic illustration of a PC shown in FIG. 5 and used to control the apparatus of FIG. 5.

Referring now to FIG. 6, the structure of the PC 1 is described. The PC 1 comprises a CPU 13 and random access memory (RAM) 14. The RAM 14 is in use provides a program memory 14*a* and a data memory 14*b*. The PC 1 further comprises a hard disk drive 15, and a input/output (I/O) interface 16. The I/O interface 16 is used to connect input and output devices to other components of the PC 1. In the illustrated embodiment, a keyboard 17 and a flat screen monitor 18 are connected to the I/O interface 16. The PC 1 further comprises a communications interface 19 which allows the PC 1 to communicate with the control elements 5, 6, 7 as is described in further detail below. The communications interface is preferably a serial bus. The CPU 13, the RAM 14, the hard disk drive 15, the I/O interface 16 and the communications interface 19 are connected together by a bus 20 along which both data and instructions can be passed between the aforementioned components.

Figure 7:
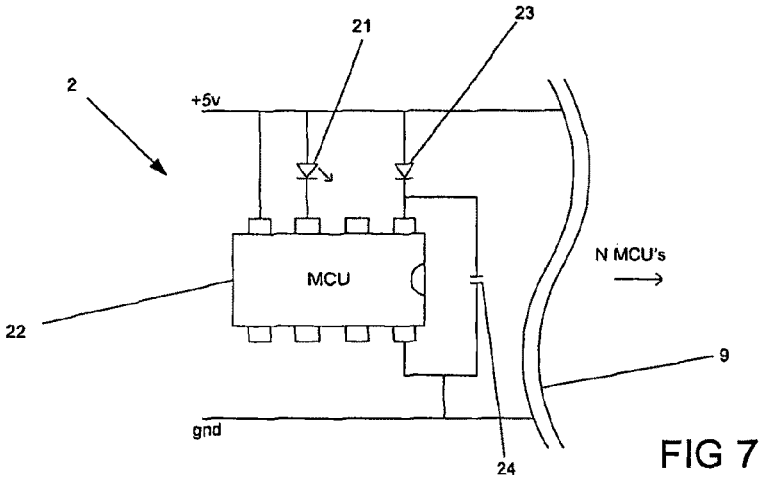
FIGS. 7, 7A and 7B are schematic illustrations of a lighting element shown in FIG. 5.

FIG. 7 illustrates an exemplary lighting element 2 connected to the bus 9. The lighting element 2 comprises a light source in the form of a light emitting diode (LED) 21 which is controlled by a processor 22. The processor 22 is configured to receive instructions indicating whether or not the LED 21 should be illuminated, and to act upon these instructions. The lighting element 2 further comprises a diode 23 and a capacitor 24. In practical embodiments of the present invention, a miniaturised version of the lighting element 2 can be manufactured, having dimensions similar to those of a conventional LED. Such a lighting element will expose two connections along which both power (a 5 v DC supply), and instructions to the processor 22 are provided. Indeed, it should be noted that the lighting element 2 is connected to the bus 9 by two connectors, and the lighting element obtains both power and instructions from the bus 9, as is described in further detail below.

Figure 7A:
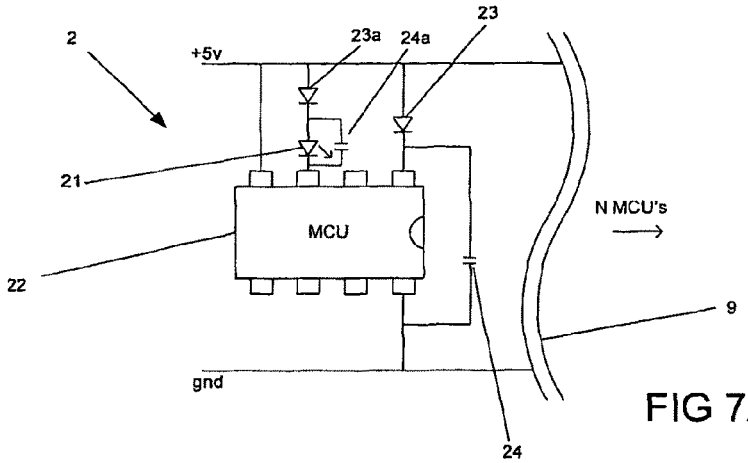
Figure 7B:
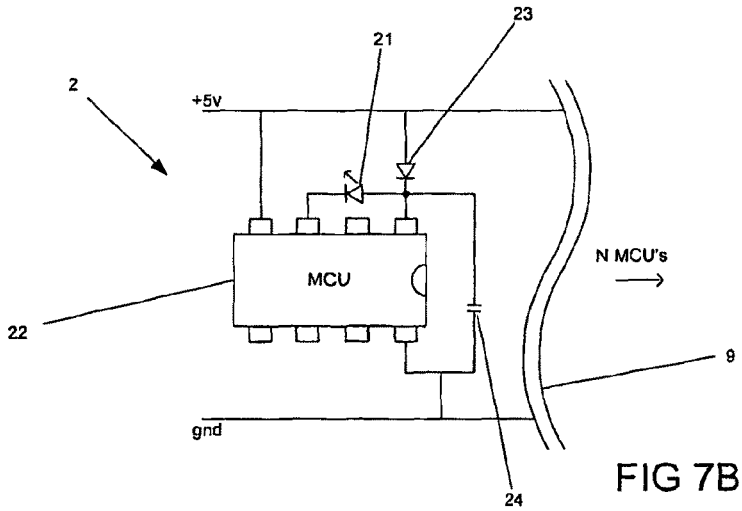

It should be noted that the lighting element illustrated in FIG. 7 is merely exemplary, and that lighting elements can take a variety of different forms. Two such alternative forms are shown in FIGS. 7A and 7B. These alternative forms are preferred in some embodiments as they aid elimination of flicker. In particular, it is to be noted that the arrangement of FIG. 7A includes a diode 23*a* in series with the LED 21, and a capacitor 24*a* in parallel with the LED 21. Furthermore, although the light source in the illustrated lighting element is an LED, any suitable light source can be used. For example the light source could be a lamp, a neon tube, or a cold cathode tube. It should also be noted that although in the described embodiment of the invention both instructions and power are provided to lighting elements via the bus 9, the instructions and power can be provided by different means. For example, power can be provided via the bus 9, with instructions being provided directly from the control element 6 by wireless means, such as by using Bluetooth communication. Alternatively, instructions could be provided via the bus 9, which each lighting element having its own power source in the form of a battery.

As outlined above, in the described embodiment, both instructions and power are provided to the lighting elements 2 connected to the bus 9 via the bus 9. Typically this is achieved by providing a 5 v DC power supply on the bus 9 and modulating this power supply to provide simplex uni-directional communication to the lighting elements 2, such that the control element 6 can transmit instructions to individual lighting elements. A 5 v supply is preferred, as otherwise it is likely that more complex lighting elements would be required to convert a received higher voltage to a voltage suitable for application to the light source.

When the apparatus of FIG. 5 was devised, scalability was a major concern. Specifically, it is important to make the individual lighting elements both easy and cheap to manufacture, and to displace control functions away from lighting elements. At the same time, care must be taken to avoid an overly-centralised solution which would be difficult to scale. It is for this reason that overall control is exercised by the PC 1, with the control elements 6, 7, 8 being delegated responsibility for control of their connected lighting elements. Referring back to FIG. 5, it can be seen that each of the control elements 6, 7, 8 is connected to the PC 1 via a bus 25, and this configuration achieves the desired balance between delegation and scalability.

Various addressing schemes can be used by the control elements 6, 7, 8 to instruct the individual lighting elements 2 to turn on or off. Indeed, in some circumstances it may be necessary for all lighting elements associated with a particular control element to turn on or off simultaneously, and in such a circumstance the control elements may control their connected lighting elements using broadcast communication. However, it is highly desirable that each lighting element can be individually addressed. Various of the possible addressing schemes are described in further detail below, but it should be noted that in general terms the control elements 6, 7, 8 are able to handle relatively complex addresses (e.g. IPv6 as described below), while individual lighting elements typically operate using simple addresses generated by a respective control element.

Each lighting element must have an address which is unique on its own bus. There are a number of ways in which such unique addressing can be realised. For example, in some embodiments addresses are hardcoded into each lighting element 2 at its time of manufacture. This is an approach which is adopted with regard to Medium Access Control (MAC) addresses of conventional computer network hardware. Although such an approach is viable, it should be noted that this is likely to result in unnecessarily long addresses, given that all addresses will be globally unique. This detracts from the desired simplicity of lighting elements. Additionally, the use of such addresses requires bi-directional communication between the control elements 6, 7, 8 and the individual lighting elements 2. Such bi-directional communication is preferably avoided for reasons of complexity and cost.

Additionally, in schemes using such hardcoded addresses, replacing a lighting element is likely to be difficult given that a failed lighting element would need to be replaced with a lighting element having the same address. This would hamper usability, and require users to order lighting elements with respect to their address and also require suppliers to stock large numbers of lighting elements having different addresses.

Because of these problems, an alternative addressing mechanism is preferred in some embodiments of the present invention. This approach involves each lighting element dynamically selecting an address that is unique on the bus to which it is connected. This approach operates using co-operation between lighting elements and the associated control element, and generates an 8-bit address for each lighting element.

Figure 8:
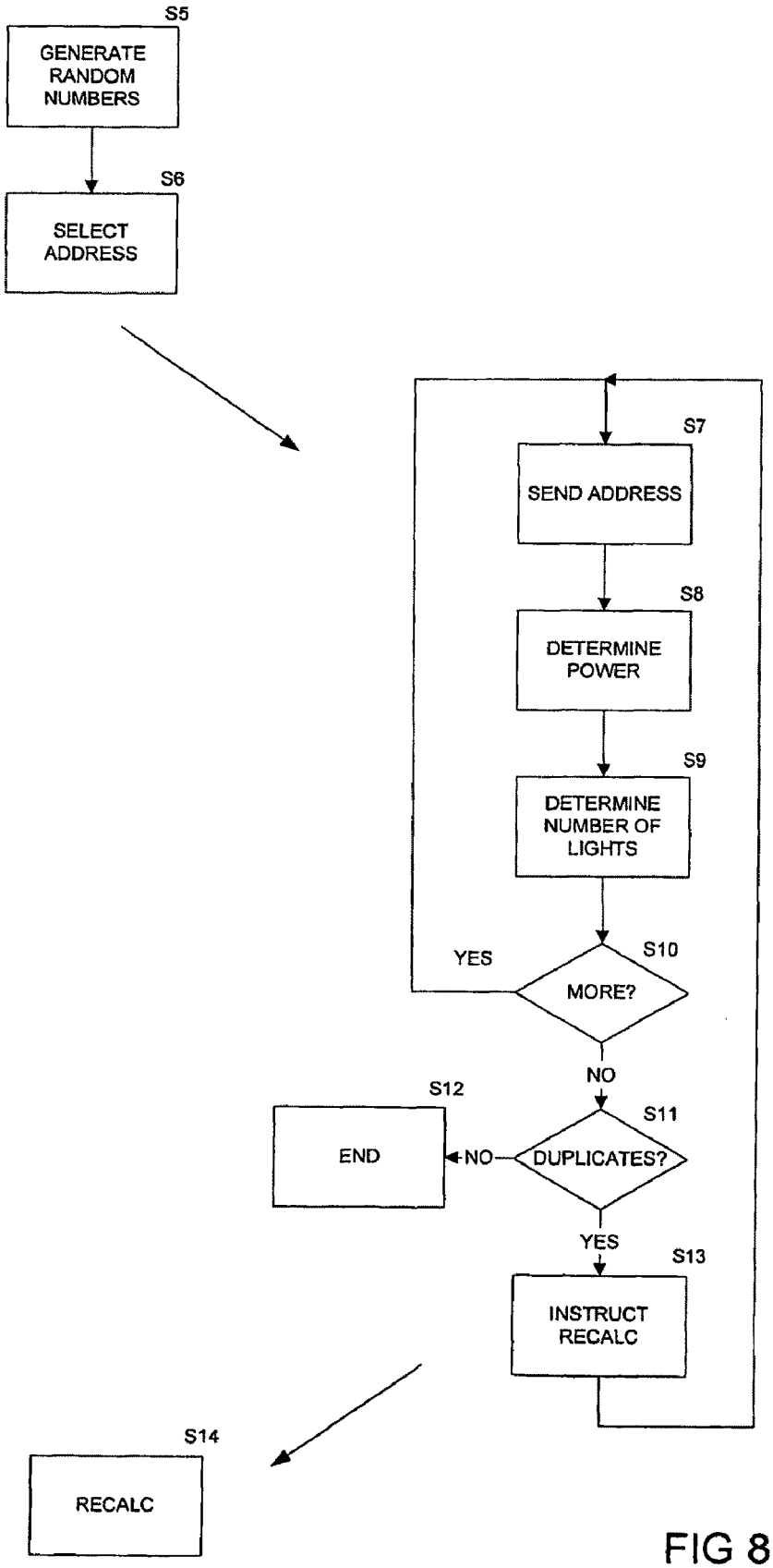
FIG. 8 is a flow chart showing an address determination algorithm used to allocate addresses to the lighting elements of FIG. 5.

FIG. 8 is a flowchart illustrating the address selection process. Steps S5 and S6 are carried out by each lighting element connected to a particular bus. At step S5 each lighting element generates a plurality of addresses using a pseudo-random number generator. This process is repeated for a predetermined time period (e.g. 1 second). The random number last generated at the end of this time period is then set to be the address of each lighting element (step S6). It should be noted that inaccuracies between on-board clocks of the processors of the various lighting elements will typically mean that the obtained addresses are reasonably evenly distributed across the address space.

When the predetermined time period mentioned above has elapsed, processing is carried out by the respective one of the control elements 6, 7, 8. The control element cycles through each address of the address space in turn. For a selected address, lighting elements 2 associated with that address are instructed to illuminate (step S7). Given that power and instructions are both sent on the same bus, the power drawn by the lighting elements can be determined at step S8, the power drawn being proportional to the number of lighting elements associated with the specified address. The power drawn is determined at step S8 (for example by measuring the current that is drawn), with the number of lighting elements illuminated being determined at step S9. Step S10 repeats this processing for each address in turn, such that the number of lighting elements associated with each address is determined. At step S11 a check is carried out to determine whether any address is associated with more than one lighting element. If no such addresses are found, it can be concluded that each lighting element has a bus unique address, and processing ends at step S12. However, if any duplicates exist, all lighting elements not having a bus unique address are instructed to repeat the processing of steps S5 and S6, which repeating is shown as step S14 in FIG. 8. After a predetermined period of time, the processing of steps S7 to S12 is repeated, to ensure that all lighting elements have unique addresses. If this processing determines address duplications, the processing of step S13 is again carried out, and so the process continues until all lighting elements on a particular bus have a bus unique address. In order to improve convergence speed, the control element can specify a set of unused addresses at step S13, and the lighting elements can then select their address from this set of unused elements, to reduce the risk of address duplications.

In some embodiments of the invention, lighting elements are provided with non-volatile storage capacity to store their last used address. This can avoid the processing of FIG. 8 being carried out each time a lighting configuration is used. Care is necessary however to ensure that all lighting elements remain connected to the bus to which they were connected when last used. In some embodiments of the invention, the consistency of lighting elements connected to a particular bus and using last used addresses, is verified by simply carrying out the processing of steps S7 to S12 of FIG. 8.

An alternative method for identifying multiple uses of a single address is now described with reference to FIGS. 8A and 8B. The processing described with reference to FIGS. 8A and 8B essentially replaces the processing described above with reference to steps S7 to S10 of FIG. 8. The alternative method is particularly appropriate where a large address space is used. In particular it is appropriate where the address space is substantially larger than the number of lighting elements to which addresses are to be allocated. The alternative method avoids a linear pass through a set of possible address as is required in the processing described with reference to FIG. 8. Indeed, a linear pass through a set of possible addresses where the address space is large maybe computationally unviable. For example, where a 32 bit address space is used a linear pass at 100 addresses per second would take over a year. The alternative method described with reference to FIGS. 8A and 8B employs a hierarchical scheme to determine whether any address clashes exist.

Figure 8A:
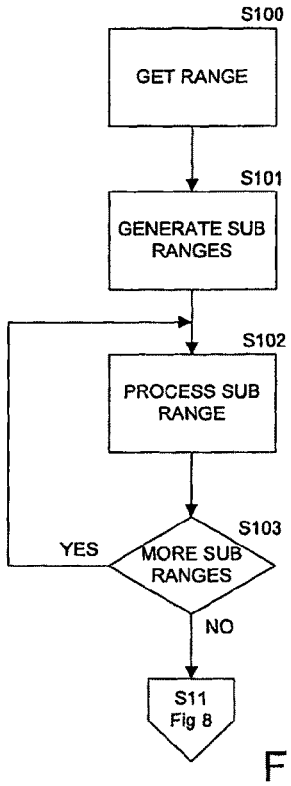
FIGS. 8A and 8B are flow charts showing a possible variation to the address determination of FIG. 8.

Referring now to FIG. 8A, at step S100 the range of addresses is determined. Sub ranges within the determined range of addresses are generated at step S101. This can be conveniently achieved by the use of an appropriate prefix. For example, if the range determined at step S100 is to be divided into two sub ranges this can be achieved by defining a first sub range as addresses beginning with a "0" valued bit and defining a second sub range as addresses beginning with an "1" valued bit. If it is desired to generate more than two sub ranges from the range determined at step S100, a prefix comprising more than a single bit may be used. For example, where a prefix comprising two bits is used four sub ranges may be provided.

Addresses within each sub range are processed at step S102 as will be described in further detail below. Step S103 determines whether further sub ranges remain to be processed. If no such sub ranges remain to be processed processing returns to FIG. 8 at step S11. If however further sub ranges remain to be processed processing passes from step S103 back to step S102.

Figure 8B:
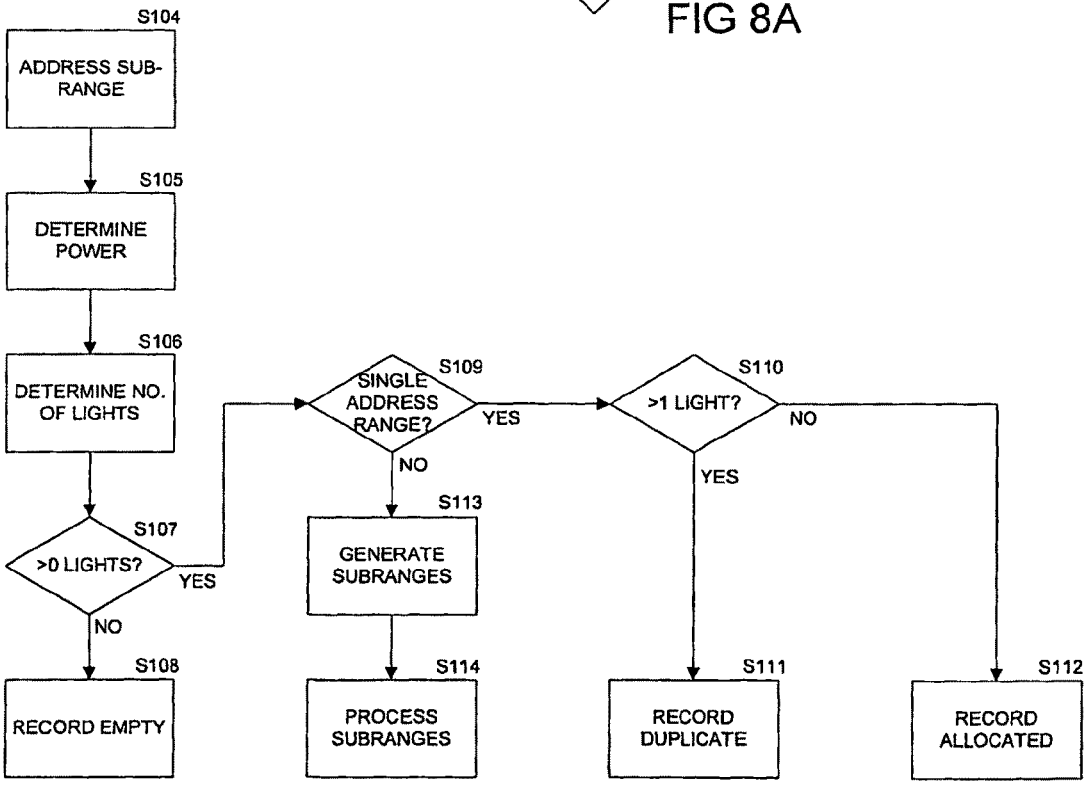

FIG. 8B shows the processing of step S102 in further detail. At step S104 lighting elements in the currently processed address sub range are instructed to illuminate. At step S105 the power drawn by the illuminated lighting elements is determined, and the determined power is used to determine a number of lighting elements which have been illuminated at step S106. At step S107 a check is carried out to determine whether any lights have been illuminated. If no lights have been illuminated data can be recorded indicating that no lighting elements have addresses within the currently processed sub range. Data indicating that this is the case is stored at step S108 and addresses within the processed sub range need not be processed further. If, however, the check of step s107 determines that some lighting elements were illuminated processing passes from step S107 to step S109. Here, a check is carried out to determine whether the currently processed address range includes only a single address. If this is the case, processing passes from step S109 to step S110 where a check is carried out to determine whether more than one lighting element has been illuminated. If it is determined that more than one lighting element has been illuminated processing passes to step S111 where data indicating this fact is stored. This data can then be processed in the manner described above with reference to FIG. 8. If however only a single lighting element is illuminated its address is noted and the address is marked as allocated at step S112.

If the check of step S109 determines that the currently processed range includes more than one address processing passes from step S109 to step S113. Here, sub ranges are generated from the currently processed address range, before those sub ranges are processed at step S114. The processing of step S114 itself involves the processing of FIG. 8B for each of the sub ranges generated at step S113. Thus, it can be seen that steps S109, S113 and S114 mean that when a lighting element is located within a sub range further processing is carried out to determine that lighting element's address.

It is to be noted that the complexity of the process described with reference to FIGS. 8A and 8B is related to the number of lighting elements and the logarithm of the number of addresses. The complexity is not linearly related to the total number of addresses. Thus, the processing of FIGS. 8A and 8B is computationally feasible for very large address ranges.

It will be appreciated that the processing of FIGS. 8A and 8B can be used when addresses have been allocated in any suitable way, including statically or dynamically. The processing of FIGS. 8A and 8B provides an effective way of determining addresses used by various lighting elements.

The preceding description has been concerned with the way in which addresses are determined so as to allow the control elements 6, 7, 8 to control individual lighting elements 2. It has been described that the busses 9, 10, 11 also carry power (typically a 5 v supply). Data in the form of addresses and instructions is supplied to the busses 9, 10, 11 along a bus 25. The PC 1 communicates with a bridge 25*a* via a USB connection. The bridge 25*a* is then connected to the control elements 6, 7, 8 via the bus 25. Power is supplied to the busses 9, 10, 11 along a bus 26 which is connected to the power supply unit 12. Although the busses 25 and 26 could be a single common bus, currently preferred embodiments of the present invention use two distinct buses 25, 26.

The power supply unit 12 is a 36 v DC power supply. Each of the control elements 6, 7, 8 includes means to convert this 36 v DC supply into the 5 v supply required by each bus. The use of a 5V supply allows standard processors to be used. The control elements 6, 7, 8 are also provided with means to carry out the modulation of the power supply to carry instructions.

A typical LED lighting element consumes 30 mA of current. Therefore a string of eighty lighting elements will draw 2.4 A of current at 5V. Such requirements can be met using inexpensive narrow gauge cabling.

The linear relationship between current and lighting element count limits the scalability of a single string of lighting elements. This scalability is further limited by the fact that the greater the number of lights, the greater the quantity of data which will be transmitted, thereby increasing the frequency of the modulated power supply. If the number of lights is too large, this frequency will become too high.

Given this limit to the scalability of a single string of lighting elements, the apparatus of FIG. 5 allows eight control elements to be connected to a single 36 v power supply unit. Each control element can control eighty lights, meaning that the configuration of FIG. 5 can be used to provide six hundred and forty lighting elements. The control elements can be connected together by cabling such as standard CAT 5 cabling.

If six hundred and forty lighting elements is insufficient the apparatus of FIG. 5 can be connected together with other similar apparatus, under the control of a central control element. Such a configuration is illustrated in FIG. 9. Here, two apparatus 27, 28, each configured as illustrated in FIG. 5 are connected together by a high bandwidth interconnect 29. A central control element 30 then provides overall control of the configuration, providing instructions to the PCs 31, 32 of the respective apparatus 27, 28.

Figure 9A:
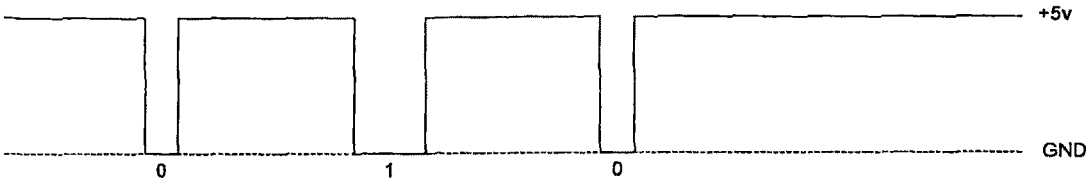
FIG. 9A is a schematic illustration of a pulse width modulated signal.

It has been described above that both power and instructions are provided to the lighting elements along the busses 9, 10, 11. This is achieved using a pulse width modulation technique. FIG. 9A shows an example pulse train. It can be seen that in general terms a voltage of +5 v is provided. When data is to be sent, the voltage falls to ground. The transmitted value is represented by the length of time for which the voltage falls to ground. Specifically, it can be seen from FIG. 9A that a relatively short pulse is used to represent a '0' bit, while a relatively long pulse is used to represent a '1' bit.

Additionally, when such modulation is used with a relatively high voltage power supply (e.g. a 36 v power supply), the voltage may drop not to ground, but rather simply to a lower level. For example, if the maximum voltage value is 36 v, the voltage may drop to 31 v to represent data.

Transmitting data as described above is advantageous given that it avoids long periods of time at which the voltage is at 0 v or a lower value than that which is desired. That is, by keeping pulse widths relatively short, little difference in terms of supplied power should be noted.

The busses 9, 10 11 operate communications at a rate of 50 kbps. This rate allows data to be processed by a relatively inexpensive 4 MHz processor. Data transmitted between control elements on the bus 25 is transmitted at a rate of 500 kbps.

Figure 9B:
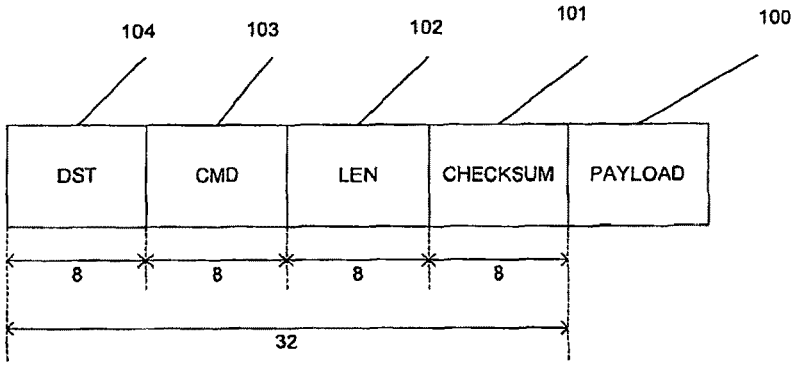
FIG. 9B is a schematic illustration of a data packet used to transmit commands to lighting elements.

The format of data transmitted to lighting elements is now described. A data packet is illustrated in FIG. 9B. It can be seen that the data packet includes an 8-bit destination field 100 specifying an address to which data is to be transmitted, an 8-bit command field 101 indicating a command associated with the data packet, and an 8-bit length field 102 indicating the data packet's length. A checksum field 103 provides a checksum for the data packet. A payload field 104 stores data transmitted in the data packet.

The destination field 100 takes a value indicating a lighting element address. However, the destination field 100 can take a value of 0 indicating that the data packet is destined for the control elements on a particular bus, or a value of 255 indicating a broadcast data packet.

Various commands can be specified in the command field of the data packet of FIG. 9B as is now described.

A command ON turns one or more lighting elements identified by the address in the destination field 100 on, while a command OFF, turns one or more lighting elements identified by the address in the destination field 100 off.

A command SELF_ADDRESS is initially broadcast to all lighting elements with a blank payload field 104 to trigger lighting elements to allocate addresses in the manner described above (FIG. 8, step S6). Where address clashes are detected, a further SELF_ADDRESS command is broadcast, although here the payload field 104 is provided with a bit pattern indicating addresses which have been allocated. That is, the bit pattern can include a bit for each possible address. On receiving the second data packet including the SELF_ADDRESS command, a lighting element determines whether its selected address is shown as allocated by inspecting the bit pattern provided in the payload field 104. If the selected address is not shown as allocated, it can be determined that the address selected caused a conflict with an address of another lighting element. The lighting element therefore selects a different address.

In selecting the different address, the lighting element can have regard to addresses indicated in the payload field 104 to be allocated so as to mitigate further address clashes.

A command SELF_NORMALISE is used to re-allocate addresses. A data packet transmitting a self normalise command has a payload indicating allocated addresses, as described above with reference to the command SELF_ADDRESS. The command SELF_NORMALISE causes addresses to be adjusted such that the addresses are consecutive. This is achieved by a lighting element processing the payload field 104 to identify the bit associated with its address. Bits preceding this address are counted, and one is added to the count to provide an address for a particular lighting element.

A command SET_BRIGHTNESS is used to set lighting element brightness. A data packet sending this command has a payload field 104 indicating the brightness, and an appropriately configured destination field 100. Similarly, a command SET_ALL_BRIGHTNESS is used to set the brightness of all of the lighting elements.

A command CALIBRATE causes each lighting element to emit a series of pulses which can be used to identify lighting elements for calibration purposes, as described below. A command FACTORY_DEFAULT is processed by a lighting element to cause the lighting element's settings to revert to factory defaults.

Having described how instructions are transmitted to lighting elements, operation of lighting elements, and control elements is now described in further detail.

Figure 9C:
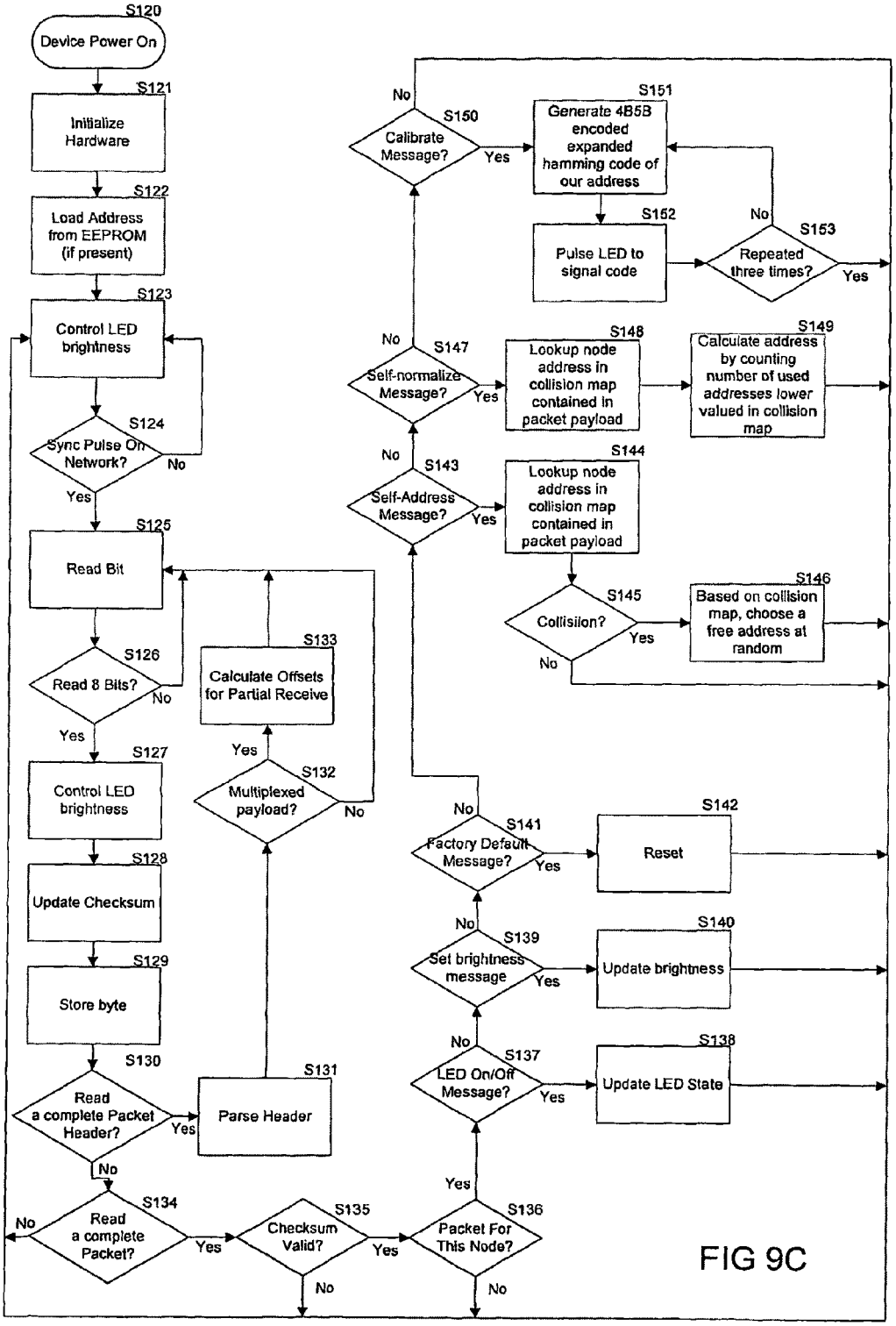
FIG. 9C is a flow chart showing processing carried out by a lighting element in FIG. 5.

FIG. 9C is a flowchart showing operation of a lighting element. At step S120 a lighting element is powered up, and hardware is initialized at step S121. At step S122, an attempt is made to load an address for the lighting element from storage. An address is loaded from storage at step S122 when static addresses are used, or when lighting elements store data indicating their last used address.

At a number of points in the processing of FIG. 9C an operation is carried out to set brightness of the LED. This effectively involves controlling the frequency at which the LED is energised so as to cause the desired brightness to be provided. Such processing is carried out at step S123.

At step S124 a check is carried out to determine whether the lighting element can receive a synchronisation pulse on the bus to which it is connected. If no such pulse is received, processing returns to step S123. If however a synchronisation pulse is received, processing continues at step S125 where a bit of data is read from the bus. At step S126 a check is carried out to determine whether 8-bits of data (a byte) have been read. If a byte has not been read, processing returns to step S125. When a byte is read, the LED brightness is again configured at step S127, before a checksum value is updated based upon the processed byte at step S128. At step S129 the received byte is stored, although it is to be noted that the processing is configured so that only bytes of interest to a particular lighting element are stored at step S129.

Processing passes from step S129 to step S130 where a check is carried out to determine whether the most recently processed four bytes represent a packet header. That is, a check is carried out to determine whether the most recently processed four bytes represent a destination field 100, a command field 101, a length field 102, and a checksum field 103, as described with reference to FIG. 9B. If it is determined that the most recently processed bytes do represent a packet header, processing passes to step S131 where the packet header is parsed. Processing then passes to step S132 whether a check is made based upon the value of the command field 101 of the processed packet header. If the command field 101 indicates that that the packet includes a multiplexed payload, processing passes to step S133, otherwise processing passes back to step S125 where further data is read from the bus. A multiplexed payload is a payload indicating lighting elements to which the data packet is directed. That is, a payload such as that provided in the SET_ALL_BRIGHTNESS command described above. Where a data packet includes a multiplexed payload, processing of step S133 calculates an appropriate offset within the payload which will be of interest to the lighting element. That is, the payload will be relatively long, and a lighting element may have insufficient storage capacity to store the entire payload. The processing of step S133 therefore identifies an offset within the payload at which data of interest is to be found. The offset determined at step S133 can be used in subsequent processing to determine whether a byte of data should be stored at step S129.

If the check of step S130 determines that the most recently received four bytes do not represent a packet header, processing passes to step S134 where a check is carried out to determine whether the most recently received bytes collectively represent a complete data packet. If this is not the case, processing returns to step S123 and continues as described above. If however the check of step S134 determines that a complete packet has been received, processing passes to step S135, where a check is carried out to determine whether the checksum value calculated by the processing of step S128 is valid. If the checksum is not valid, processing returns to step S123. Otherwise, processing continues at step S136 where a check is carried out to determine whether the received data packet is intended to be processed by this particular lighting element. If the received data packet is not intended for processing by this particular lighting element, processing returns to step S123. Otherwise, subsequent processing is carried out to determine the nature of the received data packet and the required action.

At step S127 a check is carried out to determine whether the received data packet represents an ON command or an OFF command. If this is the case, the state of the LED is updated at step S138, before processing returns to step S123.

At step S139 a check is carried out to determine whether the received data packet represents a SET_BRIGHTNESS command. If this is case, brightness information used at step S123 and S127 described above is updated at step S140, before processing returns to step S123.

At step S141 a check is carried out to determine whether the received data packet represents a FACTORY_DEFAULT command. If this is the case, processing passes to step S142 where lighting element settings are reset. Processing then returns to step S123.

At step S143 a check is carried out to determine whether the received data packet represents a SELF_ADDRESS command. If this is the case, processing continues at step S144 where the payload is processed to obtain data indicating whether the lighting element's address is allocated. If the address is allocated it can be determined that there is no address clash. If however the address is not allocated, it can be determined that an address clash did occur. Step S145 is a check to determine whether data associated with the lighting element's address indicates that an address clash occurred. If there is no such clash, processing continues at step S123. If however an address clash did occur, processing passes from step S145 to step S146 where a further address for the lighting element is chosen, the chosen address not being marked as allocated in the payload of the received data packet.

At step S147, a check is carried out to determine whether the received command represents a SELF_NORMALISE command. If this is the case, processing continues at step S148 where the payload of the data packet is processed to determine how many lower valued addresses have been allocated to other lighting elements. The address for the current lighting element is then calculated at step S149 by counting how many lower valued addresses have been allocated, and adding one to the result of that count.

At step S150 a check is carried out to determine whether the received message represents a CALIBRATE command. If this is case, processing passes to step S145 where a code to be emitted by way of visible light is determined at step S151. The determined code is then provided to the LED at step S152. The processing of step S153 ensures that the code is emitted three times. The generation and use of such codes is described in further detail below.

Figure 9D:
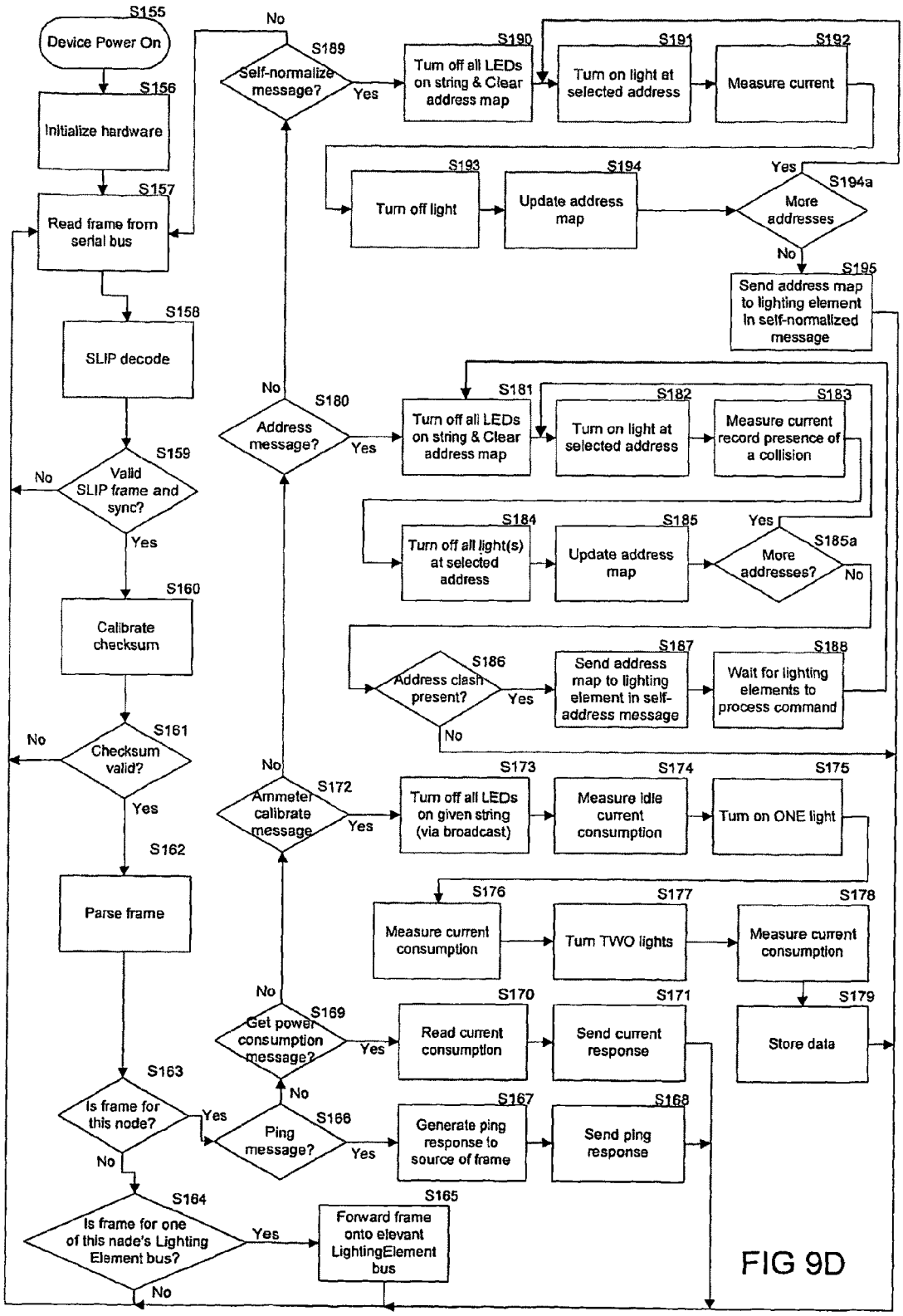
FIG. 9D is a flow chart showing processing carried out by a control element in FIG. 5.

Having described operation of a lighting element, operation of the control elements 6, 7, 8 is now described with reference to FIG. 9D.

At step S155 a control element is powered up, and a step S156 the control element's hardware is initialized. At step S157 a frame of data is received by the control element from the bus 25 to which it is connected. The frame read at step S157 is decoded at step S158 and validated at step S159. If the validation of step S159 is unsuccessful, processing returns to step S157. Otherwise, processing passes from step S159 to step S160 where a checksum value is calculated. The checksum value is validated at step S161, and if the checksum value is invalid, processing returns to step S157. If the checksum value is valid, processing continues at step S162 where the frame is parsed. At step S163 a check is carried out to determine whether the received frame is intended for the current control element. If this is not the case, processing passes to step S164 where a check is carried out to determine whether the received frame is intended for onward transmission to a lighting element under the control of the control element. If this is the case, the frame is forwarded at step S165, before processing returns to S157. If it is not the case that the frame is intended for onward transmission by the control element processing the frame, processing passes from step S164 to step S157.

If the check of step S163 determines that the currently processed frame is intended for processing by the particular control element, processing passes to a plurality of checks configured to determine the nature of the received command.

At step S166 a check is carried out to determine whether the received frame represents a ping message. If this is the case, the control element generates a response to the ping message at step S167 and this response is transmitted at step S168.

At step S169 a check is carried out to determines whether the received frame is a request for data indicating current currently being drawn from the control element by lighting elements connected thereto. That is, whether the received frame is a request for data indicating electrical power consumption. If this is the case, the current consumption is read at step S170 and the read current is provided by way of a response at step S171 before processing returns to step S157.

At step S172 a check is carried out to determine whether the received frame is a request for current calibration. That is, whether the received frame requests that the control element carries out calibration operations so as to determine current levels associated with the illumination of no lighting elements, one lighting element and two lighting elements, such current levels being usable as described above. If the check of step S172 determines that the received frame is a request for current calibration, processing passes to step S173 where all lighting elements are turned off by way of a broadcast message. At step S174 current consumption with no lighting elements illuminated is measured. One lighting element is illuminated at step S175, and the resulting current consumption is measured at step S176. At step S177 two lighting elements are illuminated, and the current consumption for these two lighting elements is measured at step S178. Data representing the current consumed when no lighting elements are illumination, when one lighting element is illuminated and when two lighting elements are illuminated in then stored at step S179 before processing returns to step S157.

At step S180, a check is carried out to determine whether the received frame represents a request to carry out addressing operations. If this is the case, processing continues at step S181 where all lighting elements under the control of the control elements are switched off. At step S182, an address is selected, and a command is issued to illuminate any lighting elements associated with the selected address. At step S183 the current consumed by the illuminated lighting elements is measured to determine whether an address clash has occurred. The illuminated lighting elements are switched off at step S184, and an address map is updated at step S185 indicating that a single lighting element is associated with the processed address, that no lighting elements are associated with the processed address or that multiple lighting elements are associated with the processed address (i.e. an address clash exists). At step S185*a* a check is carried out to determine whether further addresses remain to be processed. If this is the case, processing returns to step S182. When no further addresses remain to be processed, processing passes to step S186 where a check is carried out to determine whether any address clashes exist. If no address clashes exist it can be determined that each lighting element has a uniquely allocated address, and processing continues at step S157. If however one or more address clashes do exist processing passes from step S186 to step S187 where a self address message is transmitted to all lighting elements with a payload indicating address allocations in the manner described above. At step S188 the control element delays for a predetermined time period to allow the lighting elements to reallocate addresses, before processing returns to step S183.

At step S189 a check is carried out to determine whether the received message is a request to the control element to generate data forming the basis for a SELF_NORMALISE command to lighting elements as described above. If this is the case, processing passes to step S190 where all lighting elements are instructed to turn off, and any previously stored address map is cleared. At step S191 a command is issued to illuminate a lighting element at a selected address. At step S192 the current consumed in response to this command is measured, and the light is turned off at step S193. At step S194 the address map is updated to indicate whether a lighting element is associated with the currently processed address. This processing is based upon the current measured at step S192. Processing passes from step S194 to step S194*a* where a check is carried out to determine whether more addresses remain to be processed. If this is the case, processing returns to step S191. When no further lighting elements remain to be processed a SELF_NORMALISE command to lighting elements is generated at step S195, and the generated address map is provided in a data packet conveying this command.

Much of the preceding description has been concerned with lighting elements connected to a fixed wire. It should be noted that the address allocation methods described above are widely applicable to any collection of devices for which there is an ability to send broadcast messages to all the devices and some way of distinguishing whether zero, one or more than one of the devices is active. In particular, in the case of lighting elements, the illumination of particular lighting elements can be determined from light emitted by the lighting elements themselves, as detected by appropriate cameras. The use of emitted light to determine whether lights are illuminated is particularly valuable in wireless arrangements where it is not possible to monitor the power consumed by the various lighting elements. It should also be noted that schemes described above avoid the need for a lighting element to actively transmit data, which is particularly desirable from the point of view of complexity and power consumption.

The preceding description has set out how a plurality of lights can be connected together so as to achieve distributed control of individual lights, and also so as to conveniently provide power to various of the lights.

Referring back to FIG. 2, it can be seen that at step S1, the lighting elements 2 are located in space. The next part of this description describes various location algorithms. In general terms the location algorithms operate by using a plurality of cameras (used either sequentially or concurrently) to capture images of lighting patterns, and these images are then used in the location process.

FIG. 10 is a schematic illustration of a five lighting elements P, Q, R, S, T, which are viewed by two cameras 33, 34. Lighting elements P, Q, R, S are within the field of view of the camera 33, while lighting elements Q, R, S and T are within the field of view of the camera 34. FIG. 10A illustrates an example image captured by the camera 33. It can be seen that four pixels are illuminated, one for each of the four light sources P, Q, R, S. Similarly, FIG. 10B illustrates an example image captured by the camera 34. Here, four pixels are again illuminated, this time representing the lighting elements Q, R, S, T. Although in the images of FIGS. 10A and 10B individual pixels relate to individual lighting elements, there is no way of identifying which pixel is associated with which light element. A solution to this problem is now described, first by reference to FIG. 11, in which four lighting elements A, B, C, D are within the field of view of a camera 35. Each of the lighting elements A, B, C, D has an identification code unique amongst the four lighting elements A, B, C, D which are to be located. This identification code takes the form of a binary sequence. During location of the lighting elements A, B, C, D each lighting element presents its identification code by turning on and off in accordance with the identification code.

The four lighting elements A, B, C, D are allocated identification codes as indicated in table 1:

TABLE 1

| Lighting Element | Identification code |
|---|---|
| A | 1001 |
| B | 0101 |
| C | 0111 |
| D | 0011 |

FIG. 11A shows images captured by the camera 35 when each of the lighting elements A, B, C, D presents its identification code, assuming that the lighting elements A, B, C, D present their identification codes in synchronisation with one another, that the camera 35 and lighting elements are stationary with respect to one another, and that each lighting element causes illumination of one or more pixels of the captured image. FIG. 11A comprises four images generated at four distinct times, the time between images being sufficient for each lighting element to be presenting the next bit of its identification code.

At time t=1, lighting element A is detected by the camera 35. At time t=2, two lighting elements are detected by the camera 35, the detected lights being different lights to that detected at time t=1 (i.e. lighting elements B and C), that is three lights have been detected in total. At time t=3, two lighting elements are again detected by the camera 35, but this time lighting elements C and D are detected. Therefore, after the image of time t=3, all four lighting elements A, B, C, D have been detected, the lights being distinguishable from one another by virtue of their spatial positions within the generated images. At time t=4, all four previously located lighting elements A, B, C, D are detected.

By combining the data of all four images, the identification code of each lighting element can be determined, allowing the lighting elements to be distinguished from one another, even if the camera 35 is moved, or if the lighting elements are viewed from a different camera.

It can be seen that lighting element A is detected at times t=1 and t=4, but not detected at times t=2 and t=3. Therefore, the identification code of lighting element A is determined to be 1001, as indicated in table 1. Lighting element B is detected at times t=2 and t=4, but not detected at times t=1 and t=3. The identification code of lighting element B is therefore determined to be 0101, again as indicated in table 1. Lighting element C is detected at times t=2, t=3 and t=4, but is not detected at time t=1. The identification code of the lighting element C is therefore determined to be 0111 as indicated in table 1. Finally, the lighting element D is detected at times t=3 and t=4, not at times t=1 and t=2. The identification code for lighting element D is therefore determined to be 0011, again as indicated in table 1.

It will be appreciated that the simple four bit codes described above will only be sufficient to provide distinct codes for sixteen lighting elements. It will also be appreciated that simply detecting lights in the manner described above can be problematic, and prone to errors. For example, falling objects such as leaves may obscure a lighting element from visibility by the camera, thereby causing its identification code to be incorrectly determined. Indeed, even particulate matter can obscure a lighting element from visibility. Conversely, lighting elements can be falsely detected by detection of external light sources. Various encoding mechanisms, intended to improve the resilience of the identification process are now described.

In some preferred embodiments of the present invention, lighting element identification codes are encoded using Hamming codes. Hamming codes are preferred in some embodiments of the invention because of the relatively low complexity of the encoding and decoding processes. This is important, as codes may need to be generated by individual lighting elements, which as described above are designed to have very low complexity, so as to promote scalability. Hamming codes provide either guaranteed detection of up to two bit errors in each encoded transmission, or can correct a single bit error without the need for further transmissions. In approximately 50% of cases, encoded transmissions including three errors or more errors, will be detected. Hamming codes are often used where sporadic bit errors are relatively common.

Hamming codes are a form of block parity mechanism, and are now described by way of background. The use of a single parity bit is one of the simplest forms of error detection. Given a codeword, a single additional bit is added to the codeword, which is used only for error control. The value of that bit (known as the parity bit) is set in dependence upon whether the number of bits having a '1' value in the codeword is odd (odd parity) or even (even parity). Upon reception of a codeword including a parity bit, the parity of a codeword can be checked against the value of the parity bit to determine if an error occurred during transmission.

Although the simple parity bit mechanism described above gives one bit error detection, it does not provide any error correction capability. For example, it cannot be determined which bit is in error. It can also not be determined if more than one error occurred.

Hamming codes make use of multiple inter-dependent parity bits to provide a more robust code. This is known as a block parity mechanism. Hamming codes add n additional parity bits to a value. Hamming encoded codewords have a length of $2^n-1$ bits for n>3 (e.g. 7, 15, 31 . . . ). $(2^n-1-n)$ bits of the $(2^n-1)$ bits are used for data transmission, while n bits are used for error detection and correction data. In other words, messages of 4 bits can be Hamming encoded to form a 7 bit codeword, in which 4 bits represent data which it is desired to transmit and 3 bits represent error detection and correction data. Messages of 11 bits can similarly be Hamming encoded to form 15 bit code words, in which 11 bits represent useful data, and 4 bits represent error detection and correction data.

Hamming encoding is now described. The parity bits are generated by taking the parity of a subset of the data bits. Each parity bit considers a different subset, and the subsets are chosen formally such that a single bit error will generate an inconsistency in at least 2 of the parity bits. This inconsistency not only indicates the presence of an error, but can provide enough information to identify which bit is incorrect. This then allows the error to be corrected.

Figure 12:
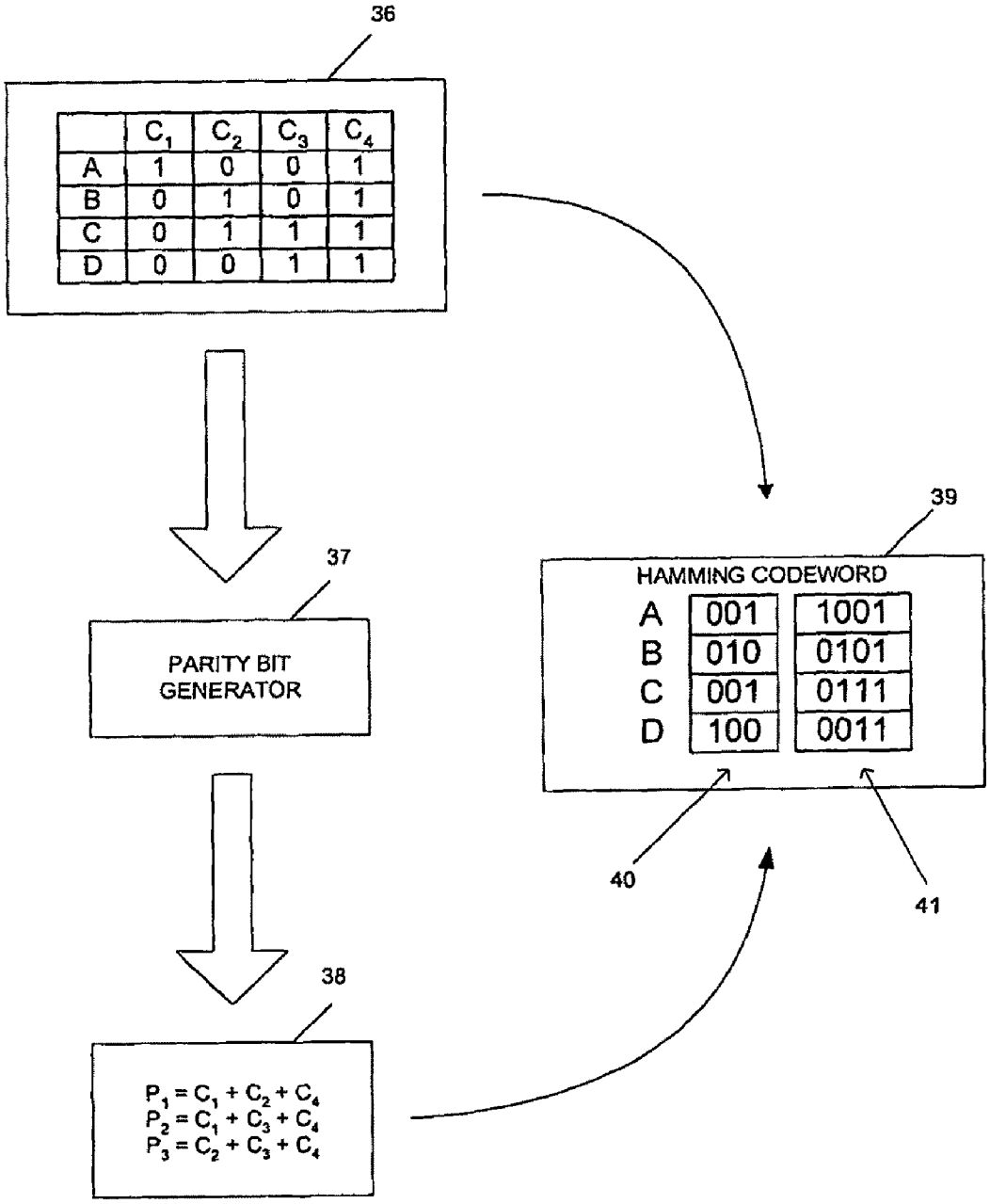
FIG. 12 is a schematic illustration of Hamming coding, as used in some embodiments of the present invention.

An example of the encoding process is now presented with reference to FIG. 12. Here the four 4-bit identification codes of table 1 are Hamming encoded to generate 7-bit code words. The four identification codes shown in table 1 form input data 36, to a parity bit generator 37. The parity bit generator 37 outputs three parity bits 38 for each input identification code. The input data 36 and parity bits 38 are then combined to generate Hamming encoded identification codes 39.

Operation of the parity bit generator 37 is now described in further detail. Three parity bits are generated for each input codeword 36, each being computed by summing three bits of the input code word and taking the least significant digit of the resulting binary number. FIG. 12 shows that bits of the input codes 36 are labelled $c_1$ to $C_4$ (with $c_1$ being the most significant bit), and the parity bits $p_1$, $p_2$, and $p_3$ are computed as follows:

$$p_1=c_1+c_2+c_4$$

$$p2=c_1+c_3+c_4$$

$$p3=c_2+c_3+c_4$$

Having computed these three parity bits for each identification code, Hamming encoded code words 39 are generated by incorporating the three generated parity bits for each identification code, into that identification code, to generate a 7 bit value. In general terms, these parity bits are usually interleaved with bits specifying the identification code, so that parity data is not all lost in a burst error. That is the first three bits 40 of the 7-bit value represent error detection and correction data, while the remaining four bits 41 represent the identification code.

Generation of a 15-bit code word starting from an 11-bit value can be carried out in a very similar manner, although this is not presented in detail here, as such encoding will be readily apparent to one of ordinary skill in the art.

Hamming codes may also be extended to form an Expanded Hamming Code. This involves the addition of a final parity bit to the code, which operates on the parity bits generated as described above. This allows the code to also detect (but not correct) two bit errors in a single transmission while having the ability to correct one-bit errors, at the cost of one additional bit. Expanded Hamming codes can be used to generate 16-bit encoded values from 11 bit values, and to generate 8 bit encoded values from 4 bit values.

In preferred embodiments of the present invention, lighting elements have associated 11 bit identification codes, and these identification codes are encoding using expanded Hamming codes to generate 16 bit encoded identification codes. The 11 bit identification codes provide $2^{11}$ (2048) distinct identification codes, meaning that 2048 lighting elements can be used and differentiated from one another. By using expanded Hamming encoding, each code has good resilience from errors, and both error detection and correction functionality is provided. The use of such expanded Hamming encoding provides a good balance between robustness needed when light patterns are transmitted through air (which is a noisy channel) and the need to use efficient encoding mechanisms, so as to preserve the simplicity of individual lighting elements. The relatively small overhead (i.e. five bits) imposed by the expanded Hamming code does not unduly increase the time taken for codes to be visibly transmitted by the lighting elements.

Although 16-bit codes of the type described above are preferred in some embodiments of the present invention, alternative codes can be used, such as 8-bit expanded Hamming codes encoding identification codes having a length of 4-bits. Although such a code will provide only sixteen distinct identification codes, meaning that only sixteen lighting elements can be used simultaneously, the chance of accurate code recognition is increased, due to reduced code length. However, one possible solution which balances the improved recognition characteristics of shorter codes, with the need for a larger number of distinct identification codes, is for each lighting element to transmit two 8-bit expanded Hamming codes. Such a technique would provide 255 distinct identifiers, each comprising two codes. Additionally, such a technique would maintain the good error resilience associated with the shorter codes.

In alternative embodiments of the present invention, a very large number of distinct identification codes may be required. In such circumstances, each lighting element could be allocated a 26 bit identification code, which could be coded as a 31 bit expanded Hamming code. Such a code would allow $2^{26}$ (approximately 67 million) lighting elements to be used.

It has been described above that the lighting elements visibly transmit their identification codes to one or more cameras by turning their light sources on or off. In order to improve scalability and minimise system complexity, the lighting elements and the cameras operate asynchronously. That is, no timing signals are communicated between the lighting elements and the cameras. Therefore, there is no synchronisation between when a lighting element changes state, and when a camera captures a frame.

When using asynchronous transmission of the type outlined above, the rate (frequency) at which the code is transmitted must be carefully controlled with respect to the frame rate of the camera, so as to ensure that at least one frame of video data is captured for each transition. Otherwise, data could be lost, resulting in the reception of an inaccurate codeword. More specifically, the frequency of the code transmitted must be no more than half the frame rate of the camera, in accordance with the Nyquist theorem. Typically video cameras operate at frame rates of 25 frames per second. Therefore identification codewords are typically transmitted at no more than 12 Hz.

One of two modulation techniques is used in the code transmission process in preferred embodiments of the invention. A modulation technique is the manner in which a codeword (a series of 0s and 1s) is translated into a physical effect—in this case the flashing of a lighting element. A first modulation technique is non-return to zero (NRZ) encoding, and a second modulation technique is Binary Phase Shift Keying (BPSK). Both of these techniques are described in further detail below.

NRZ encoding is a simple modulation scheme for data transmission. A '1' is translated to a high pulse, and a '0' is translated to a low pulse. In preferred embodiments of the invention, the transmission of a '1' involves the switching on of a lighting element, and a '0' extinguishing it. This is the modulation technique described above with reference to FIGS. 11 and 11A.

NRZ modulation is not often associated with asynchronous transmission, as long runs of zeroes or ones in the codeword can result in long periods of time during which there is no change in state of the signal (in this case the state of a lighting element). Resultantly, some bits can be 'overlooked' due to clock drift between the sender and receiver. Moreover, such modulation can in the case of the present invention make detection of the start of a transmission problematic, as is described in further detail below.

There are however, some benefits associated with using NRZ modulation in embodiments of the present invention. Firstly, the transmission rate of the data is so slow (12 Hz) that clock drift can be considered insignificant compared to the accuracy of the clock on today's processors. Secondly, the efficiency of NRZ modulation is relatively high—one bit of data can be transmitted every cycle, giving 12 bits per second at 12 Hz. Thus, notwithstanding the disadvantages set out above, NRZ modulation is used in some embodiments of the present invention.

The second modulation technique mentioned above was BPSK modulation, which is another relatively simple modulation technique. BPSK modulation has advantages in that code transmissions using BPSK modulation do not include lengthy periods of time without transitions. BPSK modulation is now described.

BPSK modulation operates by transmitting a fixed length pulse (a pulse of light in the case of the present invention) regardless of whether a '0' or a '1' is to be transmitted. BPSK encodes '0' values and '1' values in a particular way, and then transmits data using that encoding. BPSK is now described with reference to an example. In the example, a '0' is encoded as a low period followed by a high period, and a '1' is encoded as a high period followed by a low period. This encoding is shown in FIG. 13, where the pulse shapes used to represent '0' and '1' values can be seen.

Figure 13:
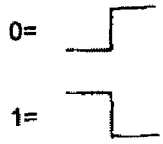
FIG. 13 is an illustration of pulse shapes used in Binary Phase Shift Keying (BPSK) modulation.
Figure 14:
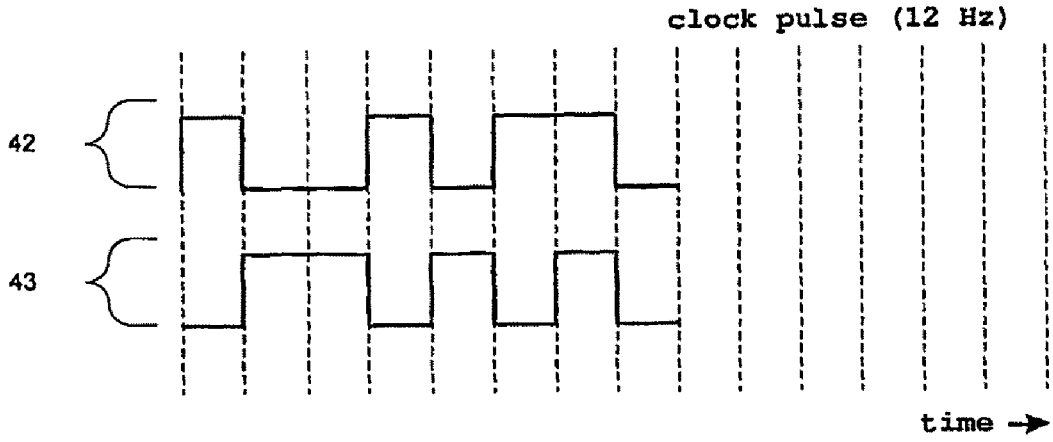
FIG. 14 is a schematic illustration of how BPSK modulation, as used in some embodiments of the present invention.

FIG. 14 illustrates two encoded pulse streams 42, 43 generated using the encoding of FIG. 13. It can be seen that each pulse stream comprises four pulses, each having a duration of two clock cycles. The pulse stream 42 comprises a '1' pulse, followed by a '0' pulse, followed by another '0' pulse, followed by a '1' pulse. Thus, the pulse stream 42 represents the code 1001. The pulse stream 43 comprises a '0' pulse, followed by three '1' pulses. Thus the pulse stream 43 represents the code 0111.

Referring to FIG. 14, it can be seen that there are now never more than two clock cycles without a transition, regardless of the data, meaning that accurate data transmission can be more easily achieved. However, it should be noted that it now takes two clock cycles to transmit a single bit. This results in a slower effective data transfer rate of 6 bits per second.

The preceding description has provided details of two modulation schemes NRZ modulation and BPSK modulation. NRZ modulation is suitable for use in embodiments of the present invention in which lighting elements are fixed relative to one another (i.e. where the cameras and lighting elements are fixed and not liable to camera shake, wind, and other similar effects). The time to recognise a 16-bit identification code using NRZ modulation is approximately 1.5 seconds at a transmission rate of 12 Hz. BPSK modulation provides a much more robust scheme supporting higher levels of mobility, but at the cost of a slightly higher recognition time, at 3 seconds for a 16-bit code. As this time difference is negligible for most scenarios, BPSK modulation is likely to be preferable in many embodiments of the invention.

Figure 15:
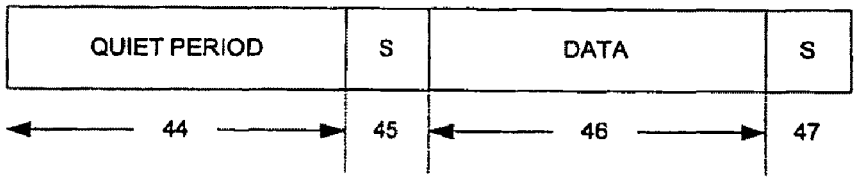
FIG. 15 is a schematic illustration of a frame of data used in embodiments of the present invention.

As is the case in many data transmission systems, data transmitted from lighting elements to cameras in the form of visible light is arranged in frames, formatted as illustrated in FIG. 15. In order to allow synchronisation between the otherwise asynchronous lighting elements and cameras, the first part of the framed data is a quiet period 44 in which no data is transmitted. This quiet period typically has a duration equal to five pulse cycles. Following this quiet period a single bit of data 45 is transmitted by way of a start bit. This indicates that data is about to be transmitted, and can take the form of either a '0' pulse or a '1' pulse. Having transmitted the start bit 45, the data to be communicated is then transmitted. As described above, this typically comprises 16-bits of data 46 being a 11-bit value after expanded Hamming encoding. Having transmitted the data 46, a stop bit is transmitted to indicate that transmission is complete.

It should be noted that where the invention is implemented using NRZ modulation, the data 46 may need to be further encoded to ensure that the data 46 does not include sufficient '0's to define a quiet period. Suitable encoding schemes to achieve this are Manchester encoding or 4B5B encoding. Given the pulses used in BPSK modulation, such encoding need not be used when BPSK modulation is employed.

Figure 16:
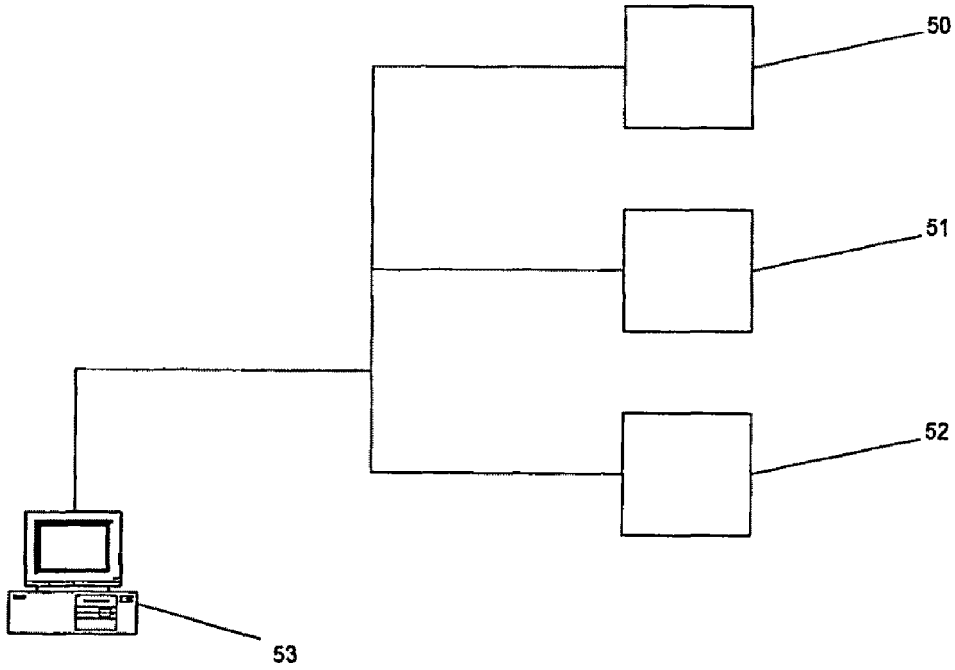
FIG. 16 is a schematic illustration of a plurality of cameras used in embodiments of the present invention to locate lighting elements.

Having described how identification codes for lighting elements are generated, and how these identification codes are communicated between lighting elements and cameras, processing carrying out to identify lighting elements from images generated by cameras is now described. An apparatus suitable for carrying out this processing is illustrated schematically in FIG. 16, where three cameras 50, 51, 52 are connected to a PC 53. The cameras 50, 51, 52 are preferably connected to the PC 53 by wireless means, aiding mobility of the cameras. The cameras are configured to pass captured image data to the PC 53, which can have a configuration substantially as illustrated in FIG. 6 and described above.

Figure 17:
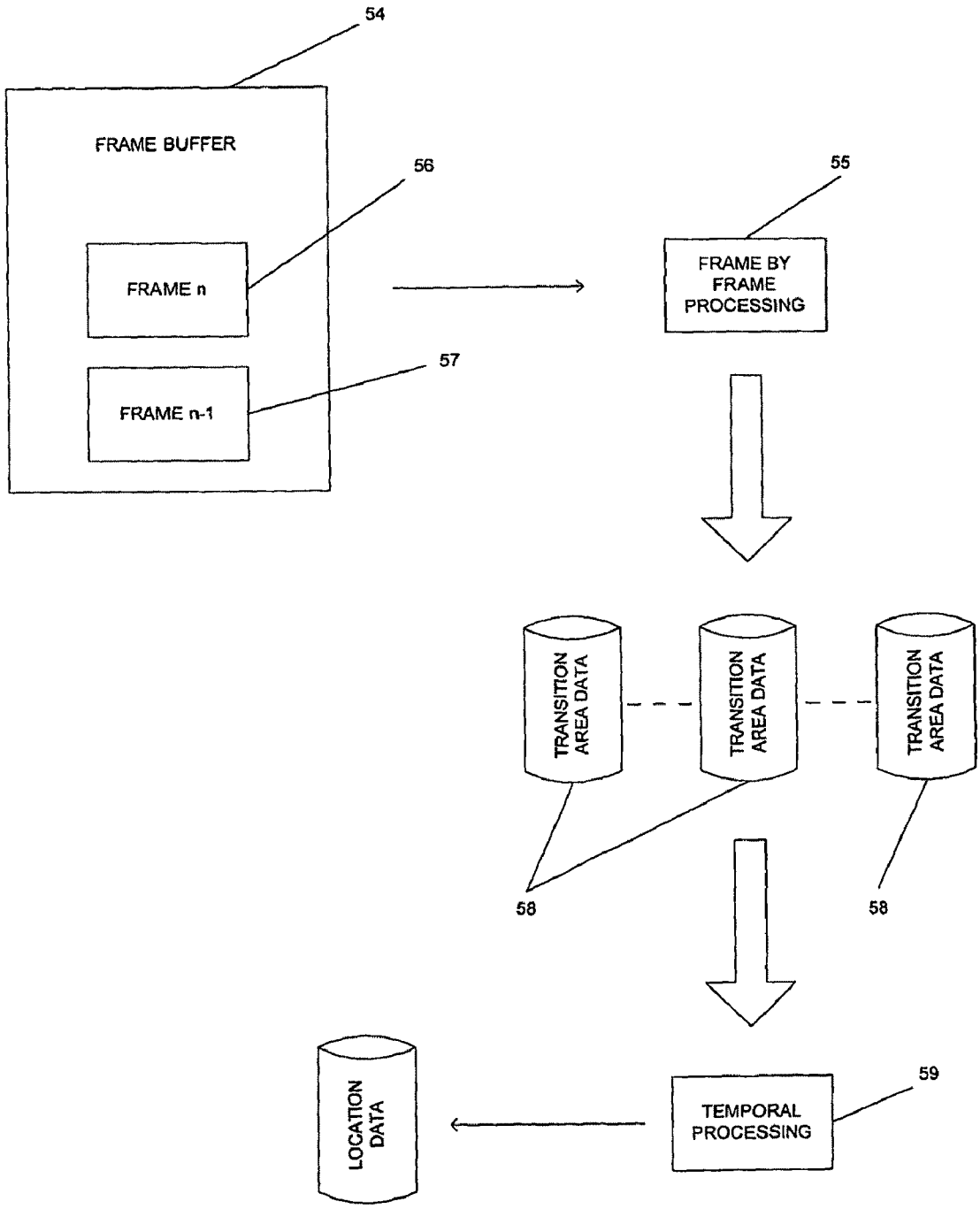
FIG. 17 is an overview of a light element location process, configured to operate on data obtained from the camera illustrated in FIG. 11.
Figure 18:
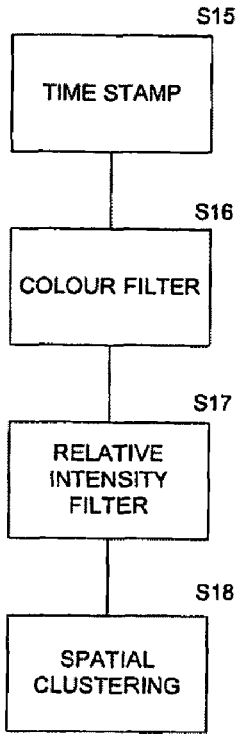
FIG. 18 is a flow chart showing frame-by-frame processing of FIG. 17 in further detail.
Figure 19:
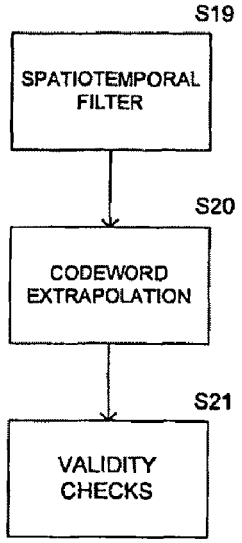
FIG. 19 is a flow chart showing temporal processing of FIG. 17 in further detail.

Processing carried out by the PC 53 on received image data is now described with reference to FIGS. 17 to 19. This processing is described with reference to the camera 50, although it will be appreciated that similar processing is required independently for the cameras 51, 52. FIG. 17 provides a schematic overview of the processing. The PC 53 includes a frame buffer 54 within which received frames of image data are stored, and processed on a frame by frame basis. This frame by frame processing is denoted by reference numeral 55 in FIG. 17. It can be seen that the frame buffer includes both the most recently received frame 56 and the immediately preceding frame 57, both of which are used by the frame by frame processing 55 as is now described with reference to FIG. 18.

At step S15 the received image data is timestamped. This process is important because many cameras will not capture frames at precisely regular intervals. An assumption that frames are captured at isochronous intervals of 1/25 second may therefore be incorrect, and the applied time stamps are used as a more accurate mechanism of determining time intervals between frames.

Having timestamped the received image, the image is filtered in colourspace using a narrow bandpass filter at step S16, to eliminate all but the colours which match the lighting elements being located. Typically this may involve filtering the image so as to exclude everything but pure white light.

At step S17, the latest received image is differentially filtered, with reference to the previously received image. This filtering compares the intensity of each pixel (after the filtering of step S16) with the intensity of the corresponding pixel of the previously processed frame. If this difference in intensity is greater than a predetermined threshold, this is an indication of a likely transition at that pixel. The processing of step S17 therefore generates a list of potential light transitions for the currently processed frame.

The assumption made above that each lighting element maps to a single image pixel is likely to be over simplistic, therefore at step S18, pixels within a predetermined distance of one another are clustered together. This distance is typically only a few pixels. After this clustering, a set of transition areas (each likely to correspond to a single lighting element) is generated. This set of transition areas is the output of the frame by frame processing 55. This processing is carried out for a plurality of frames to generate transition area data 58 for each processed frame.

The transition area data 58 is input to a temporal processing method 59. The temporal processing is shown in the flow chart of FIG. 19. For each transition area recorded in the first processed set of transition area data 58, spatiotemporal filtering (step S19) is carried out to match transition areas of the processed transition area data 58 with transition areas detected in other sets of the transition area data 58. This filtering operates by locating translation areas within other sets of transition area data which are within a spatiotemporal tolerance of the processed transition area. A motion compensation algorithm can also be applied at this stage. Transitions are then temporally grouped to form a code word at step S20.

At step S21, the generated code word is verified. This verification typically involves checking for matching start and stop bits, a valid quiet period and a valid expanded Hamming code. Once validated, the identity of the lighting element is known. The location of the lighting element on the image can easily be computed by determining the centre of corresponding transition area in the processed images.

It should be noted that the processing described with reference to FIGS. 17 to 19 requires little storage of video data—only a single previous frame is required, as information is transformed into, and recorded in, the temporal domain during processing, in the form of transition area data 58.

The description set out above explains how a single camera can be used to locate a lighting element and determine its identification code. In some circumstances, a single camera is sufficient to locate a lighting element in three dimensional space. For example, in situations where all lighting elements are known to lie within a 2D plane or surface. However, in other circumstances, information obtained using a single camera is alone insufficient to locate a lighting element within three dimensional space. Further processing is therefore required, and this further processing operates using data obtained from a plurality of cameras. For example, referring to FIG. 20, the two cameras 50 and 51, both detect a lighting element X in images produced by the cameras. This lighting element is detected at one or more pixels of the generated images, and is known to be a common element by virtue of its identification code (described above). By using triangulation algorithms, and knowing the orientation of the camera, processing is carried out to construct imaginary lines which extend from the cameras. This processing is now described.

Figure 20:
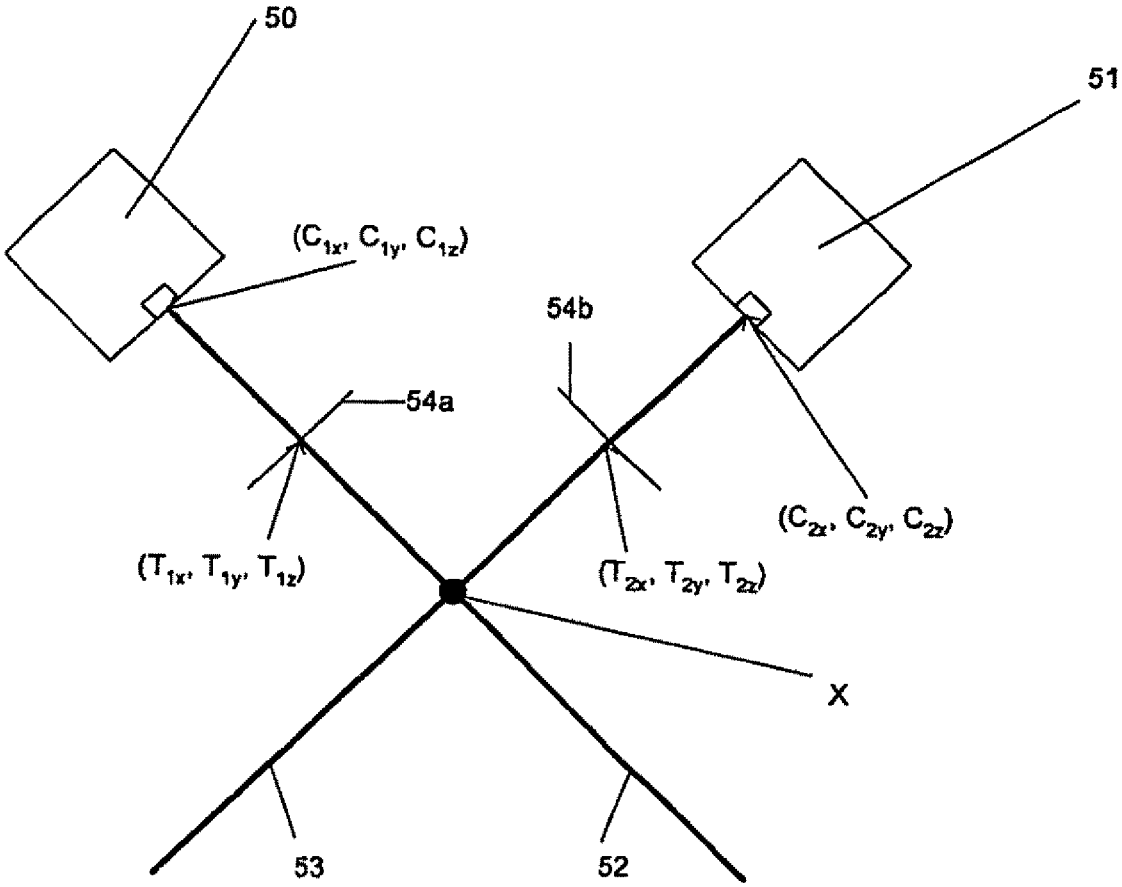

Referring to FIG. 20, it can be seen that a lens of a first camera 50 is located at a position having coordinates ($C_{1x}$, $C_{1y}$, $C_{1z}$). Similarly, a lens of a second camera 51 is located at a position having coordinates ($C_{2x}$, $C_{2y}$, $C_{2z}$). FIG. 20 further shows a line 52 extending from the lens of the camera 50 through the position of the lighting element X. A line 53 extends from the lens of the second camera 51 again through the lighting element X. The triangulation algorithm is configured to detect the point of intersection of the lines 52, 53, which indicates the location of the lighting element X. This algorithm is now described. The algorithm makes reference to imaginary planes 54*a*, 54*b* are respectively located 1 meter away from the lens of the first camera 50, and the lens of the second camera 51. These planes are arranged so as to be orthogonal to the direction in which the camera is pointing. The line 52 which extends from the first camera 50 to the lighting element X will pass through the plane 54*a* and the point within the plain 54*a* through which the line 52 passes has coordinates ($T_{1x}$, $T_{1y}$, $T_{1z}$). Similarly, the point in the plain 54*b* through which the line 53 passes has coordinates ($T_{2x}$, $T_{2y}$, $T_{2z}$). The point within the plane 54*a* through which the line 52 passes therefore has coordinates relative to the first camera as origin as follows:

$$R_{1x}=T_{1x}-C_{1x};$$

$$R_{1y}=T_{1y}-C_{1y};$$

$$R_{1z}=T_{1z}-C_{1z};$$

Similarly, the point within the plane 54*b* through which the line 53 passes therefore has coordinates relative to the second camera as origin as follows:

$$R_{2x}=T_{2x}-C_{2x};$$

$$R_{2y}=T_{2y}-C_{2y};$$

$$R_{2z}=T_{2z}-C_{2z};$$

Having defined the point within the planes 54*a*, 54*b* in relative terms as set out above, the equation of the line 52 can be expressed as follows:

$$(C_{1x}+t_1R_{1x}, C_{1y}+t_1R_{1y}, C_{1z}+t_1R_{1z})$$

Where:

$t_1$ is a scalar parameter indicating distance along the line 52.

Similarly, the line 53 is defined by the equation:

$$(C_{2x}+t_2R_{2x}, C_{2y}+t_2R_{2y}, C_{2z}+t_2R_{2z})$$

Where:

$t_2$ is a scalar parameter indicating distance along the line 53.

It can be seen that $t_1$ and $t_2$ will have values of one when the equations of the lines define the points in the imaging planes through which the respective lines pass.

Assuming perfect accuracy, it should be possible to find a point at which the lines 52, 53 intersect, this being the point X. Determination of such a intersection point can be carried out by taking values of the equations of lines 52, 53 in two dimensions, and using these values to form a pair of simultaneous equations. Given that all values of C, and R are known, this pair of simultaneous equations will include two unknowns ($t_1$, $t_2$) and can therefore be solved to determine the values of ($t_1$, $t_2$) which should be inserted into either the equation of line 52 or the equation of line 53 to generate coordinates for the lighting element X.

More specifically, at the point of intersection, the equations of the lines 51, 52 are equal to each other in x, y and z co-ordinates. Thus, at the point of y intersection of the lines the following is true:

$$C_{1x}+t_1R_{1x}=C_{2x}+t_2R_{2x}$$

$$C_{1y}+t_1R_{1y}=C_{2y}+t_2R_{2y}$$

$$C_{1z}+t_1R_{1z}=C_{2z}+t_2R_{2z}$$

As there are only two unknowns ($t_1$, $t_2$), any two of the above equations can be used to determine the values of the unknowns for example, taking equations in x and y co-ordinates:

$$C_{1x}+t_1R_{1x}=C_{2x}+t_2R_{2x}$$

$$C_{1y}+t_1R_{1y}=C_{2y}+t_2R_{2y}$$

Again, as all values of C and R are known, the above equations can be solved in a well known manner to determine the values of $t_1$ and $t_2$. Having generated such values the point of intersection of the lines (i.e. the point X) can be determined.

It should be noted that in some applications there is likely to be error such that the lines do not intersect perfectly. Therefore, it is necessary to determine the point of closest distance between the two lines, or alternatively use an alternative similar estimate.

For example, in one embodiment of the invention, the equations of the lines 52, 53 defined above are translated into a coordinate system where one line is the z direction, and the orthogonal component of the other line forms the y direction. The x intersect of these lines gives a point of closest distance which can be transformed back into the original coordinates. This co-ordinate system is described in more detail below, and with reference to FIGS. 20*a*, 20*b*, 20*c* and 20*d*.

Figure 20A:
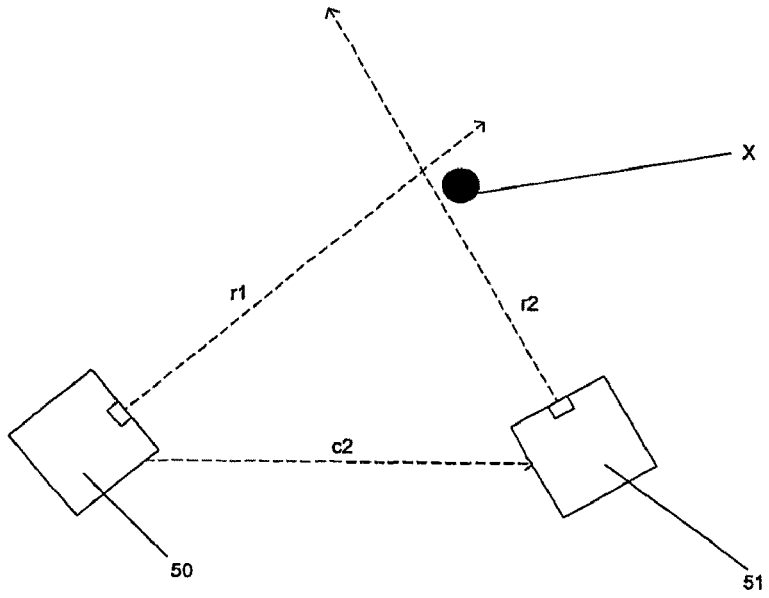
Figure 20B:
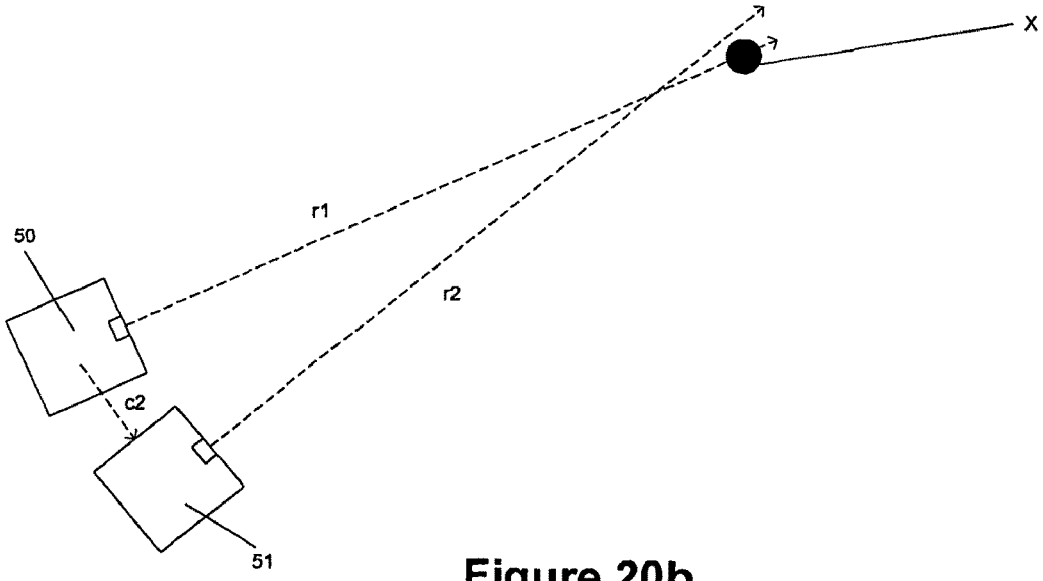

FIGS. 20*a* and 20*b* show the first camera 50 and second camera 51 in plan and side views respectively. Various vectors are shown in the figures (r1, r2 and c2). The vector c2 defines the positions of the cameras 50, 51 relative to one another. The vectors r1, r2 define lines which extend from the cameras 50, 51 in the approximate direction of the lighting element X. Note that the vectors r1 and r2 are drawn so as to slightly miss the true position of the lighting element X on the assumption that there are slight errors in sensing the position. It can be seen that there is an error in both plan and side views.

Vector r1 of the approximate line to the lighting element X relative to the first camera 50 is defined as:

$$r1=(R_{1x},R_{1y},R_{1z})$$

The vector r2 of the approximate line to the lighting element X relative to the second camera 51 is defined as:

$$r2=(R_{2x},R_{2y},R_{2z})$$

The vector from the first camera 50 (as origin) to the second camera 51 is defined as.

$$c2=(C_{2x}-C_{1x},C_{2y}-C_{1y},C_{2z}-C_{1z})$$

Three unit vectors are defined to transform the co-ordinate system. A unit vector in the direction of r1 is defined as:

$$z=r1/|r1|$$

where |r1| denotes the Euclidean norm (i.e. length) of r1

A unit vector, y, orthogonal to r1, but making a y-z plane containing r1 and r2 is defined as:

$$y=(r2-r2\cdot r1)/|(r2-r2\cdot r1)|$$

A unit vector orthogonal to y and z is defined as:

$$x=z\times y$$

where z×y denotes the vector cross product of z and y

The vectors x, y and z define a coordinate system from which it is particularly easy to calculate the point of closest distance.

It should be noted that the unit vector y is well defined so long as the vectors r1 and r2 are not parallel. However, for two cameras (e.g. the first camera 50 and second camera 51) at any distance from one another the line of sight from each camera to a single source (e.g. the lighting element X) should never be parallel. Thus if the above definition of unit vectors 'fails', one of the cameras 50, 51 has falsely detected the position of the lighting element X.

Figure 20C:
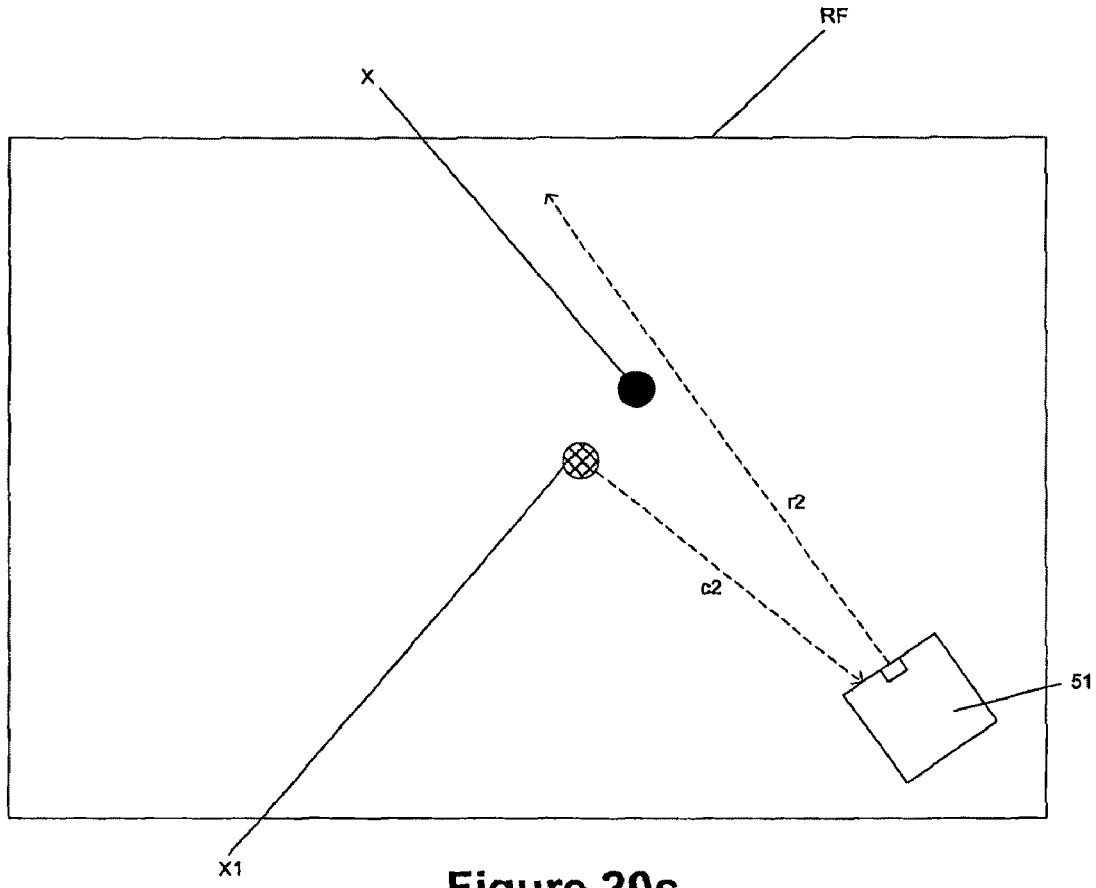
Figure 20D:
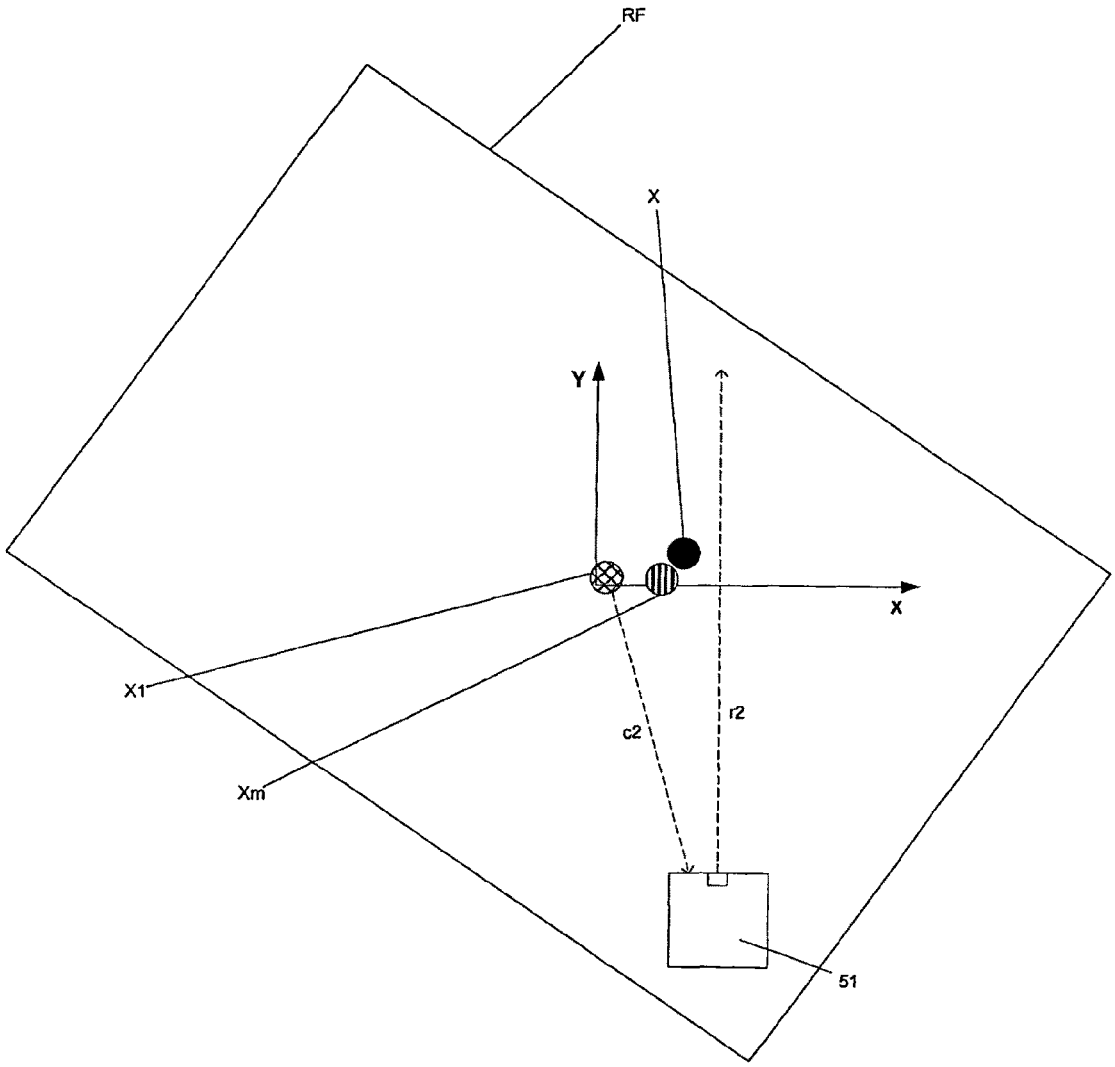

Although the coordinate system is created mathematically, it can be more easily understood by considering the movement of the first camera 50 (i.e. pan, tilt and/or roll, such that the location of the first camera 50 does not change). This is illustrated in FIGS. 20*c* and 20*d*. A reference frame RF is illustrated as an aid to the understanding of the co-ordinate system and the calculation of the point of closest distance. The reference frame corresponds with what would be seen through, for example, a viewfinder of the first camera 50.

As shown in FIG. 20*c*, the first camera 50 is moved so that its sensed position X1 (i.e. not the actual location) for the lighting element X is exactly in the centre of its view. The position X1 thereby forms the origin of the new coordinate system. The z direction for this coordinate system (i.e. going away from the first camera 50) is then in the direction of the vector r1 (as defined in the equation above).

The first camera 50 is now rotated until the second camera's 51 line of sight r2 is 'upright' relative to the first camera 50, i.e. r2 is now parallel to the y direction. This situation is depicted in FIG. 20*d*. It will be appreciated that FIG. 20*d* is a two-dimensional depiction of the co-ordinate system, and that the transformed line of sight r2 for the second camera 51 may also have a component in the z direction. As is apparent from FIG. 20*d*, the closest distance is precisely where the line of sight r2 of the second camera 51 crosses the x axis. More mathematically, the equation of the line r2 through the second camera 51 to the sensed position X1 of the lighting element X in this new coordinate system is:

$$r2=((c2\cdot x),(c2\cdot y)+t2(r2\cdot y),(c2\cdot z)+t2(r2\cdot z))$$

where t2 is a parameter varying along the line r2 as discussed above

The equation of the coordinates of the line r1 from the first camera 50 is:

$$r1=(0,0,t1(r1\cdot z))$$

For any value of t2, the value of t1 can be adjusted so that the z coordinates of the two equations defined above are equal. Hence the point of closest distance is when the y coordinate is zero:

$$(c2\cdot y)+t2(r2\cdot y)=0$$

$$t2=-(c2\cdot y)/(r2\cdot y)$$

The distance between the lines r1 and r2 at this point is:

$$(c2\cdot x).$$

The mid-point Xm between the lines r1 and r2 at closest distance can be found by substituting t2 into the z coordinate of the line r2, and is therefore:

$$((c2\cdot x)/2,0,(c2\cdot z)-((r2\cdot z)(c2\cdot y)/(r2\cdot y)))$$

This can now be translated back into the standard coordinate system.

The processing set out above has indicated how a lighting element can be uniquely located in three dimensional space. However, before carrying out the processing described above, it is necessary to ensure that cameras used to locate the lighting elements are properly calibrated. FIG. 21 is a flow chart showing steps carried out by a camera calibration process. At step S22 calibration is carried out to take individual camera properties into account. Such calibration can either be carried out at the time of the camera's manufacture, and/or immediately prior to use. Such calibration involves configuring properties such as aberration and zoom.

The calibration of step S22 must take various camera artefacts into account. For example, some camera lenses may have distortions at the edges (for example fish eye effects).

Such distortions should ideally be determined at the time at which the camera is manufactured. However, alternative approaches can be used. For example a large test card may be held in front of the camera with a known pattern of colours, and the generated image may then be processed. In alternative embodiments of the invention, this calibration is carried out by reference to lighting elements sensed by the camera, the expected images being known in advance.

Additionally, some cameras may have manually adjustable zoom factors that cannot be directly sensed. As zoom may be adjusted in the field this is likely to need correction. This can again be achieved by using a test target at a known distance, or using an arrangement of lighting elements.

Although the processing set out above allows lighting elements to be located relative to the cameras, if an absolute location in space is required, data as to camera location is required. Camera location is calibrated at step S23.

The processing of step S23 can be carried out in a number of ways. A first method involves physical measurement of camera location, and subsequent marking of camera location on a map. An alternative location calibration method involves locating cameras electronically. For example, for outdoor installations, a single camera with GPS and electronic compass could be used.

The methods set out above will determine absolute camera positions in space. This will, in turn allow the cameras to be located relative to one another and also allow lights to be located relative to the cameras, as described above. An alternative method of locating cameras relative to one another involves locating cameras by reference to a plurality of lighting elements. As the lighting elements being detected are the same, just viewed at different angles and distances, this information can be used to obtain relative locations of cameras. One such plurality of lighting elements may be the elements being located. Such a method for obtaining relative location data can also be used with reference to special light element configurations of known dimensions for example a wire cube or pyramid with lights placed at the vertices can be used. As the dimensions are known it is easier to calibrate camera angles relative to the known sources and hence each other. Cameras can also be located relative to one another by pointing cameras at one another, where each camera has a visible or invisible light source. The cameras can then be positioned relative to one another by triangulation.

The processes outlined above for locating cameras relative to one another can be augmented by the use of means such as a laser pointer included on a camera. For example, a laser pointer mounted on each camera would allow the centre of view of each camera to be focused on a single known location. If small arrays of light sources (visible or invisible to a human eye) are placed on each camera and the cameras pointed at one another (whilst maintaining their position), then their relative distances can be calculated and hence the relative locations of the cameras be determined.

The location methods described above suffer from various disadvantages, and some of the methods described do not provide unambiguous data in all situations. For example, if cameras are to be located relative to lighting elements (either in known or unknown configurations) as described above, if a particular configuration of camera and light locations is scaled linearly then the images at each camera stay the same. This means that at least one measurement needs to be known or measured by other means. Although such methods may not provide an ambiguous data, this may not matter in practice. For example, in some embodiments of the invention, only the relative dimensions may matter.

A similar issue arises when two cameras are calibrated against one another, even when the locations of the cameras are known, there are multiple configurations of lights and camera orientations that can lead to the same appearance at each camera. Hence at least three camera locations (not necessarily three cameras, one camera can be placed sequentially at three different locations) should in general be used for precise location. Again whether this matters in practice depends on the embodiment of the invention in which the method is employed.

Referring back to FIG. 21, the final stage in camera calibration is fine correction, which is carried out at step S24. This fine correction is typically concerned with ensuring that the cameras are correctly aligned with one another, and may use a holistic algorithm. For example, differences in positions of lighting elements as sensed by different cameras may be minimised using a technique such as simulated annealing, hill climbing, or a genetic algorithm. However, simpler heuristics can also be used to perform multi-step corrections (effectively a form of hill climbing). Such a method is described below.

The described method for fine correction is based upon estimated locations of light elements projected onto a camera's plane, compared with the measured locations of those lighting elements. By measuring certain systematic deviations it is possible to correct certain aspects of the camera's assumed location and orientation.

FIGS. 22A to 22D illustrate four different types of deviation. In each image five lighting elements are detected. The images show the expected position of each lighting element as a solid circle, with the actual position of each lighting element being shown as a hollow circle.

Figure 22A:
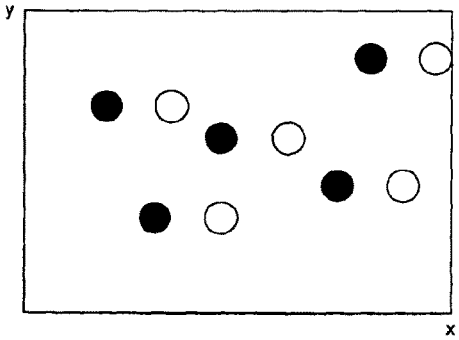

FIG. 22A illustrates a deviation caused by systematic error in the horizontal, or X direction. It can be seen that each solid circle is positioned to the left of each hollow circle, but is in perfect alignment in the vertical or Y direction. This error is caused either by a rotation of the camera's left-right orientation (yaw) or translation in the X plane. The difference between the two can be checked by whether the effect is uniform for all lights or is correlated to the distance to the light.

Figure 22B:
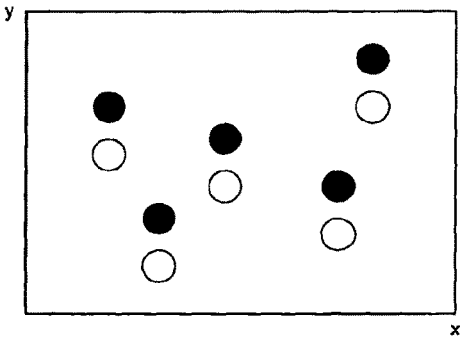

FIG. 22B illustrates a deviation caused by systematic error in the Y direction. It can be seen that each solid circle is positioned directly above each hollow circle. This error is caused either by errors in a camera's up-down orientation (pitch) or the height of the camera's location.

Figure 22C:
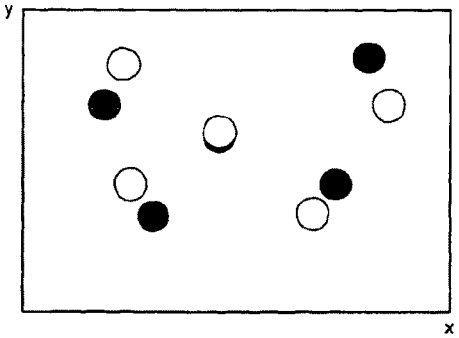
Figure 22D:
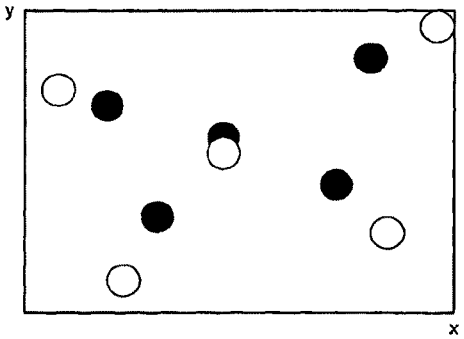

FIG. 22C illustrates a deviation with is proportional in the X direction and the Y direction. Such an error is caused by the configuration of a camera's assumed plane (roll). FIG. 22D illustrates deviation caused by a camera's zoom factor.

Having processed the image of FIGS. 22A to 22D, determined the necessary correction, and carried out this correction (step S24), the camera is correctly configured.

The processing described above can then be used to detect lighting elements and position the lighting elements in space. It will be appreciated that various of the processes described above can be modified in a number of ways. Some such modifications are now described.

It may be desirable to allow lighting elements to transmit identification codes in a manner which is invisible to, or at least not immediately apparent to human observers. For example, it may be desirable to allow identification codes to be transmitted while images are being displayed using the lighting elements. In such cases, the identification codes should be transmitted in such a way as not to disrupt the image visible to the human observer. One technique which allows this to be achieved involves transmitting identification codes by modulating the intensity of lighting elements. For example, if lighting elements have a range of intensities from zero to one, the display of images may be caused by using intensities between 0 and 0.75. When identification codes are transmitted, light may be transmitted at full intensity (i.e. 1). Therefore only a small difference is used to distinguish between light emitted to display images and light emitted to communicate identification codes. Such a small difference is unlikely to be perceptible to a human observer, but can be relatively easily detected by a camera used to locate lighting elements, by simply modifying the image processing methods described above.

When coloured lighting elements are used in embodiments of the invention, it is possible to take advantage of manipulations in colour space, to which the human eye is typically less sensitive. For example, the human eye is typically less sensitive to changes in hue (spectral colour) than it is to differences in brightness). This phenomenon is used in various image encodings such as the JPEG image format where less bits of an image signal are used to encode hue. Small variations in hue that maintain same brightness and saturation are very unlikely to be noticed by the human eye as compared with similar fluctuations in brightness or saturation. Thus, by communicating identification codes using hue variation, identification codes can be effectively transmitted while not disrupting a image perceptible to a human observer.

The preceding description has been concerned with location of lighting elements on the basis of identification codes communicated by the lighting elements transmitting visible light through the atmosphere. In alternative embodiments of the present invention, identification codes are instead transmitted using invisible light. For example, in addition to the visible light source indicated above, each lighting element can additionally comprise an infra-red light source, which transmits a lighting element identification code in the manner described above. The use of infra red light is convenient given that digital cameras using charge coupled devices (CCDs) to generate images, detect such light well, indicating detected infra red light as pure white areas in captured images.

The transmission of identification codes using infra-red light in this way (or transmission using controlled intensity as described above) means that identification codes are transmitted in a manner invisible or barely perceptible to the human eye. This means that identification codes can be transmitted without interrupting any image displayed using the lighting elements. In a similar way, other forms of electromagnetic radiation can be used, for example, identification codes can be transmitted using ultra-violet light sources.

Using such non-visible light sources (or transmission using controlled intensity as described above) means that lighting elements can transmit their identification codes regularly, or even continuously, without such transmission being disruptive to human observers. Such continuous or regular transmission of identification codes has various advantages. For example, in some embodiments of the present invention, the lighting elements are not arranged in fixed manner, rather they move while an image is being displayed. It is therefore desirable to track lighting elements as their location varies, by applying an appropriate tracking algorithm.

An example of such tracking, using images produced by cameras, of the type described above, is now provided. After a transition area has been identified as a lighting element using the above process, any subsequent transitions within a predetermined spatiotemporal tolerance of that location have a high probability of being transmitted from the same source. However, if the identification code is continuously or regularly transmitted, given that the identification code of the expected lighting element is known, the identity of the lighting element responsible for the detected transition can be validated on a frame by frame basis to ensure this assumption is correct.

This additional information provides more up to date extrapolated location information about the position of a lighting element. This allows identities of lighting elements to be validated more quickly than waiting for an entire identification code to be received. This allows embodiments of the invention to react to movement of lighting elements more quickly.

In embodiments of the invention in which the identification code is not transmitted regularly or continuously, the light emitted by the lighting element in operation, allows some tracking to be carried out. More specifically, given that the lighting element's approximate location is known (from processing as described above), by observing the output of the frequency bandpass filter described above, some tracking functionality is provided. This is particularly useful for embodiments of the invention in which lighting elements are not highly mobile, but in which lighting elements move slightly over time.

The use of the BPSK modulation scheme benefits tracking algorithms. This is because BPSK modulation generates a higher rate of transitions, thus providing more up to date location information when tracking.

In some circumstances, it is useful to disregard the error correcting capability of the Hamming codes used to transmit identification codes as described above. For example, the first time an identification code is detected, processing will typically ensure that the received codeword has no errors, and perform necessary processing until an error free identification code is received. This reduces the probability of false positives. Having determined an identification code, embodiments of the invention may then accept one or more bit errors as probable proof of location.

In some embodiments of the invention, location of lighting elements may be carried out using a single camera, which is moved into a plurality of different positions, the images generated at the different positions being collectively used to carry out location determination. Indeed, much of the processing described above may be carried out as either an offline or online process. That is, the processing may be carried out as an online process while cameras are directed at the lighting elements, or alternatively as an offline process using previously recorded data. Indeed, data can be collected either by sequential observations from a single camera or by simultaneous observations from multiple cameras. It should however be noted that, in general terms, when lighting elements are moving at least two cameras are normally required for accurate positioning.

The preceding description has considered a lighting element having an optical effect substantially co-incident with itself and its associated controller. It is to be noted that an optical effect created by a lighting element may not be coincident either with a lighting element itself or its associated controller. For example, an LED may omit light through one or more fibre optic channels such that the optical effect of illumination of the LED occurs at a point distant from the point at which the LED it located. Similarly, a lighting element's emitted light may be reflected from a reflective surface providing the optical effect of the lighting element being located at a different spatial point to that at which the lighting element is located. Assuming that there is a one to one relationship between the lighting elements and points at which lighting elements have an effect it will be appreciated that the techniques described above can be applied to appropriately locate the lighting element.

However, some lighting elements are such that their optical effect occurs over a relatively large area such that they cannot be considered to be point light sources. Indeed, relatively diffuse light sources may be used making their location relatively complex. Indeed, in some cases prior knowledge of light source location is useful or even necessary to reduce computational requirements and reduce ambiguity.

In some cases, diffuse light from a single source may be assumed to lie approximately on a plane. Such a case exists where a spotlight illuminates part of a wall. Here, the centroid of the light source can be calculated by each camera and this can then be subject to the algorithm set out above. The spread of light about the centroid can be used to determine the angle of the plane. Multiple light sources effectively build up a 3D model of the surface being illuminated and this can be fed back to refine points associated with particular light sources that illuminate corners of multiple objects.

In some cases determination of the 3D extent of diffuse light sources can be avoided. If light is falling on a known surface, then a single camera can determine the two dimensional extent of the light source. Even when this is not the case, it may be that only a view from a single view point is of importance, in which case the two dimensional extent of the effect of the source can be taken as the important location information.

Where diffuse light sources are used, the generation of images also has additional complexity. Because the light sources are not points, simply turning on those lights whose effect is entirely within regions which it is desired to illuminate may lead to no source being turned on given that all light sources may have an effect outside the region which it is desired to illuminate. Some form of closest match is required to determinate which lighting elements should be illuminated.

A least squares approximation (which is common in statistics) can be used to determine which lighting elements should be illuminated. The three dimensional or two dimensional space of interest is divided into a number of voxels or pixels ($N_p$). Each voxel or pixel is labelled $P_k$ where k=1 . . . $N_p$. A number of light sources (N) is provided. Each light source is labelled $l_i$, for i=1 . . . N.

For each light source $l_i$ and each voxel/pixel $p_k$ a level of illumination at that voxel/pixel caused by lighting element $l_i$ is determined. This level is denoted $M_{Ki}$. This value is based upon full illumination of the light source $l_i$. If each light source is illuminated to a level $il_i$ (assuming illumination is measured on a standardised scale between 0 and 1) illumination at a particular voxel/pixel $IP_k$ is given by:

$$IP_K = \sum_{i=1}^{N_l} M_{Ki} IL_i$$

Given a desired illumination pattern over the voxel/pixel given by $DP_j$, illumination levels for each light source are determined such that the sum of square error is minimised. The sum of squares error is given by:

$$\text{sum of squares error} = \sum_{K=1}^{N_p} (DP_K - IP_K)^2$$

The above equation can be solved using a standard method. The solution is:

$$IL = QM^T DP$$

Where Q is the inverse of the symmetric positive definite matrix $M^T M$, DP is the vector of desired illumination levels, and IL is a vector of determined illumination levels for the light sources. Solution of the sum of squares error can be carried out using multi-linear regression. This is described in Freund J., & Walpole R.: "Mathematical Statistics", Longman, 1986, ISBN-10: 0135620759, pp 480 et seq.

It is to be noted that the method described above may provide impossibly high values of illumination for particular light sources, and may provide negative values of illumination for other light sources. In such a case a thresholding procedure is used to appropriately set illumination levels.

In some cases, multiple light sources may not be independently controllable. For example, it may be the case that the control of light sources is such that light sources cannot be switched on and off independently. Alternatively, each light source may have an associated reflection. In such a case, each camera may detect several two dimensional points for a single address. Given two cameras each potential pair of points for a single light source detected in first and second cameras can be triangulated and error value can be calculated as at step S103 of FIG. 23A. The detected two dimensional point for different source locations will usually give higher error values so these can be discarded. Occasionally, strange coincidences of locations may give rise to false positive locations, but where this is deemed to be a potential problem a large number of cameras may be used to overcome this problem.

The embodiments of the invention described above, are such that each lighting element has an address. Each lighting element also transmits an identification code which is transmitted by the lighting element and used in the location process. This identification code can either be that lighting element's address, or alternatively can be different. When the identification code and address are different, they may be linked, for example, by means of a look up table. However, in some embodiments of the present invention, lighting elements do not transmit identification codes under their own control. Instead, a central controller controls the location process, on the basis of lighting element addresses. Such a process is now described with reference to FIG. 23.

Referring to FIG. 23, at step S25 all lighting elements are instructed to emit light, so that the cameras used in the detection process have a full picture of all light sources. All lighting elements are turned off at step S26. At step S27 counter variable i is initialized to 1. During the course of processing this counter variable is incremented from 1 to N, where N is the number of bits in the address of each lighting element. At step S28, all lighting elements having an address in which bit i is set to '1' are illuminated. The resulting image is recorded at step S29. Step S30 determines whether there are further bits to be processed, if i is equal to N such the processing has been carried out for all bits, processing moves to step S31 (described below). Otherwise, i is incremented at step S32, and processing returns to step S28.

At step S31, the series of N images is processed. These images will be of the form illustrated in FIG. 11A, and can be processed to determine address of the various lighting elements using methods described above.

In alternative embodiments of the invention, lighting elements may transmit codes under their own control, but may be prompted to do so by a central controller.

The methods described above for location of lighting elements from generated images uses conventional triangulation algorithms. Such algorithms can suffer from a number of problems. For example, some lighting elements may be occluded from the view of some cameras. If only two cameras are used in the triangulation process, this will mean that some lighting elements cannot be properly located. However, where a greater number of cameras is used, this problem can be overcome by simply triangulating on the basis of the images generated by cameras which do have visibility of the lighting element.

A further problem with triangulation of the type described above arises because of noise, camera accuracy and numeric errors. This is likely to mean that imaginary lines projected from the cameras will not cross exactly. Some form of "closest point" approach is therefore required, to determine an approximation of location based upon the generated imaginary lines. For example, a three-dimensional location may be selected such that the sum of squares of the difference between the projection of estimated location on all cameras, and the respective measured location are minimised.

For example, one algorithm based upon a "closest point" approach operates as follows. Taking a single lighting element, for each camera that has registered that lighting element imaginary lines are projected from the camera to the point of detection of the lighting element. For each pair of cameras that have registered the selected lighting element, the point of closest approach between the projected light is calculated, and a midpoint between these lines is taken as an estimate of the true position of the lighting element. This yields an estimated location for the lighting element for each pair of cameras. It also indicates a distance between the lines at closest approach, which provides a useful measure of error. If any of the estimated points has an error measure substantially greater than the others, these points are ignored. Each such point will have been generated by a particular pair of cameras and will typically correspond to a false positive on one of the cameras from previous stages of processing. The remaining camera pair estimates are averaged to give an overall estimated location for that lighting element. This algorithm is then repeated for each lighting element detected. A suitable process is shown in FIG. 23A.

Referring to FIG. 23A, at step S100, an empty results_set array is initialized. This array is to store a pair at each of its elements, each pair comprising an estimate of a signal source location together with an error measure. At step S101, a counter variable c is initialized to zero. At step S102 a location estimate for a camera pair denoted by the counter variable c is calculated, while at step S103 an error measure for that camera pair is also calculated. At step S104 a pair comprising the calculated location estimate generated at step S102, and the calculated error measure computed at step S103 is added to the result_set array. The counter variable c is incremented at step S105, and at step S106 a check is carried out to determine whether there are further camera pairs to be processed. If there are further camera pairs to be processed, processing returns to step S102. Otherwise processing continues at step S107. At step S107 a mean error measure value is computed across all elements of the results_set array.

Having computed the mean at step S107, a further counter variable p is initialized to zero at step S108. This counter variable is, in turn, to count through all elements of the results_set array. At step S109 the average error value computed at step S107 is subtracted from the error value associated with element p of the results_set array. A check is then carried out to determine whether the result of this subtraction is greater than a predetermined limit. If this is the case, it indicates that element p of the results_set array represents an outlying value. Such an outlying value is then removed at step S10 and the average error across all elements of the array is then recomputed at step S111. If the check at step S109 is not satisfied, processing passes directly to step S112 where the counter variable p is incremented and processing then passes to step S113 where a check is carried out to determine whether further elements of p require processing. If this is the case, processing returns to step S109. Otherwise processing continues at step S14.

At step S114 the average location estimate across all elements of the results_set array is computed. Step S115 then resets the counter variable p is reset to a value of zero and each element of the results_set array is then processed in turn. At step S116 a corresponding element of a distance array is set to be equal to the difference between the location estimate associated with element p of the results_set array and the average estimate. The counter variable p is incremented at step S117 and a check is carried out at S118 to determine whether further elements of the array need processing. If this is the case, processing returns to step S116 otherwise processing passes to step S119 where the average distance of all points from the average estimate computed at step S114 is determined.

Processing then passes to step S120 where a counter variable P is again set to zero. At step S121 a check is carried out to determine whether the difference between the average distance and the distance associated with element P of the distance array is greater than a limit. If this is the case, element P of the distance array is deleted and element P of the results set array is also deleted at step S122, and the average distance is then recalculated at step S123 before the counter variable is P is incremented at step S124. If the check of step S121 is not satisfied processing passes directly from step S121 to step S124. At step S124 a check is carried out to determine whether further elements of the distance array require processing, and if this is the case processing returns to step S121 otherwise, processing passes from step S125 to step S126 where remaining elements of the location array are used to calculate an average estimate for location.

It will be appreciated that the process described with reference to FIG. 23A is merely exemplary, and various similar processes could be used. For example, in some embodiment of the invention further outlier removal maybe carried out at various stages in the process.

If two or more lighting elements are aligned from the point of view of a particular camera, then the camera will effectively generate an image which is the logical OR of the two lighting elements transmitted codes. If the codes are sufficiently sparse, false detections can typically be identified. However, if a camera determines a valid code which is in fact caused by two aligned lighting elements, the triangulation process can detect the error, assuming that at least one camera is such that the lighting elements are not aligned from its point of view such that the generated imaginary lines will not cross.

An alternative triangulation scheme which seeks to solve the problem of aligned lighting elements is now described, with reference to FIG. 24. The method of FIG. 24 operates on images generated by the cameras in the manner described above, operating on pairs of images captured at the same time, but from different cameras, in turn. At step S33 a variable f is initialized to 1, and this variable acts as a frame counter, counting through each captured frame in turn. At step S34, imaginary lines are projected from each pixel of a first camera at which a lighting element was detected. Similar imaginary lines are projected at step S35, but this time from a second camera. The projected lines from the first camera and second camera will intersect, and any intersection of lines considered to be detected lighting elements. This constitutes a logical AND operation, and is carried out at step S36. If the AND operation is successful a lighting element is recorded at step S37, alternatively if the AND operation is unsuccessful no lighting element is recorded at step S38. Processing then passes to step S39 where a check is made to determine whether or not all frames have been processed. If not all frames have been processed, the frame counter f is incremented at step S41, and processing returns to step S34. If all frames have been processed, processing ends at step S40.

The processing described above to locate lighting elements is carried out under the control of the PC 1. FIG. 24A shows processing carried out by the PC 1. At step S200 a camera is connected to the PC 1. At step S201 a command is issued to the lighting elements to be located causing them to emit light representing their identification codes in the manner described above. This is achieved by providing appropriate commands to the control elements 6, 7, 8 (FIG. 5) which in turn causes commands to be provided to lighting elements along the busses 9, 10, 11 in the form of CALIBRATE commands described with reference to FIGS. 9B and 9C.

At step S202 data is received from the connected camera, and a check is carried out at step S203 to determine whether an acceptable number of lighting elements have been identified. At step S204 a check is made to determine whether the currently processed image is the first image to be processed. If this is the case, at step S205, the position of the camera is used as an origin, and data indicating that the camera is located at the origin and further indicating the position of the lighting elements relative to that origin is stored at step S206. If the check of step S204 determines that this is not the first image to be processed, processing passes to step S207 where the currently processed camera's position is determined, for example by use of the techniques described above for camera location. Processing then passes from step S207 to step S206 where data indicating camera and lighting elements positions is stored.

Processing passes from step S206 to step S208 where a check is carried out to determine whether further images (i.e. camera positions) remain to be processed. If this is the case, processing returns to step S200. Otherwise, processing ends at step S209.

FIG. 24B is a flow chart showing processing carried out by the PC 1 to locate lighting elements from data stored by the processing of FIG. 24B. At step S215 a check is carried out to determine whether further lighting elements remain to be located. If no such further lighting elements exist, processing ends at step S216. If such lighting elements do exist, a lighting element is selected for location at step S217, and images including the lighting element to be located are identified at step S218. Images with anomalous readings are discarded at step S219. At step S220 a check is carried out to determine whether more than one image includes the lighting element to be located. If this is not the case, processing returns to step S215 as the lighting element cannot be properly located. If however more than one image including the light to be located is found, a pair of images is selected for processing at step S221, and triangulation as described above is carried out at step S222. At step S223 location data derived from the triangulation operation is stored.

At step S224 a check is carried out to determine whether further images including the lighting element of interest exist, if such images do exist, processing returns to step S221, where further location data is derived. When no further images remain to be processed, processing continues at step S225, where statistical analysis to remove anomalous location data is carried out. The obtained location data is aggregated at step S226, before finalised location data is stored at step S227.

FIG. 24C is a screenshot from a graphical user interface provided by an application running on the PC 1 to allow the calibration processing described with reference to FIGS. 24A and 24B to be carried out. It can be seen that the interface provides a calibrate button 150 which is usable to cause lighting elements to emit their identification code to allow identification operations to be carried out. An area 151 is provided to allow camera positions and parameters to be configured.

Location data obtained using the processing that has been described can be stored in an XML file. The XML file includes a plurality of <light id> tags. Each tag has the form:

<light id="65823" x="0.0005" y="0.6811" z="6.565"/> where the number following "light id=" is a lighting element identifier, and numbers following each of x, y, and z are co-ordinates. It should be noted that in preferred embodiments of the invention co-ordinates are stored at a greater accuracy than that shown above.

Referring back to FIG. 2, it can be seen that location information determined using the methods described above can be used to display images using the lighting elements. The process of displaying images can take a variety of different forms, depending upon the nature and location of the lighting elements, although it should in general be noted that when an image to be displayed has been mapped to a representation of space (as shown in FIG. 4) and lighting element locations within that representation are known, arranging image display is relatively straightforward. It should be noted that in some embodiments of the present invention, each voxel of the representation of space is allocated an address. As described above, each lighting element also has an address, and lighting elements are then positioned in space by means of relationships between lighting element addresses, and voxel addresses. Addressing schemes are discussed in further detail below.

The lighting elements can be arranged in a wide variety of different configurations and locations. For example in some embodiments of the invention the lighting elements may be arranged on a tree or similar structure in the manner of conventional "fairy lights" which are commonly used to decorate Christmas trees and objects in public places as mentioned above. Alternative embodiments of the invention use more mobile lighting devices which are not necessarily connected together by wired means. For example, at events at which large numbers of people are present many people have light emitting devices in the form of "light sticks" or lights affixed to items of clothing such as hats. Indeed, any device emitting light can be used. For example mobile telephones with backlit LCD screens can be used as lighting elements. Such events include stadium based events such as football matches, and opening ceremonies of major sporting events such as the Olympic Games. Although it is well known that members of the public present at such events have such lighting devices they currently operate independently of one another. In embodiments of the present invention these lighting devices are used to display images, and this is now described.

Lighting devices each have a unique address, and are located using methods described above. In preferred embodiments, all lighting devices continuously transmit their identification code to enable location. This can be achieved, for example, by providing lighting devices with infra red or ultra violet light sources of the type described above. It should be noted that in stadium based applications, holders of the lighting devices are likely to be located within a side of a stadium, that is, they will be located within a single plane. Because of this, it is likely that a single camera may be sufficient to locate lighting devices. That is, the triangulation methods described above may not be required. Large stadiums may however require a plurality of cameras for use in the location process, each capturing a different part of the stadium.

Having located the lighting devices, such that their locations and addresses are known, individual lighting devices, or more probably groups of lighting devices are instructed to emit light. These instructions can be delivered using any wireless data transmission protocol which provides sufficient addressing capability. In preferred embodiments of the invention the lighting devices are capable of emitting a plurality of different colours of light, and in such embodiments the instructions will additionally comprise colour data. Holders of lighting devices will be aware of their own lighting device being turned on or off, or emitting a different colour. They will also be aware of the operation lighting devices of those in their vicinity undergoing similar changes. However, although holders of the lighting devices will be aware only of localized changes, those, for example, located at the opposite side of the stadium will be able to view a large stadium-sized image which is collectively displayed by the lighting devices. For example, a pattern may be displayed, a football club logo, a national flag, or even text such as words of a song.

A process for controlling lighting elements to display a predetermined image is now described with reference to FIG. 24D. At step S230 a model representing that which is to be displayed is created. This model is created using conventional graphical techniques using two-dimensional and/or three-dimensional graphical primitives. The model is updated at step S231. When the model is complete an application model 155 is stored.

At step S233 data indicating locations of lighting elements is read. At step S234 lighting elements located within the area represented by the model 155 are determined. At step S235 a check is carried out to determine whether a simulation of the lighting elements is to be provided. Such a simulation is described in further detail below. Where a simulation is provided, a visualisation of the model in the simulator is provided at step S236, before appropriate lighting elements are illuminated at step S237. If no simulation is required, processing passes directly from step S235 to step S237.

FIG. 24E is a screenshot taken from a graphical user interface allowing the control of lighting elements in the manner described above. It can be seen that an open button 160 is provided to allow a model data file to be opened. Additionally, an area 161 allows various standard effects to be displayed using the lighting elements.

FIG. 24F is a screenshot taken from a simulator as provided by the invention and as mentioned above. It can be seen that all lighting elements are shown, with those which are illuminated being shown more brightly. It can be seen that the lighting elements are controlled to display an image of a fish.

The application provided to control the lighting elements also allows interactive control. Specifically, FIG. 24G allows data defining an arrangement of lighting elements to be loaded. This is loaded and displayed in the simulator as shown in FIG. 24H It can be seen the lighting elements are arranged on a Christmas tree. An interface shown in FIG. 24I allows a brush to be selected by a user. This brush can then be used to "draw" in the window of FIG. 24H allowing appropriate lighting elements to be selected for illumination.

As indicated above, lighting devices may be mobile as their holders move. However, typically movement is likely to be slow and relatively infrequent. Recalibration of lighting device location will however be required from time to time. Such recalibration can be carried out either using invisible light sources (for example infra red or ultra violet) as described above, or alternatively by varying light intensity, as is also described above.

It should be noted that embodiments of the invention based upon movable lighting devices are such that lighting device complexity can be minimised because the lighting devices need only receive (not transmit) data. The only transmission carried out using light, either visible or invisible.

Referring to FIG. 5, it has been described that instructions to illuminate various of the lighting elements are communications from the PC 1 to the lighting elements 2 via control elements 6, 7, 8, to which some data transmission tasks are delegated. It will be appreciated that in the embodiment of the invention using wireless lighting devices a similar hierarchy can be created. Although, where wireless lighting devices are used, dynamic or ad-hoc connections of lighting elements to different and varying wireless base stations may be required.

In the described embodiments of the present invention, details of a location to address mapping are stored either at the PC 1 or at the control elements 6, 7, 8. However, in alternative embodiments of the invention once the location of a lighting element or device is determined, this location is transmitted to the lighting element or device, or alternatively to the appropriate control element. Instructions can then be transmitted by way of broadcast or multicast messages. For example, if space containing lights is divided into a four-layered hierarchy a four element tuple may be used to denote location. In general terms, if space containing lighting elements is divided into a multi-level hierarchy, then an IP-based octtree or quadtree address may be used to denote a special area. Such an approach is describe in further detail below. Instructions indicating that all lights within a cell defined by an element of any one of the levels of the hierarchy may be sent. On receiving such instructions, each lighting element determines whether it is located within any appropriate element, and thereby determines whether it should illuminate, and perhaps with what colour light it should illuminate.

It will be appreciated that a plurality of sets of lighting elements can be used together to produce a larger display.

The methods set out above to locate lighting elements for the purposes of image display, have various other applications, and some such applications are now described. For example, people or equipment could be tracked around a predetermined location using location devices which emit non-visible light. Such location devices can be located using the methods described above, although it should be noted that such location devices are likely to be subject to greater movement than the lighting elements described above.

In embodiments of the invention intended to locate people, for example about a place of work, such people wear a badge bearing an LED configured to emit infrared light. The badge is further configured to continuously transmit an identification code of the type described above, which is appropriately encoded and modulated. This identification code is then detected as people move about the place of work by cameras, the infrared light being invisible to human observers, but being detected clearly by the cameras. If the emitted code is detected by a single camera, this will, at least allow the person associated with the badge having the detected identification code to be located to within the field of view of the camera. If the transmitted identification code is detected by two or more cameras, it can be absolutely located within space, using triangulation methods of the type described above.

If the transmitted code is only detected by a signal camera, this alone may be sufficient to locate the person in space. This can be achieved by assuming that the badge is located at a height of one meter above the ground, as is likely to be the case, and assuming that the camera is positioned considerably higher than one meter above the ground (e.g. at ceiling level within a building), this assumed height of one meter can be used to locate the person within a plane at a height of one meter above the ground. That is, the image and the height measurement can be used together to locate the badge.

It has been described above, that triangulation using two cameras generates equations of straight lines of the form:

$$(C_x+tR_x, C_y+tR_y, C_z+tR_z)$$

In a case such as that described above, it is known that the target is at a height of approximately one meter above the ground. Assuming that this height is defined to be the z dimension, then it is known that:

$$C_z+tR_z=1$$

Given that values of $C_z$ and $R_z$ are known, it is easily possible to derive a value for t. Having derived such a value, it will be appreciated that values for x and y coordinates can be derived by substitution into the equation defined above.

The example described above is concerned with locating a person in a place of work fitted with a plurality of cameras. Very similar techniques can be used to locate items of equipment. Each item of equipment to be located is fitted with a small tagging device, which has the appearance of a small black button and comprises an infrared transmitter. The transmitter continually transmits a unique identification code, which is detected by appropriately positioned cameras, to determine equipment locations. It will be appreciated that the transmitter may transmit its unique identification, either continually or alternatively intermittently or periodically. Again, if a transmitted code is detected by at least a pair of cameras, triangulation can be used to locate the equipment. Where a single camera is used, an assumption as to height level (ground level is likely to be a suitable assumption in this case) can be used to locate equipment using images captured by a single camera, as described above.

It should be noted that the embodiment of the invention described above does not necessarily rely upon additional hardware. Indeed, existing components may be used to achieve the desired aim of location determination. Specifically, devices such as computers may use existing screen devices and devices such as mobile telephones may use LED's which conventionally indicate their power status.

In the location examples above, reference has been made to infrared transmitters. It should be noted that in some embodiments of the invention a ultraviolet or infrared reflector is used, being shuttered by a LCD. For example, the light emitting elements of embodiments of the invention described above may be replaced by suitably reflective surfaces. Any light source may be shone on these reflective surfaces thereby generating a plurality of lighting elements. Each of these lighting elements would appear as a point source of light, in a similar way to an LED. In order to control such reflective surfaces it would be necessary to control reflectivity of the reflective surfaces. Such control of reflectivity can be achieved by providing a surface with controllable opacity (such as an LCD) over a highly reflective surface (such as a mirror). This would result in a low power lighting element which is light reflective rather than light generative.

The embodiments of the invention described above have been concerned with locating lighting elements using visible or invisible light. Some embodiments have been concerned with using the located elements to display images using visible light transmission. However, it should be noted that some embodiments of the present invention operate using sound instead of light, and such embodiments are now described.

FIG. 25 provides an overview of hardware used to generate a three-dimensional soundscape using a plurality of sound transceivers which are located, and then used to transmit sound on the basis of their location. The hardware of FIG. 25 comprises a controller PC 55 which is illustrated in further detail in FIG. 26. It can be seen that the PC 55 has a structure very similar to the PC 1 shown in FIG. 6, and like components are indicated by like reference numerals primed. Such like components, namely the CPU 13', RAM 14', hard disk drive 15', I/O interface 16', keyboard 17', monitor 18', communications interface 19' and bus 20' are not described in further detail here. However, it should be noted that the PC 55 further comprises a sound card 56 having an input 57 through which sound data can be received, and an output 58 through which sound data can be output to, for example, speakers.

Referring back to FIG. 25, it can be seen that PC 55 is connected, to speakers 59, 60, 61, 62 which are connected to the output 58 of the sound card 56. The PC 55 is further connected to microphones 63, 64, 65, 66 which are connected to the input 57 of the sound card 56. The PC 55 is further configured for wireless communication with a plurality of sound transceivers, which in the described embodiment take the form of mobile telephones 67, 68, 69, 70. It should be noted that although only four mobile telephones are shown in FIG. 25, practical embodiments of the invention are likely to include a greater number of mobile telephones or other suitable sound transceivers. Connections between the mobile telephones 67, 68, 69, 70 and the PC 55 can take any convenient form including wireless connections using a mobile telephone network (e.g. the GSM network) or using other protocols such as wireless LAN (assuming that the both the PC 55 and the mobile telephones 67, 68, 69, 70 are equipped with suitable interfaces). Indeed, in some embodiments of the invention the PC 55 and the mobile telephones 67, 68, 69, 70 may be connected together by means of wired connections. Use of the apparatus illustrated in FIG. 25 to produce three-dimensional soundscapes is now described.

First, an embodiment of the invention in which the production of the soundscape is controlled by the PC 55 is described, initially with reference to FIG. 27, which is a flow chart showing a overview of processing. The processing carried out at each step is described in further detail below. At step S45 the mobile telephones 67, 68, 69, 70 all establish connections with the PC 55. At step S46 initial calibration is carried out to locate the mobile telephones 67, 68, 69, 70 in space, and this initial calibration is refined at step S47. At step S48 the mobile telephones are calibrated with respect to output volume and orientation. Having carried out these various calibration processes, sound is presented using the mobile telephones at step S49.

FIG. 28 shows the processing of step S45 of FIG. 27 in further detail. At step S50 the PC 55 waits to receive connection requests from the mobile telephones 67, 68, 69, 70. When such a request is received, processing moves to step S51 where the PC 55 generates data for storage in a data repository, indicative of a connection with that mobile telephone, and indicating that mobile telephone's address, so that data can be communicated to it. It should be noted that the request generated by one of the mobile telephones can take any convenient form. For example, where communication between the mobile telephones 67, 68, 69, 70 and the PC 55 is carried out over a telephone network, the mobile telephone's may call a predetermined number, when a connection is desired, the call to the predetermined number constituting the connection request. A telephone call will then exist between the mobile telephone and the PC 55 for the duration of the connection. Such a telephone call may be made to a predetermined premium rate telephone number. It should also be noted that the addresses allocated to the telephone 67, 68, 69, 70 are likely to be dependent upon the communication mechanism used. For example, where communication is over a telephone network a telephone number can act as the address.

Having established connections between the mobile telephones 67, 68, 69, 70 and the PC 55, calibration is then carried out at step S46 of FIG. 27. This calibration is shown in further detail in FIG. 29, which shows calibration processing carried out by the PC 55. At step S52, the PC 55 causes predetermined tones to be played on the speakers 59, 60, 61, 62. These tones are detected by microphones of the mobile telephones 67, 68, 69, 70, and these detected tones are transmitted to the PC 55. The following processing is carried out for each telephone from which data is received in turn. At step S53 data indicating tone detection is received at step S53. This received data is correlated with the tones output through each of the speakers 59, 60, 61, 62 at step S54, and the output of the correlation is used to calculate the distance of the telephone from each of the speakers 59, 60, 61, 62. This distance data is then used to determine the position of the telephone by triangulation, at step S56. Step S57 determines whether any more telephones need to be calibrated, and if this is so, processing returns to step S53. Otherwise, processing ends at step S58.

The process of triangulation distance calculation is now described in further detail. Each process can take a number of different forms depending on the nature of sounds generated by the speakers at 59, 60, 61, 62. However in general terms the location process involves matching the sounds generated by each of the speakers with the actual sound received by one of the microphones of the mobile telephones, the received sound being a combination of the generated sounds. The received sound is then processed to identify sound components generated by each speaker.

If simple tones are output by the speakers 59, 60, 61, 62, the identification process can be straightforward and a plurality bandpass filters can be applied to the received signal, one bandpass filter applied for each expected frequency. To differentiate the sounds produced by the different speakers. If signals output by the individual speakers are turned on or off, or modulated, then the time taken between transmission and receipt of these modulations gives a good indication of time of flight for the sound from the speakers 59, 60, 61, 62 to the mobile telephone 67, 68, 69, 70. If this time is known, distance between the speakers 59, 60, 61, 62 and the mobile telephones 67, 68, 69, 70 can be determined given that the speed of sound in air is known. Additionally, the relative strength of the signal identified within the received signals by the application of bandpass filters gives a measure of relative distance.

The information set out above allows location to be determined in a number of different ways.

If the time of transmission of sounds through the speakers 59, 60, 61, 62 and the time of receipt of those same sounds at one of the mobile telephones is known, this allows an absolute measure of distance between that mobile telephone and each of the speakers to be determined. For each of the speakers, it can therefore be determined that the mobile telephone is located on the surface of the sphere centred on that speaker and having a radius of the identified distance. The intersection of three spheres, identifies the position of the mobile phone to one of two three dimensional locations, one of which can usually be dismissed given that it would be below ground. If more than three speakers are used (e.g. four speakers as shown in FIG. 25) unique determination and additional accuracy are provided.

If the transmitter and receiver clocks are not synchronised, calculations based upon time of flight measurement may still be possible. For example, if the time at which signal are transmitted through various of the speakers are known, and the relative times at which these same signals are received by one of the mobile telephones is also known the difference between the distance of a speaker to different mobile phones can be determined. Pairs of speakers can then be used to locate the particular mobile telephone on a more complex 3D surfaces (typically hyperbolae of revolution i.e. hyperbolae spun about their principle axis) the intersection of which can be used to determine unique 3D locations.

Relative distance can also be determined on the basis of volume of signals received at the microphone 63, 64, 65, 66. However it should be noted that such measurements are likely to be less robust due to directional sound tendencies.

The techniques described above work well where the speakers 59, 60, 61, 62 output simple tones which can be differentiated from one another using bandpass filters. Where more complex sounds are produced by the speakers 59, 60, 61, 62, such as for example music, a more complex correlation process is required. For example sound expected from the a particular speaker can be determined, and this expected sound can then be multiplied by actual sound received offset by a particular time delay and summed over a short time window. The resulting sum gives an offset covariance which can be used as a measure of signal strength at the delay. The delay with the higher signal strength will then correspond to the time of flight.

In alternative embodiments of the present invention, correlation and distance calculation is not carried out in the manner described above. Instead, the PC 55 computes the sound expected at each point in space. Such computation can be carried out, because it is known what sound is being output from each of the speakers. The received sound can then be the subject of a search through the various expected points, the telephone being determined to be located at the point having the expected sound closest to the received sound.

Manipulations of hue or brightness in locating lighting elements were described above. Location of sound sources may use sound inaudible manipulations to create easier to detect positioning signals whilst playing 'normal' sounds. For example, inaudible high or low frequency pulses can be mixed with the sound source, or the time/frequency characteristics of the sound can be modified in inaudible ways, similar to those used to compress MPEG-3 recordings Having carried out the processing shown in FIG. 29, the location of each telephone is known, and this data can be stored by the PC 55, alongside each telephone's address data. Having determined this location data, the location data is refined at step S47 of FIG. 27, which processing is shown in further detail in FIGS. 30, 31, 32 and 33.

Referring to FIG. 30, at step S59 the PC 55 calculates a spatial sound map, which determines the sound desired at each point in space. Having determined this spatial sound map, the following processing is carried out for each mobile telephone in turn. The location data generated as described above is used to determine the sound which should be played through that mobile telephone's speaker (step S60), and this determined sound is provided to the mobile telephone at step S61. Step S62 determines whether there are more telephones for which processing should be carried out, and if so processing returns to step S60, otherwise processing ends at step S63.

While the processing of FIG. 30 is being carried out, the processing of FIG. 31 is carried out concurrently, for each telephone in turn. At step S64 a telephone for which processing is to be carried out is muted such that it temporarily stops transmitting any sound. The mobile telephone then captures, using its microphone, the sound transmitted by mobile telephones nearby. This captured sound is transmitted to the PC 55, and is received at the central PC 55 at step S65. The received sound is correlated with the spatial sound map calculated at step S59 (FIG. 30), and this correlation is used to refine data stored at the PC 55 indicating that telephone's spatial location. Step S68 determines whether there are any more telephones for which processing is to be carried out. If this is so, processing returns to step S64, otherwise processing ends at step S69. The processing of FIG. 30 is carried out periodically, so as to ensure that accurate location data is maintained.

The processing of FIG. 32 is also carried out concurrently with that of FIGS. 30 and 31. At step S70 the PC 55 receives sound detected by the microphones 63, 64, 65, 66. At step S71 this received sound is correlated with the spatial sound map computed at step S59 of FIG. 30, and this correlation is used to determine a map indicating relative volumes of sound at various points within the space in which the telephones are located (step S72).

Typically, speakers of some mobile telephones will be louder than others, and additionally some areas will include more mobile telephones than others. It may therefore be desirable to adjust the volume of sound played by each mobile telephone so as to achieve a desired soundscape. In order to do this, it is necessary to calculate actual volume of sound produced by all phones in each area in order to produce a volume map for that area.

In a simple case, a volume map can be generated by arranging so that all mobile telephones within a particular area produce a fixed tone. The volume of sound generated by these fixed tones can then be measured from a plurality of known locations (either using fixed microphones, or alternatively using microphones of other mobile telephones). By comparing this measured sound with a known volume which would be expected from a speaker of known power in a known location, effective power within that location can be determined. Doing this sequentially for each area will generate a volume map.

Although this method described above works well, in some embodiments of the invention it is not preferred because it is relatively disruptive. Therefore, more complex techniques based upon bandpass filters or correlation can be carried out on mixed sounds received over a whole area. Rather like extraction of a signal from fixed speakers at each phone (used in the location method described above) signal from fixed microphones can be filtered or collated with sounds being produced in each area to produce a signal strength for each area which can then be compared with expected strength as above in order to determine output power within a particular area.

FIG. 33 illustrates further processing used to refine calibration. This processing is carried out for each telephone in turn, and corresponds to step S48 of FIG. 27. At step S73 the telephone is muted so as to output no sound. At step S74 sound captured by the telephone's microphone is received at the PC 55. At step S75 correlation data is combined with location data for that telephone. This data is used to calculate mobile telephone orientation at step S76 and gain at step S77. Step S78 determines if there are more telephones for which processing is to be carried out, and if this is so processing returns to step S73, otherwise, processing ends at step S79.

It was indicated above that gain of particular telephones' microphones was calculated. Having calculated a mobile telephone's location, the volume of a signal received at that mobile telephone can be compared with the signal which would be expected to be received at that known location by a reference receiver. This allows the gain of the mobile telephone microphone to be calculated. That is, if a microphone of reference sensitivity would be expected to receive a signal of strength 50 at the known location, and the actual received signal strength is 35 then that mobile telephone can be said to have a microphone of 70% sensitivity. If a signal from this mobile telephone is later used, for example in refining a volume map or location then the received figure can be manipulated using this known gain value so as to convert the received value into what would be expected from a microphone having reference sensitivity.

Additionally, it was also described above that orientation for each mobile telephone is determined. If it is known that a mobile telephone is equidistant from two speakers, which are both producing sound of equal volume, if the strength of signal from one speaker is higher than another it can be inferred that the microphone is orientated towards the speaker from which the greatest quantity of signal is received. Taking similar readings from a number of speakers will typically provide more accurate estimates of rotation. It should be noted that although orientation can be calculated in this way, given that mobile telephones are hand held this information is unlikely to be of great value given that the orientation is likely to change quickly over time. However, for alternative embodiments with devices with a more fixed orientation, this level of calibration can allow directional as well as spatially organised sound production.

FIG. 34 illustrates processing carried out at step S49 of FIG. 27 by the PC 55 to produce desired sound using the mobile telephones. At step S80, the desired spatial sound is computed, and this spatial sound map is combined with a desired volume map at step S81 to generate a modified spatial sound at step S82. The following processing is carried out for each telephone in turn. The mobile telephone's location (as previously determined) is obtained. This location data is used to carry out a look up operation on the modified spatial sound generated at step S82, to determine the sound to be output by that telephone (step S83). The required sound is then provided to the telephone at step S84. Step S85 determines whether there are further telephones for which processing should be carried out. If this is so processing returns to step S84, else processing ends at step S86.

The processing described above with reference to FIGS. 28 to 34 has been concerned with processing carried out by the PC 55. Processing carried out by one of the mobile telephones 67, 68, 69, 70 is now described, with reference to the flow chart of FIG. 35. At step S87 the mobile telephone connects to the PC 55 using processing of the type described above. The mobile telephone then carries out two streams of processing in parallel. A first stream of processing involves receiving audio data from the PC 55 (step S88), and outputting this received audio data on the mobile telephone's speaker (step S89) such that the mobile telephone, in combination with the other mobile telephones, generates a three-dimensional soundscape. A second stream of processing captures sound using the mobile telephone's microphone (step S90), and transmits this to the PC 55 (step S91). This second stream of processing provides data to the PC 55 to allow location data to be maintained and returned.

The embodiment of the invention described above operating to generate a three-dimensional soundscape is such that a central PC 55 determines the sound to be output from each telephone, and provides appropriate sound data. In alternative embodiments of the invention, the telephones may themselves determine what sounds they should output. Such an embodiment is illustrated in FIG. 36.

Referring to FIG. 36, at step S92 calibration data to be used to calibrate the mobile telephones is downloaded. This calibration data may include data indicating tones to be generated by a mobile telephone during the calibration process and may also include data indicating sounds which are expected to be generated by other devices, at different spatial locations. At step S93, sounds generated by other mobile phones are received through the mobile telephones microphone, and the calibration data and received sound are then used in order to perform correlation operations at step S94. These correlation operations can be carried out as set out above, although it should be noted that in general terms correlation operations using relatively low computer power are preferred given the relatively limited processing capacity of the mobile telephone. Having carried out these correlation operations the location of the mobile telephone can be determined at step S95.

Having performed the processes set out above the mobile telephone is configured to participate in generation of a soundscape of the type described above. Therefore, at step S96 sound data indicative of the sound to be generated is downloaded. At step S97 the received sound data is processed using the determined location data and used to determine the sound to be output by that mobile telephone. The determined sound is then output at step S98.

It should be noted that although step S96 to S98 are shown as occurring after steps S92 to S95, in some embodiments of the invention the processing of steps S96 to S98 is carried out in parallel with the processing of steps S92 to S95.

Having described embodiments of the invention using both light and sound, addressing schemes suitable for use in embodiments of the present invention are now described. It has already been explained (for example with reference to FIG. 5) that control of lighting elements is preferably handled hierarchically. It is preferred that each of the control elements 6, 7, 8 control lighting elements within a predetermined part of the space to be illuminated. That is, if appropriate addressing mechanisms are used, only parts of addresses need to be handled at various levels of the hierarchy. For example, a first part of an address may simply indicate one of the control elements. This would be the only part of the address processed by the central controller PC 1. A second part of an address detailing individual lighting elements can then be used by the control elements to instruct the correct lighting elements. Addressing schemes are now described in further detail.

A spatial address system is at present preferred, in which lighting elements can be addressed on the basis of their spatial location, for example an instruction can be provided to turn on all lights in a 10 cm cube centred at coordinates (12,−3,7). Referring to FIG. 37, it can be seen that a spatial address 75 can be converted into a plurality of native addresses 76, each associated with a lighting element located as indicated by the spatial address.

Furthermore, it should be noted that presently preferred embodiments of the invention use IPv6 addresses. As shown in FIG. 38, an IPv6 address is 128 bits long (16 octets) and is typically composed of two logical parts: a 64-bit networking prefix 77 and a 64-bit host-addressing suffix 78.

The 64 bit host-addressing suffix 78 is not interpreted outside the network indicated by the 64-bit networking prefix 77, and can therefore be used to encode information directly relating to the network indicated by the networking prefix 77. The 64 bit suffix can be used to encode three dimensional location data, as shown in FIG. 39 where it can be seen that the 64-bit host-addressing suffix comprises a first component 79 indicating an x co-ordinate, a second component 80 indicating a y co-ordinate, and a third component 81 indicating a z co-ordinate. Each of the three components comprises 21 bits, and one bit is unused. The 21 bits available for each x, y, z coordinate allow cubes of one cubic millimeter to be individually addressed in a 2 km cube. Similarly this addressing scheme could provide three dimensional addressing for the Earth, allowing a multi-resolution mapping to 1 meter longitude-latitude resolution and 1 meter height resolution to 10,000 meters and 10 meter height resolution to 100,000 meters, sufficient to locate, for example, any plane or ship.

This is considerably finer grained addressing than would be necessary for most applications. In practice, a smaller and non-cubic addressing may be used. The coordinate frame for applications such as this would usually be relative to some point in the display or the original calibrating camera locations.

In alternative embodiments, the host addressing suffix 78 may be divided into two components, each comprising 32-bits, to indicate two-dimensional location data. Indeed, it will be appreciated that the host-addressing suffix 78 can be interpreted by the network indicated by the networking prefix 77 in any convenient manner, and can thus represent combinations of, for example, spatial location, time and direction or even, in some embodiments, book ISBN and page number.

FIG. 40 illustrates, a longitude-latitude two dimensional encoding in which the host addressing suffix 78 comprises two components. A first component 82 comprises 31-bits and represents latitude, while a second component 83 comprises 32-bits and represents longitude. There is also a third component that comprises an unused bit. Such an addressing scheme provides addresses which refer to 1 cm squares of the Earth's surface. It should be noted that the second component 83 representing longitude comprises an additional bit as compared with the first component 82. This is because the circumference of the Earth is approx 40,000 km whereas the distance from North Pole to South Pole is 20,000 km. The addressing scheme illustrated in FIG. 40 allows a network to be represented in which a virtual web server is provided for each point on the Earth's surface, the webservers providing data such as elevation and land use. Such webservers could alternatively provide geospatial URIs for semantic web applications.

Referring to FIG. 41, IPv6 addresses of the type described above can be transmitted between a first computer 84 and a second computer 85 via the Internet 86. Although the host addressing suffixes of such addresses may represent spatial information, given that only the networking prefix 77 is used for routing by the Internet 86, addresses of the type described above can be transmitted transparently through the Internet 86.

When an address reaches a network indicated by the networking prefix 77, the 64 bit suffix is converted into native non-spatial addresses. This conversion is schematically illustrated in FIG. 37.

In alternative embodiments of the present invention, IPv6 addresses representing spatial information can be interpreted as such by a network of appropriately configured routers and network controllers, which have knowledge of the manner in which spatial addressing is carried out. Such embodiments of the network operate by maintaining spatial address ranges within routers, so that broadcast and multicast messages can be controlled so as to be only transmitted to relevant network nodes. Such an embodiment of the invention is shown in FIG. 42.

Referring to FIG. 42, it can be seen that a first router 87, a second router 88 and a third router 89 are connected to a network 90. It can be seen that data intended for an address 2001:630:80:A000:FFFF:5856:4329:1254 is transmitted on the network. This data, together with its associated address is passed to the three routers 87, 88, 89. As described above, this address encapsulates spatial data. Given that the routers 87, 88 are configured spatially, they determine that their respective connected devices 91, 92 do not require data associated with that spatial location. Accordingly, the data is not passed on by the routers 87, 88. Conversely, the router 89 determines that its three connected components do need to receive data intended for that spatial location, and accordingly the router 89 forwards the data to the components 93.

It should be noted that operation of the invention as shown in FIG. 42 requires the use of a spatially aware routing protocol. Such a protocol may include transformation of data from one coordinate system to another.

One such a spatial routing protocol used in embodiments of the present invention may associate each of the routers 87, 88, 89 with a three dimensional bounding box, the bounding box including all devices which are connected to that router. For a router positioned relatively highly within the hierarchy, bounding boxes are calculated so as to include bounding boxes of all connected routers. In such a system spatial addresses can then be compared with a bounding box of a router, and if the region addressed is within that bounding box the message is passed on to the lower routers, where the process is repeated.

Using high-resolution spatial addressing schemes such as those described above does have some problems. As volume data sets can be very large, it is not always possible to render an entire scene by addressing each constituent volume individually, given the limitations of widely available computing power. For example, producing a cubic-millimeter resolution black/white voxel-map for a 10 cubic meter volume would take twelve days at a transfer rate of 1 megabit per second. Furthermore, in the case of lighting elements, the spacing between lights may be far larger than the resolution. Thus, an instruction to turn on lighting elements within a particular 1 mm cube is likely to have no effect, as it is unlikely that a lighting element with be positioned within that 1 mm cube.

The present invention overcomes some of the problems outlined above in a number of ways. For example different resolutions are used for different lighting networks. A greater quantity of descriptive data is transmitted, such as X3D-like mark-up or other forms of solid modelling description.

However, some embodiments of the invention create a multi-resolution encoding within a single spatial address using a hierarchical data structure. This is based upon the fact that the number of bits needed for lower-resolution addresses drops rapidly.

For example, a location (i.e. a one dimensional spatial address) on a one meter ruler can be specified using 8 bits to encode the location using a hierarchical data structure. For an 8 bit encoding system, the number of "1"s before the first "0" bit generates a "level indicator" Seven "1" s specifies the top level (the whole ruler), the next level is six "1"s followed by a "0", and the bottom level (level 8) is given by a single leading "0". The bits not used to indicate the level are used to locate the actual address of the desired range. The most accurate way of specifying a location using this hierarchical structure is using a spatial address beginning with a '0'. This allows an 8 mm range to be specified:

$$\frac{1000}{2^7} \approx 8 \text{ mm}$$

Similarly, leading bits of "10" mean the remaining six bits can specify a 16 mm range, "110" provide 32 mm range, and so on. This means we can either refer to each 8 mm segment of the ruler, to any 16 mm segment, or to the first or second half as a whole at approximately 500 mm accuracy, or simply specify the entire ruler. This is illustrated below in Table 2:

TABLE 2

| Leading Bits | Number of Location Bits required | Number of locations that could be specified | Accuracy/ mm |
|---|---|---|---|
| 0 | 7 | 128 | 8 |
| 10 | 6 | 64 | 16 |
| 110 | 5 | 32 | 32 |
| 1110 | 4 | 16 | 63 |
| 11110 | 3 | 8 | 125 |
| 111110 | 2 | 4 | 250 |
| 1111110 | 1 | 2 | 500 |
| 11111110 | 0 | 1 | 1000 |

The equivalent of this spatial addressing method for a three dimensional system is to use a data structure known as an octree.

An octree is a data structure, in which each node of the octree represents a cuboidal volume, each node representing one octant of its parent. Such a structure is shown schematically in FIG. 43. It can be seen that a top-level volume 94 comprises eight component volumes 95. Each of these eight component volumes themselves contain eight component volumes 96.

For a 64 bit encoding system (i.e. one which can be accommodated within the host addressing suffix of an IPv6 address), the number of "1"s before the first "0" bit generates a level indicator. Twenty-one "1"s means the top level. That is the cube 94 can be addressed as a whole, but its component volumes 95 cannot be individually addressed. The next level is indicated by twenty leading "1"s followed by a "0", this level provides three bits which can be used to identify the volumes 95 in terms of x, y and z values. Such values are shown in FIG. 43 in connection with the volumes 95.

The next level is indicated by nineteen leading "1"s followed by a "0". This level provides six bits which can be used to individually address the volumes 96, although further subdivisions cannot be individually addressed.

At a lowest level (level 21) single voxels can be individually addressed. This level is indicated by a leading "0". Such lowest level addresses are identical to addresses shown in FIG. 39, the spare bit being used to indicate the level of the address.

The various levels of the addressing hierarchy, together with their associated resolution, are shown in table 3 below:

TABLE 3

| Number of Leading 1s | Leading Bits | Number of Bits for each x, y, z | Number of Location Bits Required | Number of segments that could be specified for each x, y, z | Total Addressable Volume Regions | Resolution |
|---|---|---|---|---|---|---|
| 0 | 0 | 21 | 63 | $2^{21}$ | $8^{21}$ | $2^{0}$ |
| 1 | 10 | 20 | 60 | $2^{20}$ | $8^{20}$ | $2^{1}$ |
| 2 | 110 | 19 | 57 | $2^{19}$ | $8^{19}$ | $2^{2}$ |
| 3 | 1110 | 18 | 54 | $2^{18}$ | $8^{18}$ | $2^{3}$ |
| 4 | 1111 0 | 17 | 51 | $2^{17}$ | $8^{17}$ | $2^{4}$ |
| 5 | 1111 10 | 16 | 48 | $2^{16}$ | $8^{16}$ | $2^{5}$ |
| 6 | 1111 110 | 15 | 45 | $2^{15}$ | $8^{15}$ | $2^{6}$ |
| 7 | 1111 1110 | 14 | 42 | $2^{14}$ | $8^{14}$ | $2^{7}$ |
| 8 | 1111 1111 0 | 13 | 39 | $2^{13}$ | $8^{13}$ | $2^{8}$ |
| 9 | 1111 1111 10 | 12 | 36 | $2^{12}$ | $8^{12}$ | $2^{9}$ |
| 10 | 1111 1111 110 | 11 | 33 | $2^{11}$ | $8^{11}$ | $2^{10}$ |
| 11 | 1111 1111 1110 | 10 | 30 | $2^{10}$ | $8^{10}$ | $2^{11}$ |
| 12 | 1111 1111 1111 0 | 9 | 27 | $2^{9}$ | $8^{9}$ | $2^{12}$ |
| 13 | 1111 1111 1111 10 | 8 | 24 | $2^{8}$ | $8^{8}$ | $2^{13}$ |
| 14 | 1111 1111 1111 110 | 7 | 21 | $2^{7}$ | $8^{7}$ | $2^{14}$ |
| 15 | 1111 1111 1111 1110 | 6 | 18 | $2^{6}$ | $8^{6}$ | $2^{15}$ |
| 16 | 1111 1111 1111 1111 0 | 5 | 15 | $2^{5}$ | $8^{5}$ | $2^{16}$ |
| 17 | 1111 1111 1111 1111 10 | 4 | 12 | $2^{4}$ | $8^{4}$ | $2^{17}$ |
| 18 | 1111 1111 1111 1111 110 | 3 | 9 | $2^{3}$ | $8^{3}$ | $2^{18}$ |
| 19 | 1111 1111 1111 1111 1110 | 2 | 6 | $2^{2}$ | $8^{2}$ | $2^{19}$ |
| 20 | 1111 1111 1111 1111 1111 0 | 1 | 3 | $2^{1}$ | $8^{1}$ | $2^{20}$ |
| 21 | 1111 1111 1111 1111 1111 10 | 0 | 0 | $2^{0}$ | $8^{0}$ | $2^{21}$ |

In table 3, the number of leading 1's column (column 1) specifies the number of 1's in the address before the first zero. The leading bits column (column 2) specifies the initial bits in the address that can be used to uniquely identify this level of the addressing hierarchy. This consists of the number of 1's specified in column 1 plus a single zero. The number of bits for each x, y, z column (column 3) specifies the number of bits used for a single coordinate. Because of the different resolutions at each level in the hierarchy, more or less bits are required to store the x, y, z coordinates. The number of location bits required column (column 4) is equal to three times the number in column 3. This is because three coordinates are required to address the volume regions at each hierarchy level. At each level of the hierarchy there are different numbers of cuboid regions. The number of segments that can be specified for each x, y, z column (column 5) states how many of these cuboid regions there are across a single dimension. For example, in FIG. 43 at the top level only one cube fits along the x direction, but the level below has two across the x direction and the one below has four. The total addressable volume regions column (column 6) gives the total number of cuboids that can be specified at a level in the hierarchy. For example, in FIG. 43, there is one cube at the top level, eight at the second level and fifty-four at the next level. This column is precisely the value given in column 5 (the number of segments that could be specified for each x, y, z) raised to the power of three. The resolution column (column 7) gives the side length of the cuboids addressed at each level. This is given relative to the smallest addressable region. That is the lowest level is "size" 1. The physical size of these regions and indeed whether these are uniformly and linearly mapped onto physical space depends on a precise situation of use. For example, if used for large scale geographic addressing, the x and y may be longitude and latitude and the z direction height. Then, the precise size of each of these in meters would vary depending on location.

Using the addressing scheme described above, it is possible to address messages to any octree cube from single voxels to the entire space.

For example, it would be possible to send an instruction to illuminate all lighting elements within the volume: 11111111 11111111 11100000 00000000 00000000 00000000 00000000 00 01 10 10. The nineteen "1"s at the start of the address indicate the level. As is shown in the above table, there are two bits (i.e. $2^2=4$) used to code the range in the x, y and z directions. The last six bits of the address (01, 10, 10) indicate the x, y, z co-ordinates of the volume.

This would address all the voxels in the following address range:

$2^{19} \leqq x < 2\hat{}20$ location 01, resolution of $2^{19}$ voxels $2^{20} \leqq y < 2\hat{}20+2\hat{}19$ location 10, resolution of $2^{19}$ voxels $2^{20} \leq z < 2^{\wedge}20+2^{\wedge}19$ location 10, resolution of $2^{19}$ voxels Looking at these equations in further detail, it should be noted that the 19 leading 1 indicate that volumes being addressed are $2^{19}$ times the width of base voxels. The encoded x coordinate is 01 binary, so refers to a region with x coordinates between $1 \times 2^{19}$ and $2 \times 2^{19}$, or from 0 1000 0000 0000 0000 0000 to 0 1111 1111 1111 1111 1111 inclusive.

The use of an octree requires much less data to be transferred than addressing every individual voxel within a range individually.

An alternative mapping, still using an octree data structure, is to keep fixed initial starting bit locations for the x, y, z coordinates and use the trailing bits to determine the level. This would have advantages for bounding box filtering at routers. For example, the x, y, z location above would instead encode as: 01000000 00000000 00000100 00000000 00000000 00100111 11111111 11111111.

These compact mappings have plenty of 'spare' bits at the lower resolutions allowing a variety of other shapes, rotations or offset regions to be included in the same address range.

The above description refers to the addressing of regions of space. The message is sent to such spatial address normally carry some payload. For example messages in the form "turn all lights on in this region" or "turn all lights in this region to blue" could be included.

It will be appreciated that the present invention is applicable to a wide range of sizes of signal sources, allowing the apparatus of the present invention to be reduced down to micron or nano scale. Such small scale apparatus may result in the ability to develop, deploy, calibrate and control vast arrays of the micron or nano signal sources using the present invention. For example, displays such as cathode ray tubes, liquid crystal displays and plasma screens may be constructed using such small-scale signal sources. It will be appreciated that with such miniaturised signal sources, such display devices maybe be deployed in an ad-hoc fashion. For example, it is envisaged that miniature signal sources may be sprayed onto a supporting structure (e.g. a wall) from a canister, and are then calibrated using the techniques of the present invention. It will be appreciated that in such ad-hoc application, the small signal sources may draw power from a substrate deposited prior to or along with the deposition of the signal sources. The substrate itself may be connected to a power source.

Various embodiments of the present invention have been described above, by way of example. It will be appreciated that features of the various described embodiments can be combined in a number of different ways. Such combinations will be readily apparent to those of ordinary skill in the art. It should also be noted that the description provided above is in no way intended to be limiting. Rather it is exemplary, and modifications will be apparent to those of ordinary skill in the art. Such modifications are within the spirit and scope of the present invention. In particular, it will be appreciated that where features of the invention have been described in terms of lighting elements some such features are equally applicable to any suitable device. For example, where schemes for addressing lighting elements have been described it will be appreciated that such addressing schemes can similarly be used for other devices.

The invention claimed is:

1. A method of presenting an information signal using a plurality of signal sources, said plurality of signal sources being located within a predetermined space, the method comprising:

receiving a respective positioning signal from each of said signal sources;

wherein receiving a respective positioning signal from each of the signal sources comprises receiving a positioning signal transmitted from each said signal source at a signal receiver, the signal receiver being configured to produce two-dimensional location data locating said signal source within a detection frame;

generating location data indicative of locations of said plurality of signal sources, based upon said positioning signals, wherein generating said location data comprises generating location data based upon said two-dimensional location data;

generating output data for each of said plurality of signal sources based upon said information signal and said location data; and transmitting said output data to said signal sources to present said information signal.

2. A method according to claim 1, wherein said detection frame defines an array of pixels, and said signal receiver produces data indicating at least one pixel of said array of pixels.

3. A method according to claim 1, wherein receiving a positioning signal transmitted from each said signal source comprises:

receiving said positioning signals using a camera, wherein said positioning signals comprise emissions of electromagnetic radiation detectable by the camera.

4. A method according to claim 3, wherein receiving said signal positioning signals using a camera comprises:

receiving said positioning signals using a charge coupled device (CCD) sensitive to electromagnetic radiation.

5. A method according to claim 3 wherein generating said location data further comprises temporally grouping frames generated by said camera to generate said identification data.

6. A method according to claim 5, wherein temporally grouping a plurality of said frames to generate said identification data comprises processing areas of said frames which are within a predetermined distance of one another.

7. A method according to claim 1, wherein receiving said positioning signals further comprises:

receiving a positioning signal transmitted from each said signal source at a plurality of signal receivers, the signal receivers each being configured to produce two-dimensional location data locating said signal source within a respective detection frame.

8. A method according to claim 7, wherein generating said location data further comprises combining said two-dimensional location data generated by said plurality of signal receivers to generate said location data.

9. A method according to claim 8, wherein combining said two-dimensional location data comprises combining said two-dimensional location data by triangulation or trilateration.

10. A method of presenting an information signal using a plurality of signal sources, said plurality of signal sources being located within a predetermined space, the method comprising:

receiving a respective positioning signal from each of said signal sources;

generating location data indicative of locations of said plurality of signal sources, based upon said positioning signals;

generating output data for each of said plurality of signal sources based upon said information signal and said location data; and transmitting said output data to said signal sources to present said information signal, wherein each of said signal sources is a reflector of electromagnetic radiation.

11. A method according to claim 10, wherein each of said signal sources is a reflector of electromagnetic radiation with controllable reflectivity.

12. A method according to claim 10, wherein each of said signal sources comprises a reflective surface and an element of variable opacity, said element of variable opacity being configured to control reflectivity of said signal source.

13. A method of presenting an information signal using a plurality of signal sources, said plurality of signal sources being located within a predetermined space, the method comprising:

receiving a respective positioning signal from each of said signal sources, comprising transmitting sound signals to at least some of said plurality of signal sources wherein transmitting sound signals to at least some of said plurality of signal sources comprises transmitting a plurality of sound signals to each of said at least some of said plurality of signal sources, each of said plurality of sound signals being transmitted from a different spatial position and receiving data indicating sound signals received at said at least some of said plurality of signal sources from said signal sources, wherein each of said plurality of sound signals is different;

generating location data indicative of locations of said plurality of signal sources, based upon said positioning signals, comprising processing data indicating sound signals received at said at least some of said plurality of signal sources to generate said location data, the processing data comprising filtering said received data to generate components derived from said plurality of different sound signals transmitted to said signal sources generating output data for each of said plurality of signal sources based upon said information signal and said location data; and transmitting said output data to said signal sources to present said information signal.

14. A method according to claim 13, wherein processing said data further comprises:

generating said location data based upon relative strengths of said components.

15. A method according to claim 13, wherein said plurality of sound signals are transmitted at predetermined times, and said processing said data comprises determining a time difference between transmission of each sound signal, and receipt of that sound signal at a signal source.

16. A method of locating and identifying a signal source, the method comprising:

receiving a signal transmitted from said signal source by a signal receiver, the signal receiver being configured to produce two-dimensional location data locating said signal source within a detection frame;

generating location data based upon said two-dimensional location data;

processing said received signal, said received signal comprising a plurality of temporally separated signal transmissions; and determining, from said received plurality of temporally separated signal transmissions, an identification code for said located signal source.

17. A method according to claim 16, wherein said plurality of temporally separated signal transmissions constitute a modulated form of an identification code of the signal source.

18. A method according to claim 17, wherein plurality of temporally separated signal transmissions constitute a Binary Phase Shift Keying modulated form or a Non Return to Zero modulated form of an identification code of the signal source.

19. A method according to claim 16, wherein the said signal source has an associated address, and said identification data for a signal source has a predetermined relationship with the respective address.

20. A method according to claim 19, wherein the identification data for each signal source is the address of that signal source.

21. A method according to claim 16, wherein receiving a signal transmitted from said signal source by a signal receiver comprises receiving a plurality of temporally spaced emissions of electromagnetic radiation.

22. A method according to claim 21, wherein said electromagnetic radiation is visible light.

23. A method according to claim 21, wherein said electromagnetic radiation is infra-red radiation or ultra-violet radiation.

24. A method according to claim 16, wherein said detection frame defines an array of pixels, and said signal receiver produces data indicating at least one pixel of said array of pixels.

25. A method according to claim 16, wherein receiving a signal transmitted from said signal source by a signal receiver:

receiving said signal using a camera, wherein said signal comprises emissions of electromagnetic radiation detectable by the camera.

26. A method according to claim 25, wherein receiving said signal using a camera comprises:

receiving said signal using a charge coupled device (CCD) sensitive to electromagnetic radiation.

27. A method according to claim 25, wherein generating said identification code comprises temporally grouping a plurality of frames captured by said camera to generate said identification code.

28. A method according to claim 27, wherein temporally grouping a plurality of frames to generate said identification code comprises processing areas of said frames which are within a predetermined distance of one another.

29. A method according to claim 16, wherein receiving said signals further comprises:

receiving a signal transmitted from said signal source at a plurality of signal receivers, the signal receivers each being configured to produce two-dimensional location data locating said signal source within a respective detection frame.

30. A method according to claim 29, wherein generating said location data further comprises combining said two-dimensional location data generated by said plurality of signal receivers to generate said location data.

31. A method according to claim 30, wherein combining said two-dimensional location data comprises combining said two-dimensional location data by triangulation or trilateration.

32. A method according to claim 16, wherein generating said location data comprises generating three-dimensional location data from said two-dimensional location data.

33. A method according to claim 32, wherein generating three-dimensional location data from said two-dimensional location data comprises basing said three-dimensional location data upon an assumed location in one of said three dimensions.

34. A method according to claim 16, wherein said signal source is associated with a person or an item of equipment.

35. A carrier medium carrying computer readable program code configured to cause a computer to carry out a method of locating and identifying a signal source, the method comprising:

receiving a signal transmitted from said signal source by a signal receiver, the signal receiver being configured to produce two-dimensional location data locating said signal source within a detection frame;

generating location data based upon said two-dimensional location data;

processing said received signal, said received signal comprising a plurality of temporally separated signal transmissions; and determining, from said received plurality of temporally separated signal transmissions, an identification code for said located signal source.

36. A computer apparatus for locating and identifying a signal source, the apparatus comprising:

a program memory storing processor readable instructions; and a processor configured to read and execute instructions stored in said program memory;

wherein said processor readable instructions comprise instructions controlling said processor to carry out a method of locating and identifying a signal source, the method comprising:

receiving a signal transmitted from said signal source by a signal receiver, the signal receiver being configured to produce two-dimensional location data locating said signal source within a detection frame;

generating location data based upon said two-dimensional location data;

processing said received signal, said received signal comprising a plurality of temporally separated signal transmissions; and determining, from said received plurality of temporally separated signal transmissions, an identification code for said located signal source.

37. Apparatus for locating and identifying a signal source, the apparatus comprising:

a receiver for receiving a signal transmitted from said signal source by a signal receiver, the signal receiver being configured to produce two-dimensional location data locating said signal source within a detection frame; and a processor configured to generate location data based upon said position within said detection frame, process said received signal, the received signal comprising a plurality of temporally separated signal transmissions, and to determine from the received plurality of temporally separated signal transmissions an identification code for said located signal source.

* * * * *